US006558863B2

(12) United States Patent
Rokutanzono et al.

(10) Patent No.: US 6,558,863 B2
(45) Date of Patent: May 6, 2003

(54) ELECTROPHOTOGRAPHIC PHOTORECEPTOR, ELECTROPHOTOGRAPHIC IMAGE FORMING METHOD AND APPARATUS USING THE PHOTORECEPTOR

(75) Inventors: Takashi Rokutanzono, Tachikawa (JP); Tamotsu Aruga, Mishima (JP); Tatsuya Niimi, Numazu (JP); Yoshiaki Kawasaki, Susono (JP)

(73) Assignee: Ricoh Company Limited, Tokyo (JP)

( * ) Notice: Subject to any disclaimer, the term of this patent is extended or adjusted under 35 U.S.C. 154(b) by 46 days.

(21) Appl. No.: 09/734,718

(22) Filed: Dec. 13, 2000

(65) Prior Publication Data

US 2001/0016296 A1 Aug. 23, 2001

(30) Foreign Application Priority Data

Dec. 13, 1999 (JP) ..... 11-352720
Feb. 21, 2000 (JP) ..... 2000-042702

(51) Int. Cl.[7] ..... G03G 5/047

(52) U.S. Cl. ..... 430/58.7; 430/56; 430/59.5; 430/78; 430/126; 399/116; 399/159

(58) Field of Search ..... 430/56, 58.7, 59.5, 430/78, 59.1, 126; 399/159, 116, 156

(56) References Cited

U.S. PATENT DOCUMENTS 4,664,997 A * 5/1987 Suzuki et al. ..... 430/59.5
5,430,526 A * 7/1995 Ohkubo et al.
5,593,805 A * 1/1997 Go et al. ..... 430/78
5,871,876 A * 2/1999 Ikuno et al. ..... 430/58.7
6,190,811 B1 * 2/2001 Tanaka et al. ..... 430/78
6,248,490 B1 * 6/2001 Suzuki et al. ..... 430/78

FOREIGN PATENT DOCUMENTS

JP 64-66658 * 3/1989 ..... 430/56

OTHER PUBLICATIONS

Derwent Abstract Acc. No. 89–119610/16 describing JP 01–66658. pub 1989, attached to JP 64–66658, 1989.*
Caplus Abstract Acc. No. 1989:505751 describing JP 01–66658, pub 1989.*
Japio Abstract An. 1989–06658 describing JP 01–66658, pub 1989.*
Ladd, M.F.C. et al. ed. Structure Determination by X–Ray Crystallography, 2nd ed., Plenum Press, NY (1985), pp. 424–426, 1985.*
US Patent & Trademark Office English–Language Translation of JP 64–66658 (pub 3/89), Mar. 1989.*
JPO Abstract of Japanese Laid–Open Patent Publication No. 03035064, Feb. 15, 1991.
JPO Abstract of Japanese Laid–Open Patent Publication No. 03035245, Feb. 15, 1991.
JPO Abstract of Japanese Laid–Open Patent Publication No. 03037669, Feb. 19,1991.
JPO Abstract of Japanese Laid–Open Patent Publication No. 03269064, Nov. 29, 1991.
JPO Abstract of Japanese Laid–Open Patent Publication No. 07319179, Dec. 8, 1995.
JPO Abstract of Japanese Laid–Open Patent Publication No. 57148745, Sep. 14,1982.
JPO Abstract of Japanese Laid–Open Patent Publication No. 59031965, Feb. 21, 1984.
JPO Abstract of Japanese Laid–Open Patent Publication No. 59036254 (Abstract), Feb. 28, 1984.
JPO Abstract of Japanese Laid–Open Patent Publication No. 59044054 (Abstract), Mar. 12, 1984.
JPO Abstract of Japanese Laid–Open Patent Publication No. 59049544 (Abstract), Mar. 22, 1984.
JPO Abstract of Japanese Laid–Open Patent Publication No. 59166959 (Abstract), Sep. 20,1984.
JPO Abstract of Japanese Laid–Open Patent Publication No. 61239248 (Abstract), Oct. 24, 1986.
JPO Abstract of Japanese Laid–Open Patent Publication No. 62067094 (Abstract), Mar. 26, 1987.
JPO Abstract of Japanese Laid–Open Patent Publication No. 63000366 (Abstract), Jan. 5, 1988.
JPO Abstract of Japanese Laid–Open Patent Publication No. 63116158 (Abstract), May 20, 1988.
JPO Abstract of Japanese Laid–Open Patent Publication No. 63196067 (Abstract), Aug. 15, 1988.
JPO Abstract of Japanese Laid–Open Patent Publication No. 01017066 (Abstract), Jan. 20, 1989.
JPO Abstract of Japanese Laid–Open Patent Publication No. 02028265 (Abstract), Jan. 30, 1990.
JPO Abstract of Japanese Laid–Open Patent Publication No. 01299874 (Abstract), Dec. 4, 1989.
JPO Abstract of Japanese Laid–Open Patent Publication No. 02008256 (Abstract), Jan. 11, 1990.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A photoreceptor including an electroconductive substrate and a photosensitive layer which is formed on the electroconductive substrate and which includes a charge generation material, wherein the charge generation material comprises an organic pigment and wherein the photosensitive layer further includes at least one ion selected from the group consisting of $K^+$, $Na^+$, $NO_3^-$, $HCOO^-$, $NO_2^-$, $Cl^-$, $Br^-$, and $NH_4^+$ or one or more water-soluble inorganic salts.

71 Claims, 6 Drawing Sheets

ELECTROPHOTOGRAPHIC PHOTORECEPTOR, ELECTROPHOTOGRAPHIC IMAGE FORMING METHOD AND APPARATUS USING THE PHOTORECEPTOR

BACKGROUND OF THE INVENTION

1. Field of the Invention

The present invention relates to an electrophotographic photoreceptor. In addition, the present invention relates to an electrophotographic image forming method, apparatus and process cartridge using the electrophotographic photoreceptor.

2. Discussion of the Background

Recently the growth of electrophotographic image forming apparatus using a photoreceptor such as copiers, printers and facsimiles is remarkable. In particular, photo-printers capable of recording digital information using light have been drastically improving in recording qualities and reliability. This digital recording technique is applied to copiers as well as photo-printers. The digital copiers to which this digital technique is applied have various image forming functions. Therefore it is considered that the demand for the digital copiers increases more and more.

As the photoreceptor used for such image forming apparatus, photoreceptors using an organic photosensitive material are typically used because of having advantages such as low manufacturing costs, low toxicity and good film formability over inorganic photosensitive materials such as selenium.

Photoreceptors using an organic photosensitive material include single-layered photoreceptors, and multi-layered photoreceptors. Single-layered photoreceptors include a photosensitive layer which is formed on an electroconductive substrate and which typically includes a charge generation material, a charge transport material and a binder resin. The photosensitive layer is typically formed by coating a coating liquid including such constituents on a substrate using a coating method such as dip coating methods.

In multi-layered photoreceptors, the photosensitive layer typically includes a charge generation layer which is formed on an electroconductive substrate and which includes a charge generation material, and a charge transport layer which is formed on the charge generation layer and which includes a charge transport material. The multi-layered photoreceptors typically include an undercoat layer which is formed between the substrate and the charge generation layer, and/or a protective layer which is formed on the charge transport layer, to improve the image qualities and durability of the resultant photoreceptors.

At the present time, laser diodes (LDs) and light emitting diodes (LEDs) are used as light sources for the photo-printers because of being small in size, and having a relatively low cost and good reliability. The LEDs which are typically used for the photo-printers emit light having a wavelength of 660 nm. The LDs which are typically used for the photo-printers emit near infrared light. Therefore, a need exists for a photoreceptor having high sensitivities over a wavelength range including the visible region and the near infrared region.

The wavelength range over which an electrophotographic photoreceptor has sensitivity almost equal to the wavelength range over which the charge generation material used in the photoreceptor has photosensitivity. Therefore, various kinds of materials, such as azo type pigments, polycyclic quinone type pigments, trigonal system selenium, phthalocyanine pigments and the like, have been developed for the charge generation materials.

Among these materials, titanyl phthalocyanine pigments (hereinafter sometimes referred to as TiOPc), which have been disclosed in Japanese Laid-Open Patent Publications Nos. 3-35064, 3-35245,3-37669, 3-269064 and7-319179, are very useful for a photoreceptor for image forming apparatus such as printers and copiers, which use an LED or LD as a light source. This is because titanyl phthalocyanine is sensitive to light having a relatively long wavelength of from 600 to 800 nm.

A photoreceptor used for electrophotography such as Carlson process and the like processes is required to have the following charge properties as well as the high sensitivity to the specific light mentioned above:

(1) good charging ability such that a high electric potential can be formed and maintained in a dark place;

(2) good charge decaying ability such that the electric potential previously formed on the photoreceptor rapidly decays and the residual potential is low when the photoreceptor is exposed to light; and (3) good charge stability such that the photoreceptor can maintain a good charging ability and a good charge decaying ability even when the photoreceptor is used for a long time.

In particular, in high sensitive photoreceptors such as photoreceptors including TiOPc, the charging ability thereof tends to deteriorate and the residual potential tends to increase when the photoreceptors are repeatedly used. Namely, the photoreceptors including TiOPc have an insufficient charge stability. Therefore, a need exists for a photoreceptor which includes a TiOPc and which has good charge stability.

In addition, another problem which occurs is that undesired black spot images are observed in background area of images when a reverse developing method is used. In particular, after a photoreceptor is preserved under high temperature and high humidity conditions, this black spot problem frequently occurs. Therefore, a need also exists for a photoreceptor which does not cause such a black spot problem.

Because of these reasons, a need exists for a photoreceptor maintaining high sensitivity and good charge properties, and producing good images without causing undesired images such as black spots even when repeatedly used for a long period of time and even after the photoreceptor is preserved under high temperature and high humidity conditions.

SUMMARY OF THE INVENTION

Accordingly, an object of the present invention is to provide a photoreceptor which maintains high photosensitivity and good charge properties, and capable of producing good images without causing undesired images even when repeatedly used for a long period of time and even after the photoreceptor is preserved under high temperature and high humidity conditions.

Another object of the present invention is to provide an image forming method using a photoreceptor, by which good images can be stably produced at a high speed without hardly causing undesired images such as black spots even when images are repeatedly produced for a long period of time and even after the photoreceptor is preserved under high temperature and high humidity conditions.

Yet another object of the present invention is to provide an image forming process cartridge and apparatus in which good images can be stably produced at a high speed without hardly causing undesired images such as black spots even when images are repeatedly produced for a long period of time and even after the apparatus and process cartridge are preserved under high temperature and high humidity conditions.

To achieve these objects, the present invention contemplates the provision of a photoreceptor including an electroconductive substrate, and a photosensitive layer formed on the substrate and including an organic pigment as a charge generation material, wherein the photosensitive layer includes at least an ion selected from the group consisting of a potassium ion ($K^+$), a sodium ion ($Na^+$), a nitrate ion ($NO_3^-$), a formate ion ($HCOO^-$) , a nitrite ion ($NO_2^-$), a chloride ion ($Cl^-$), a bromide ion ($Br^-$), and an ammonium ion ($NH_4^+$). The concentrations of the ions are preferably not greater than 50 ppm, not greater 200 ppm, not greater than 50 ppm, not greater than 100 ppm, not greater than 50 ppm, not greater than 100 ppm, not greater than 50 ppm, and from 10 to 300 ppm, respectively, relative to total amount of the organic pigment.

Preferably, the organic pigment is a titanyl phthalocyanine pigment. The concentrations of a potassium ion ($K^+$) a sodium ion ($Na^+$), a nitrate ion ($NO_3^-$), a formate ion ($HCOO^-$), a nitrite ion ($NO_2^-$), a chlorine ion ($Cl^-$), a bromine ion ($Br^-$), and an ammonium ion ($NH_4^+$) in the titanyl phthalocyanine pigment are preferably not greater than 50 ppm, not greater 200 ppm, not greater than 50 ppm, not greater than 100 ppm, not greater than 50 ppm, not greater than 100 ppm, not greater than 50 ppm, and from 10 to 300 ppm, respectively.

Alternatively, the photosensitive layer includes one or more water-soluble inorganic salts in an amount not greater than 1000 ppm relative to the organic pigment. Preferably the organic pigment is a titanyl phthalocyanine pigment.

The titanyl phthalocyanine pigment preferably has an X-ray diffraction spectrum in which main peaks are observed at Bragg 2θ angle of 9.6°±0.2°, 24.0°±0.2° and 27.2°±0.2°; 7.5°±0.2°, 25.3°±0.2° and 28.6°±0.2°; 9.3°±0.2°, 13.1°±0.2°and 26.2°±0.2°; or 9.0°±0.2°, 14.2°±0.2°, 23.9°±0.2° and 27.1°±0.2, when a specific X-ray of Cu-Kα having a wavelength of 1.541 Å irradiates the titanyl phthalocyanine pigment.

The photosensitive layer preferably includes a charge generation layer including the charge generation material, and a charge transport layer including a polycarbonate resin having a triaryl amine structure in its main chain and/or side chain.

In another aspect of the present invention, an electrophotographic image forming method is provided which uses the photoreceptor of the present invention mentioned above and which includes the steps of charging, light irradiating, developing and image transferring.

In yet another aspect of the present invention, an electrophotographic image forming apparatus is provided which includes an image bearing member, a light irradiating device, a developing device, and an image transferring device, wherein the image bearing member is the photoreceptor of the present invention mentioned above. A process cartridge including at least the photoreceptor of the present invention may be used for the image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like of corresponding parts throughout and wherein.

DESCRIPTION OF THE PREFERRED EMBODIMENTS

Figure 1:
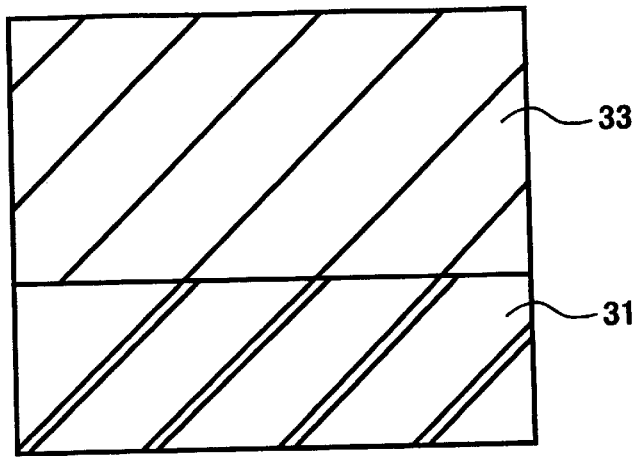
FIGS. 1 to 3 are schematic cross-sectional views of three embodiments of the electrophotographic photoreceptor of the present invention.

The titanyl phthalocyanine pigment (hereinafter sometimes referred to as TiOPc) for use in the present invention has the following formula (1):

(1)

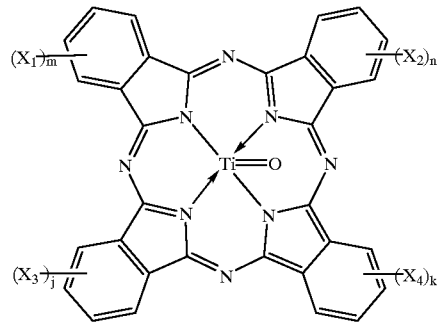

wherein X1, X2, X3 and X4 independently represent a halogen atom, and n, m, j and k are independently 0 or an integer of from 1 to 4.

With respect to the synthetic methods and electrophotographic properties of titanyl phthalocyanine have been disclosed, for example, in Japanese Laid-Open Patent Publications Nos. 57-148745, 59-36254, 59-44054, 59-31965, 61-239248 and 62-67094.

With respect to the crystal form of titanyl phthalocyanine, various crystal forms are known. For example, Japanese Laid-Open Patent Publications Nos. 59-49544, 59-166959, 61-239248, 62-67094, 63-366, 63-116158, 63-196067 and 64-17066 have disclosed titanyl phthalocyanine pigments having different crystal forms.

As mentioned above, when a photoreceptor using a titanyl phthalocyanine pigment having good photosensitivity is repeatedly used for an image forming process such as Carlson process and the like process, the surface potential tends to decrease and the residual potential tends to increase, resulting in end of life of the photoreceptor.

The present inventors have researched why the charge properties of photoreceptors including titanyl phthalocyanine pigment deteriorate while paying attention to the impurities of the photosensitive layer.

As the results of the research, it is discovered that the contents of ions such as $K^+$, $Na^+$, $NO_3^-$, $HCOO^-$, $NO_2^-$, $Cl^-$, $Br^-$, and $NH_4^+$ in the photosensitive layer closely relate to the deterioration of the charge properties of the photoreceptor. Therefore it is discovered that by controlling the content of such ions in the photosensitive layer so as to be not greater than a specified value or within a specified range in the synthesis process and/or refining process of a TiOPc, the resultant photoreceptor can maintain good charge properties even when repeatedly used for a long period of time.

In addition, as mentioned above, when a photoreceptor using a TiOPc having good photosensitivity is repeatedly used after being preserved under a high temperature and high humidity condition, undesired black spot images are often observed in background area of the resultant images.

As a result of our research paying attention to the amounts of impurities in the photosensitive layer, it is discovered that the content of water-soluble inorganic salts closely relates to the amount of black spot images. Therefore it is discovered that by controlling the content of water-soluble inorganic salts in the photosensitive layer so as to be not greater than a specified value in the synthesis process and/or refining process of a TiOPc, the resultant photoreceptor can produce good images without causing undesired black spot images.

In the above-description, a TiOPc is used as a charge generation material, however, other organic pigments such as azo pigments and the like pigments can be used as a charge generation material. The above description is also true for the cases in which the TiOPc is replaced with another organic pigment.

At this point, the water-soluble inorganic salts mean salts and ions which can be detected by subjecting an aqueous dispersion of a pigment to ion chromatography. The salts and ions include, for example, cations such as $Na^+$, $K^+$ and $NH_4^+$, and anions such as $SO_4^-$, $Cl^-$, $Br^-$, $HCOO^-$, $NO_2^-$ and $NO_3^-$, and the salts of the ions.

The reason why such salts cause the black spot problem is not clearly is not clarified. However, the reason is considered to be that the salts are dissociated or dissolved in the photosensitive layer under high humidity conditions.

TiOPcs are typically prepared by the following method:

(1) a TiOPc pigment is synthesized in a solvent;

(2) the synthesized pigment is washed with a solvent;

(3) the pigment is refined by, for example, recrystallization; and (4) the crystal form of the refined pigment is changed, if desired.

In order to prepare a TiOPc having a desired crystal form, for example, the following methods can be used:

(1) using a know synthetic method for preparing the aimed TiOPc;

(2) changing the crystal form of a TiOPc to the desired crystal form in the washing/refining process thereof; and (3) performing an additional crystal form changing process.

With respect to the crystal form changing method, for example, the following methods can be used:

(1) changing the solvent dissolving a titanyl phthalocyanine pigment to another solvent;

(2) setting a pigment under load conditions;

(3) a sulfuric acid pasting method in which a TiOPc is dissolved in sulfuric acid and the solution is added into water to prepare an amorphous TiOPc, and then the amorphous pigment is subjected to one of the above-mentioned crystal changing treatment.

The electrophotographic properties of photoreceptors including a TiOPc largely change depending on how the pigment is synthesized. Several methods are known to synthesize a TiOPc. As one of the methods, a method using a halogenated titanium as a source material. When the TiOPc synthesized by such a method is used for a photoreceptor, charge properties of the photoreceptor deteriorate when the photoreceptor is repeatedly used for a long period of time. Therefore, it is preferably to prepare a TiOPc by not using a halogenated titanium as a source material and by using, for example, an organic titanium compound.

Synthesized TiOPcs are typically subjected to a washing treatment using water several times in its refining process. The TiOPcs, which have been subjected to a washing treatment several times, typically include $K^+$, $NO_3^-$, $NO_2^-$, and $Br^-$ of from 80 to 100 ppm, respectively; $HCOO^-$, and $Cl^-$of from 130 to 200 ppm; $Na^+$ of about 300 ppm; and $NH_4^+$ of about 400 ppm. When one or more of such TiOPcs including the ions in the above-mentioned amounts are used for a photoreceptor, the photoreceptor initially has no problems of the charge properties. However, the present inventors discover that when the photoreceptor is repeatedly used, the ions adversely affect the charge properties of the photoreceptor. Therefore, it is discovered that the ions in the photosensitive layer need to be controlled so as to be not greater than a specific value or within a proper range to maintain good charge properties for a long period of time.

Specifically the ions included in the photosensitive layer are preferably controlled so as to be in the following range:

$K^+$: not greater than 50 ppm $Na^+$: not greater than 200 ppm $NO_3^-$: not greater than 50 ppm $HCOO^-$: not greater than 100 ppm $NO_2^-$: not greater than 50 ppm $Cl^-$: not greater than 100 ppm $Br^-$: not greater than 50 ppm $NH_4^+$: from 100 to 300 ppm In addition, the TiOPcs subjected to a washing treatment using water in its refining process typically include water-soluble inorganic salts in an amount of from 1300 to 2000 ppm. When one or more of such TiOPcs including the ions in the above-mentioned amounts are used for a photoreceptor, the resultant photoreceptor does not initially cause the black spot problem. However, the present inventors discover that after the photoreceptor is preserved under high temperature and high humidity conditions, the photoreceptor causes the black spot problem. Therefore, the water-soluble inorganic salts in the photosensitive layer need to be controlled so as to be not greater than a specific value or within a proper range to avoid the black spot problem.

In order to control the content of the above-mentioned ions and water-soluble inorganic salts in the photosensitive layer, the content of the ions and inorganic salts in the TiOPc used in the photosensitive layer is preferably controlled so as to be not greater than a specific value and within a specific range.

Specifically the ions included in the TiOPc are preferably controlled so as to be in the following range:

$K^+$: not greater than 50 ppm $Na^+$: not greater than 200 ppm $NO_3^-$: not greater than 50 ppm $HCOO^-$: not greater than 100 ppm $NO_2^-$: not greater than 50 ppm $Cl^-$: not greater than 100 ppm $Br^-$: not greater than 50 ppm $NH_4^+$: from 100 to 300 ppm The content of the ions and inorganic salts in a pigment (TiOPc) can be determined by a method in which the pigment dispersed in deionized water is subjected to ion chromatography and the like method.

The concentration of water-soluble salts or ions such as $Na^+$, $K^+$, $NH_4^+$, $Cl^-$, $Br^-$, $HCOO^-$, $NO_2^-$ and $NO_3^-$ in a photosensitive layer can be determined as follows:

(1) the photosensitive layer is sampled, for example, by peeling from the photoreceptor;

(2) the photosensitive layer is pulverized;

(3) the pulverized photosensitive layer is dispersed in deionized water; and (4) the dispersion is subjected to ion chromatography.

The photoreceptor of the present invention will be explained referring to drawings.

FIG. 1 is a schematic view illustrating the cross-section of an embodiment of a single-layered photoreceptor of the present invention. The photoreceptor has an electroconductive substrate 31 and a photosensitive layer 33 formed on the substrate 31 and including a charge generation material and a charge transport material as main components.

Figure 2:
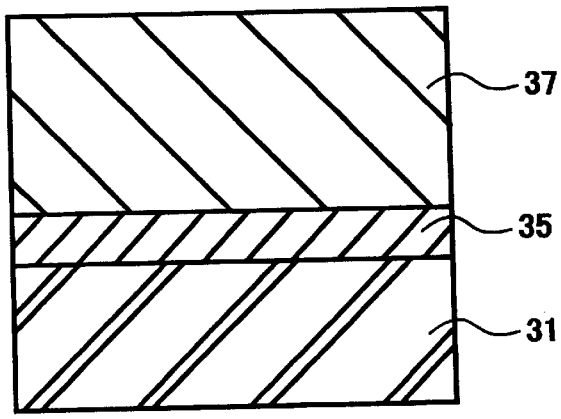
Figure 3:
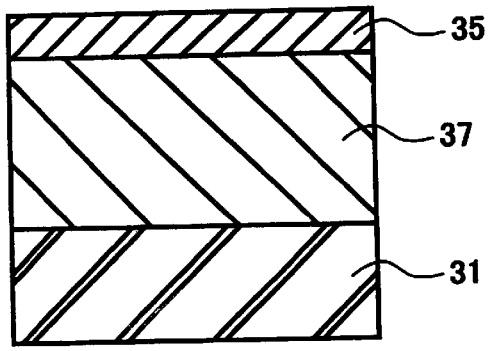

FIGS. 2 and 3 are schematic views illustrating the cross-sections of embodiments of the multi-layered photoreceptor of the present invention. The photoreceptor as shown in FIG. 2 has a charge generation layer 35 which includes a charge generating material as a main component and which is formed on an electroconductive substrate 31, and a charge transport layer 37 which includes a charge transport material as a main component and which is formed on the charge generation layer 35.

In the multi-layered photoreceptor as shown in FIG. 3, a charge generation layer 35 is formed on a charge transport layer 37 which is formed on an electroconductive substrate 31.

Suitable materials for use as the electroconductive substrate 31 include materials having a volume resistance not greater than $10^{10}$ Ωcm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a tube can also be used as the substrate 31 which is prepared by tubing a plate of a metal such as aluminum, aluminum alloys, nickel, stainless steel and the like or tubing by a method such as impact ironing or direct ironing, and then treating the surface of the tube by cutting, super finishing, polishing and the like. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including a binder resin and an electroconductive powder is coated on the supporters mentioned above, can be used as the substrate 31. Specific examples of the electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The electroconductive layer can be formed by coating a coating liquid in which an electroconductive powder and a binder resin are dispersed or dissolved in a proper solvent such as tetrahydrofuran, dichloromethane, methyl ethyl ketone, toluene and the like, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, are also used as the substrate 31.

Next, the photosensitive layer of the photoreceptor of the present invention will be explained.

In the present invention, the photosensitive layer may be a single-layered photosensitive layer or a multi-layered photosensitive layer.

At first, multi-layered photosensitive layer including the charge generation layer 35 and the charge transport layer 37 will be explained.

The charge generation layer 35 (hereinafter referred to as CGL 35) includes a TiOPc, which serves as a charge generation material, as a main component. In the charge generation layer 35, the content of the ions, $K^+$, $Na^+$, $NO_3^-$, $HCOO^-$, $NO_2^-$, $Cl^-$, $Br^-$, and $NH_4^+$, relative to the TiOPc included in the CGL 35 are preferably controlled so as to fall in the following range:

$K^+$: not greater than 50 ppm $Na^+$: not greater than 200 ppm $NO_3^-$: not greater than 50 ppm $HCOO^-$: not greater than 100 ppm $NO_2^-$: not greater than 50 ppm $Cl^-$: not greater than 100 ppm $Br^-$: not greater than 50 ppm $NH_4^+$: from 10 to 300 ppm When one or more organic pigments are included in the CGL 35, the weight ratio of water-soluble inorganic salts to the organic pigments included in the CGL 35 is preferably not greater than 1000 ppm.

By controlling the content of the ions and/or the salts in the above-mentioned range, the resultant photoreceptor has good charge properties and can produce good images without causing undesired black spot images even when repeatedly used for a long period of time.

When the weight ratio of water-soluble inorganic salts to the organic pigments included in the CGL 35 is less than 100 ppm, the surface potential of a lighted area (i.e., the residual potential) of the photoreceptor, which is exposed to image-wise light, tends to slightly increase. Therefore, the content of water-soluble inorganic salts is preferably not less than 100 ppm.

As the TiOPc for use in the CGL 35, a TiOPc crystal having at least main diffraction peaks at Bragg (2θ) angles of 9.6°±0.2°, 24.0°±0.2° and 27.2°±0.2° when a specific X-ray of Cu-Kα having a wavelength of 1.542 Å irradiates the TiOPc; a TiOPc crystal having at least main diffraction peaks at Bragg (2θ) angles of 7.5°±0.2°, 25.3°±0.2° and 28.6°±0.2°; a TiOPc crystal having at least main diffraction peaks at Bragg (2θ) angles of 9.3°±0.2°, 13.1°±0.2° and 26.2°±0.2°; and/or a TiOPc crystal having at least main diffraction peaks at Bragg (2θ) angles of 9.0°±0.2°, 14.2°±0.2°, 23.9°±0.2° and 27.1°±0.2°, are preferably used.

These TiOPcs having such a crystal form have a relatively high photosensitivity compared to the TiOPc having another crystal form. However, since the TiOPcs have a high photosensitivity, the TiOPcs are easily influenced by impurities. Therefore, problems such that the residual potential of the resultant photoreceptor increases; the surface potential thereof decreases; and the photosensitivity deteriorates tend to occur. Namely, it is hard to use the TiOPcs in a photoreceptor. In order to effectively use such TiOPcs and take the advantages of the TiOPcs, the technique of the present invention essential.

The CGL 35 can be prepared, for example, by the following method:

(1) a TiOPc is mixed with a proper solvent optionally together with a binder resin;

(2) the mixture is dispersed using a ball mill, an attritor, a sand mill or a supersonic dispersing machine to prepare a coating liquid; and (3) the coating liquid is coated on an electroconductive substrate and dried to form a CGL.

As mentioned above, the charge generation material is not limited to TiOPc.

Suitable binder resins, which are optionally mixed in the charge generation layer coating liquid, include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

Among these resins, polyvinyl acetal resins such as polyvinyl butyral resins are preferably used. In particular, polyvinyl acetal (butyral) resins having an acetylation (butyralation) degree not less than 4% by mole are more preferably used.

The content of the binder resin in CGL 35 is preferably from 0 to 500 parts by weight, and preferably from 10 to 300 parts by weight, of 100 parts by weight of the charge generation material included in the CGL 35.

The CGL 35 may include one or more charge generation materials other than the TiOPc of the present invention. Specific examples of such charge generation materials include monoazo pigments, disazo pigments, trisazo pigments, perylene pigments, perynone pigments, quinacridone pigments, quinone type condensed polycyclic compounds, squaric acid type dyes, phthalocyanine pigments other than the TiOPc of the present invention, naphthalocyanine pigments, azulenium salt type dyes, and the like pigments and dyes.

Suitable solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used.

The CGL coating liquid can be coated by a coating method such as dip coating, spray coating, bead coating, nozzle coating, spinner coating and ring coating. The thickness of the charge generation layer 35 is preferably from 0.01 to 5 μm, and more preferably from 0.1 to 2 μm.

The charge transport layer 37 (hereinafter referred to as a CTL 37) can be formed, for example, by the following method:

(1) a charge transport material is dispersed or dissolved in a proper solvent optionally together with a binder resin to prepare a coating liquid; and (2) the coating liquid is coated on the CGL and dried to form a CTL.

The CTL 37 may include additives such as plasticizers, leveling agents, antioxidants and the like.

Charge transport materials are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These charge transport materials can be used alone or in combination.

Specific examples of the binder resin for use in the CTL 37 include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

These resin can be used alone or in combination.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The CTL 37 can be formed by one of the coating methods mentioned above for use in formation of the CGL 35.

The content of the charge transport material in the CTL 37 is from 20 to 300 parts by weight, and preferably from 40 to 150 parts by weight, per 100 parts by weight of the binder resin included in the CTL 37.

The thickness of the CTL 37 is preferably from 5 to 100 μm.

In the CTL 37, charge transport polymer materials which have a function of the binder resin and a function of the charge transport material can be preferably used. A CTL 37 constituted of a charge transport polymer material has good abrasion resistance. Suitable charge transport polymer materials include known charge transport polymer materials. Among these materials, polycarbonate having a triarylamine structure in its main chain and/or side chain is preferably used. In particular, charge transport polymer materials having the following formulae of from (2) to (11) are preferably used:

(2)

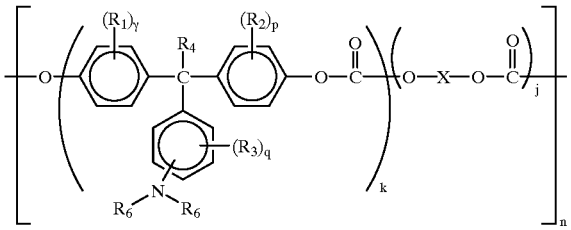

wherein R1, R2 and R3 independently represent an alkyl group which is substituted or is not substituted, or a halogen atom; R4 represents a hydrogen atom, or an alkyl group which is substituted or is not substituted; R5, and R6 independently represent an aryl group which is substituted or is not substituted; r, p and q independently represent 0 or an integer of from 1 to 4; k is a number of from 0.1 to 1.0 and j is a number of from 0 to 0.9; and n is an integer of from 5 to 5000; and X represents a divalent aliphatic group, a divalent alicyclic group or a divalent group having the following formula:

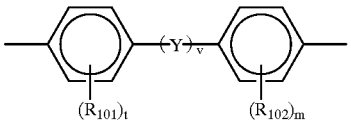

wherein R101 and R102 independently represent an alkyl group which is substituted or is not substituted, an aryl group which is substituted or is not substituted, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group) , or a group having the following formula:

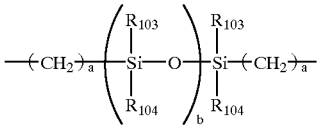

wherein a is an integer of from 1 to 20; b is an integer of from 1 to 2000; and R103 and R104 independently represent a substituted or unsubstituted alkyl group, or a substituted or unsubstituted aryl group, wherein R101, R102, R103 and R104 may be the same or different from each other.

(3)

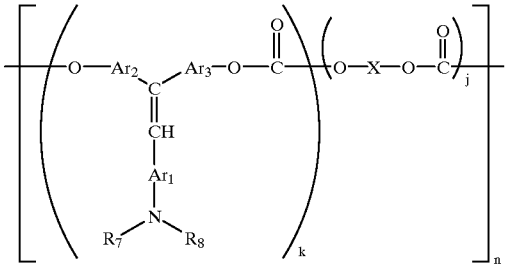

wherein R7 and R8 independently represent a substituted or unsubstituted aryl group; Ar1, Ar2 and Ar3 independently represent an arylene group; and X, k, j and n are defined above in formula (2).

(4)

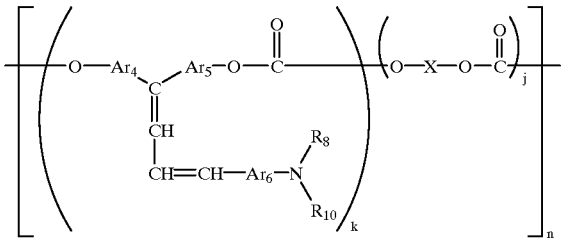

wherein R9 and R10 independently represent a substituted or unsubstituted aryl group; Ar4, Ar5 and Ar6 independently represent an arylene group; and X, k, j and n are defined above in formula (2).

(5)

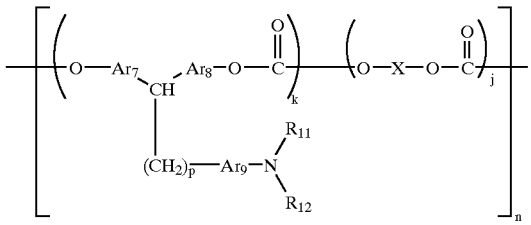

wherein R11 and R12 independently represent a substituted or unsubstituted aryl group; Ar7, Ar8 and Ar9 independently represent an arylene group; p is an integer of from 1 to 5; and X, k, j and n are defined above in formula (2).

(6)

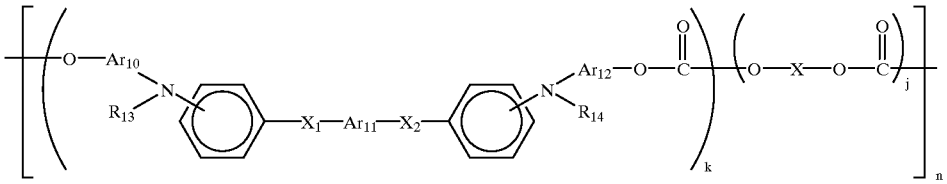

wherein R13 and R14 independently represent a substituted or unsubstituted aryl group; Ar10, Ar11 and Ar12 independently represent an arylene group; X1 and X2 independently represent a substituted or unsubstituted ethylene group, or a substituted or unsubstituted vinylene group; and X, k, j and n are defined above in formula (2).

(7)

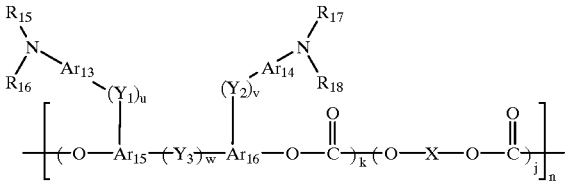

wherein R15, R16, R17 and R18 independently represent a substituted or unsubstituted aryl group; Ar13, Ar14, Ar15 and Ar16 independently represent an arylene group; Y1, Y2 and Y3 independently represent a substituted or unsubstituted alkylene group, a substituted or unsubstituted cycloalkylene group, a substituted or unsubstituted alkylene ether group, an oxygen atom, a sulfur atom, or a vinylene group; u, v and w independently represent 0 or 1; and X, k, j and n are defined above in formula (2).

(8)

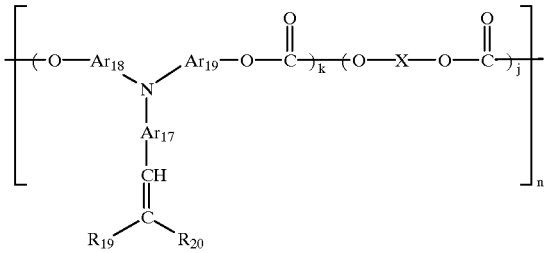

wherein R19 and R20 independently represent a hydrogen atom, or substituted or unsubstituted aryl group, and R19 and R20 may form a ring; Ar 17, Ar18 and Ar19 independently represent an arylene group; and X, k, j and n are defined above in formula (2).

(9)

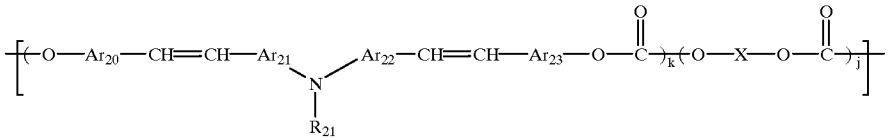

wherein R21 represents a substituted or unsubstituted aryl group; Ar20, Ar21, Ar22 and Ar23 independently represent an arylene group; and X, k, j and n are defined above in formula (2).

(10)

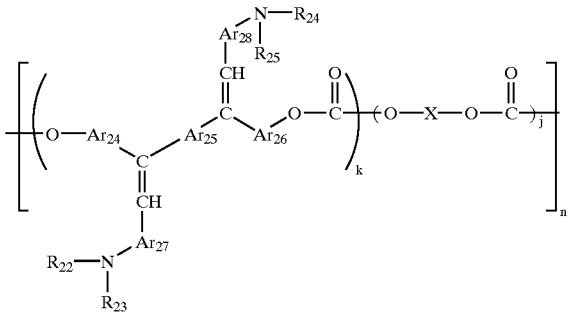

wherein R22, R23, R24 and R25 independently represent a substituted or unsubstituted aryl group; Ar24, Ar25, Ar26, Ar27 and Ar28 independently represent an arylene group; and X, k, j and n are defined above in formula (2).

(11)

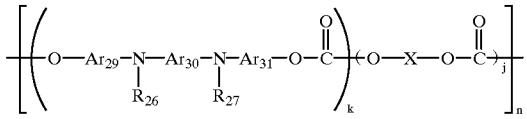

wherein R26 and R27 independently represent a substituted or unsubstituted aryl group; Ar29, Ar30 and Ar31 independently represent an arylene group; and X, k, j and n are defined above in formula (2).

Specific examples of the charge transport polymer materials having formula (2) to (11) are shown in Tables 1 to 10, respectively.

TABLE 1
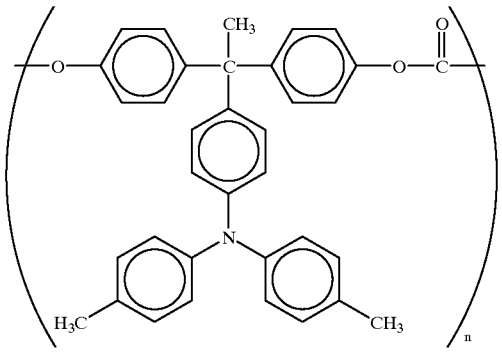
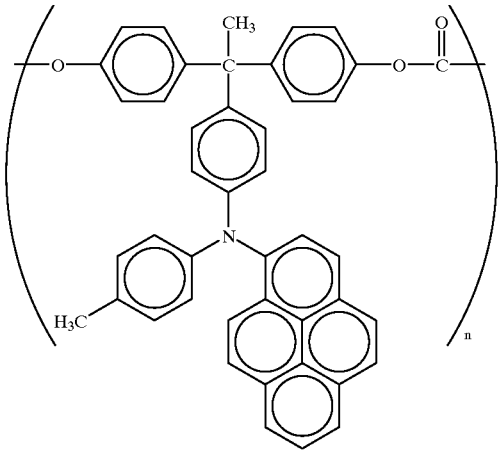
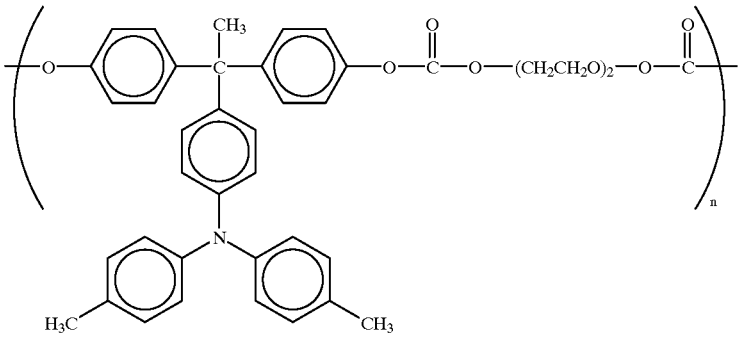
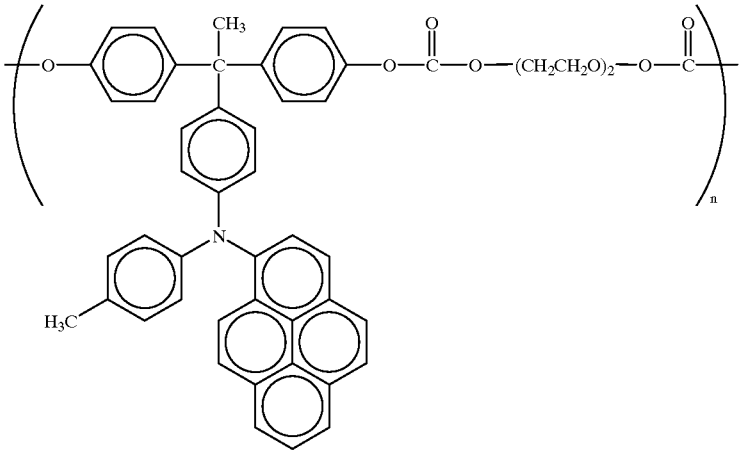

TABLE 1-continued
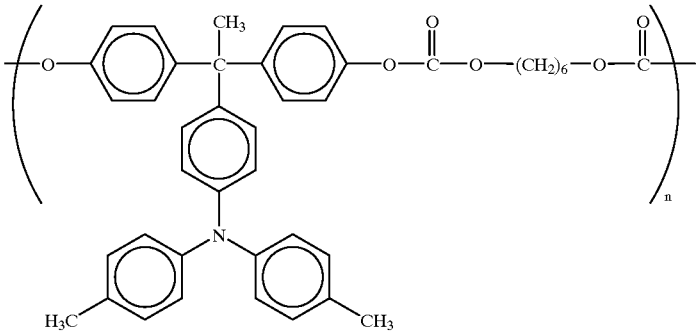
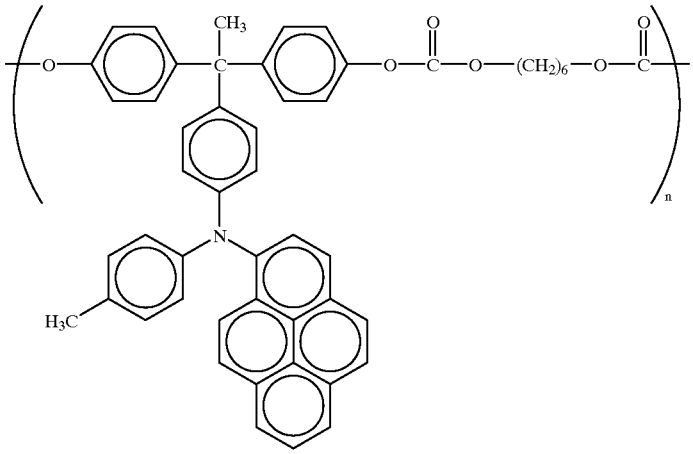
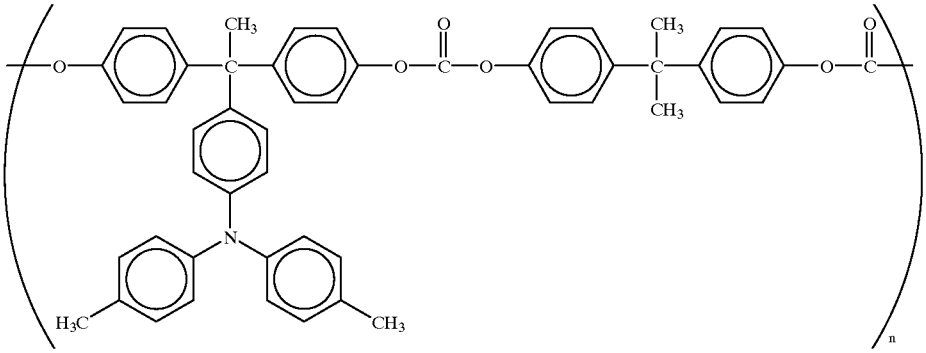
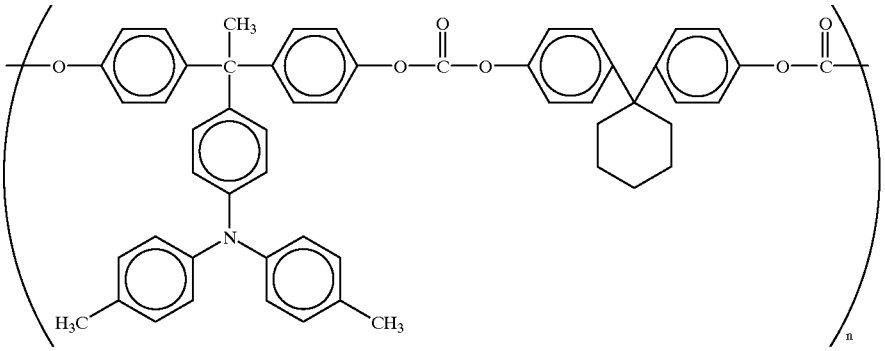

TABLE 1-continued
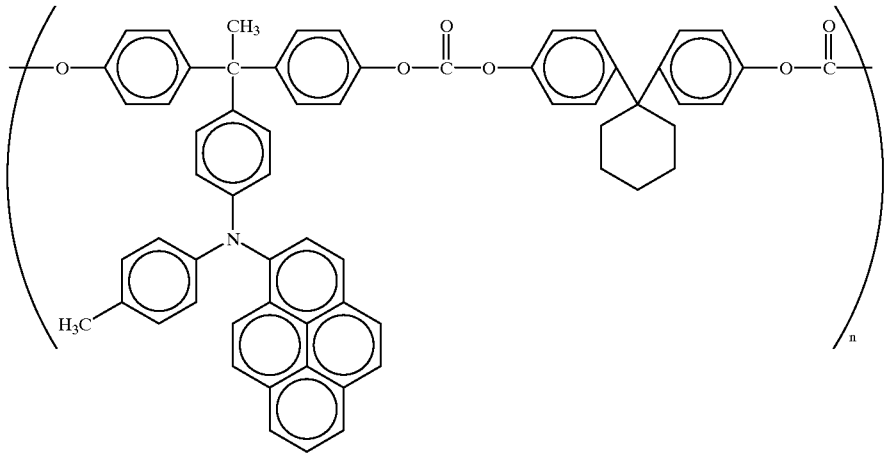
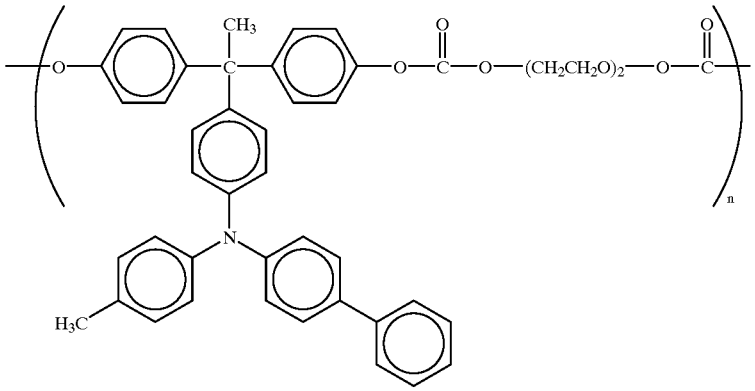
TABLE 2
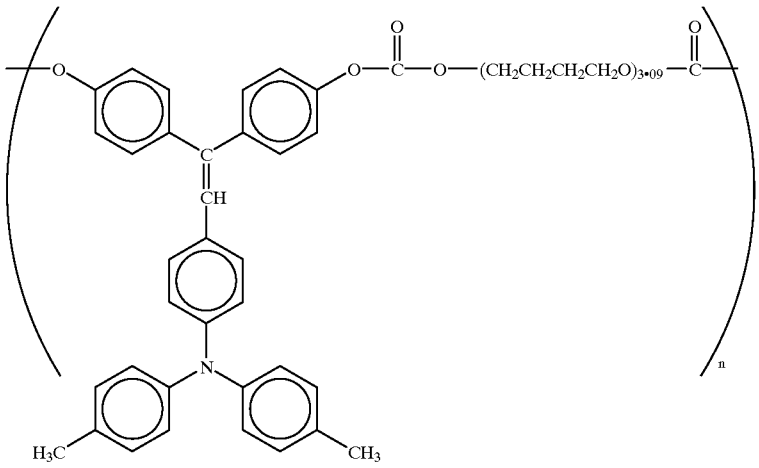

TABLE 2-continued
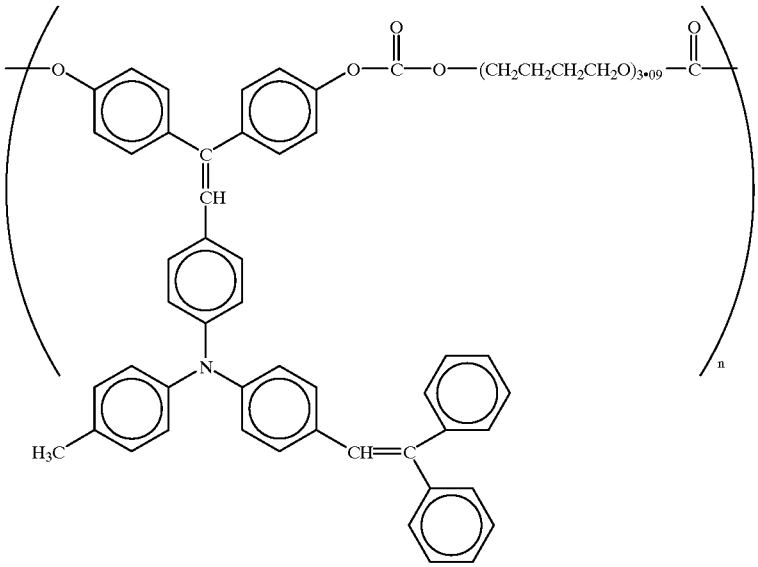
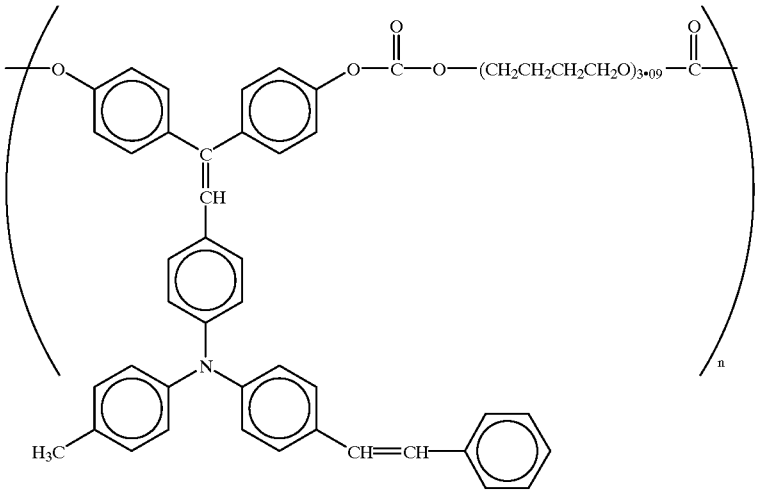
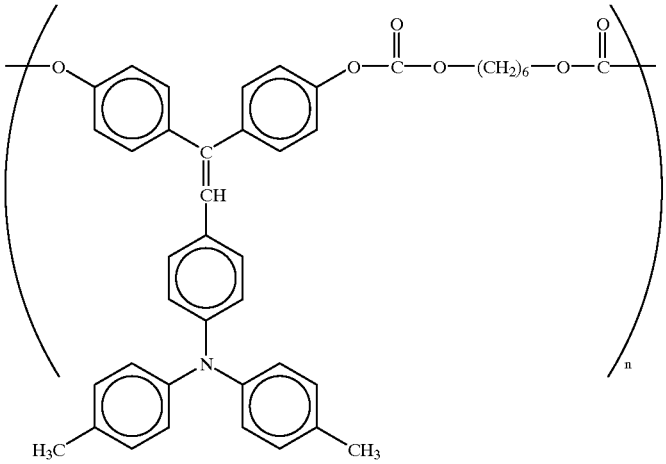

TABLE 2-continued
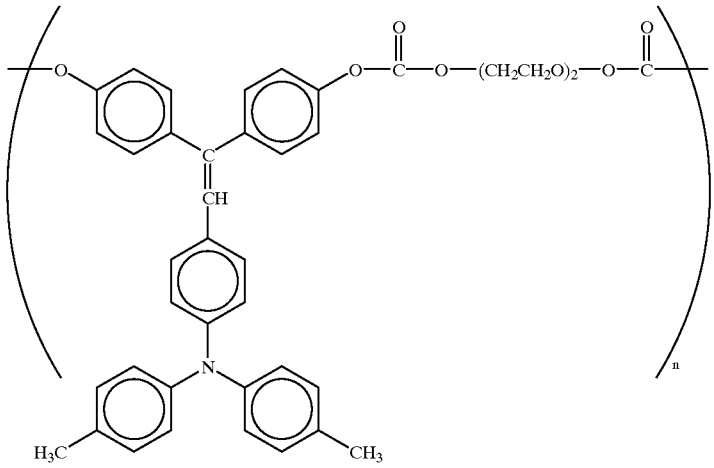
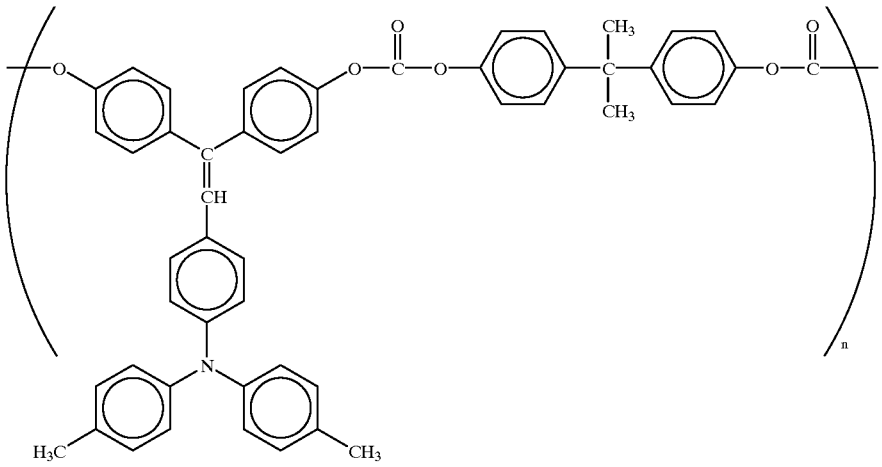
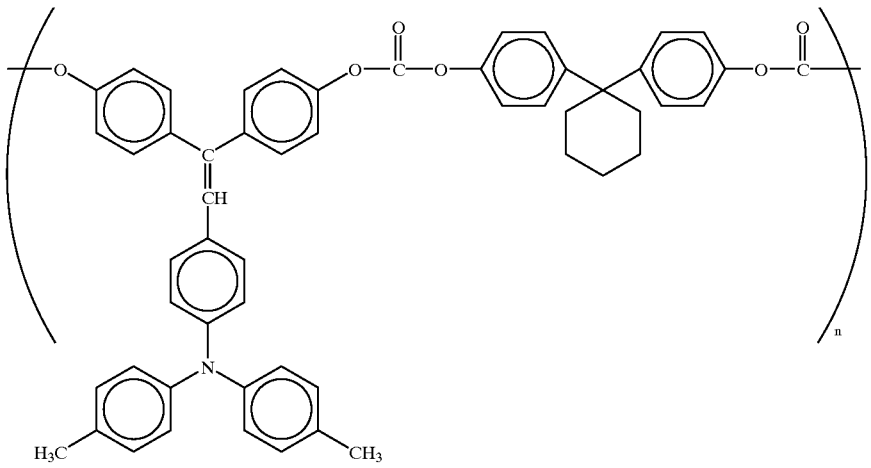

TABLE 2-continued
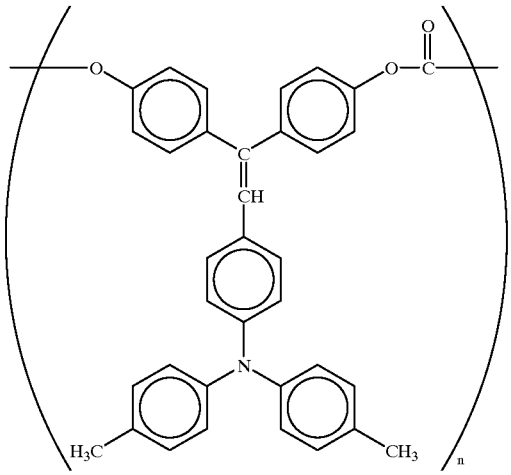
TABLE 3
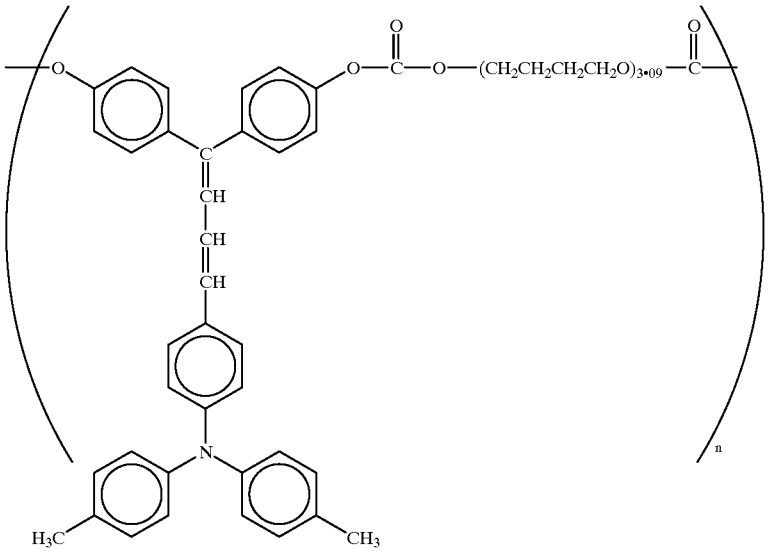

TABLE 3-continued
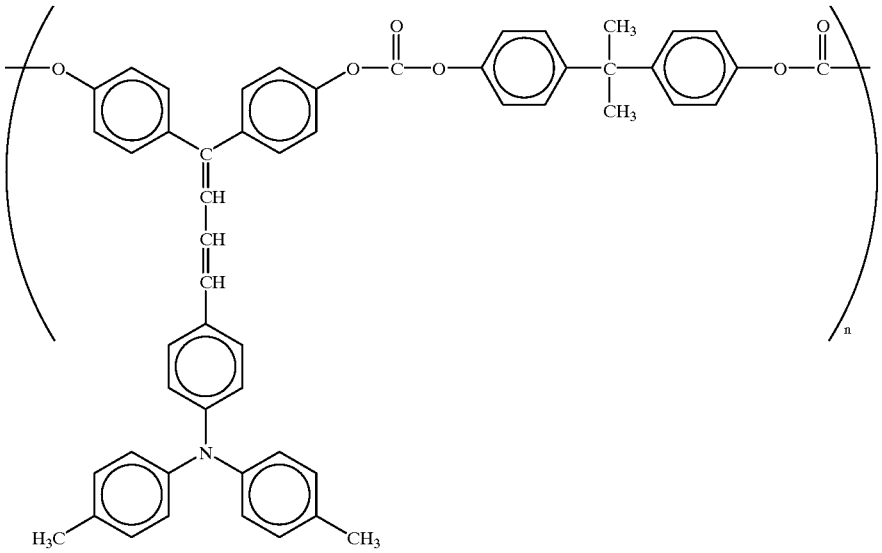
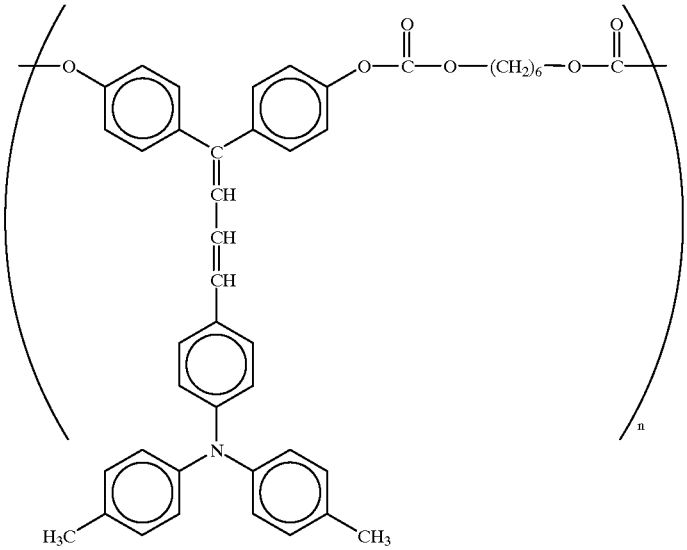

TABLE 3-continued
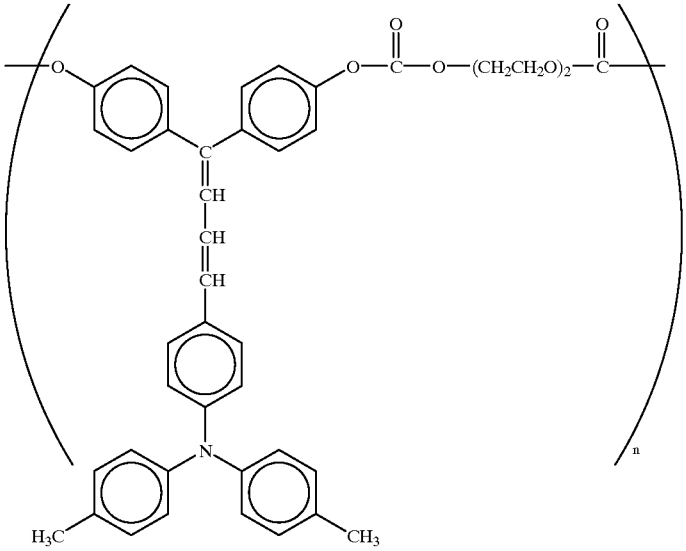
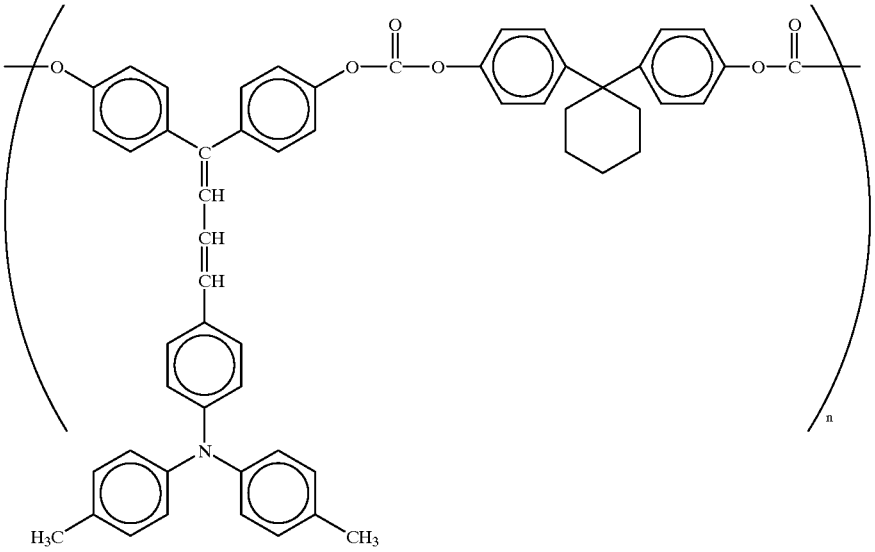

TABLE 4
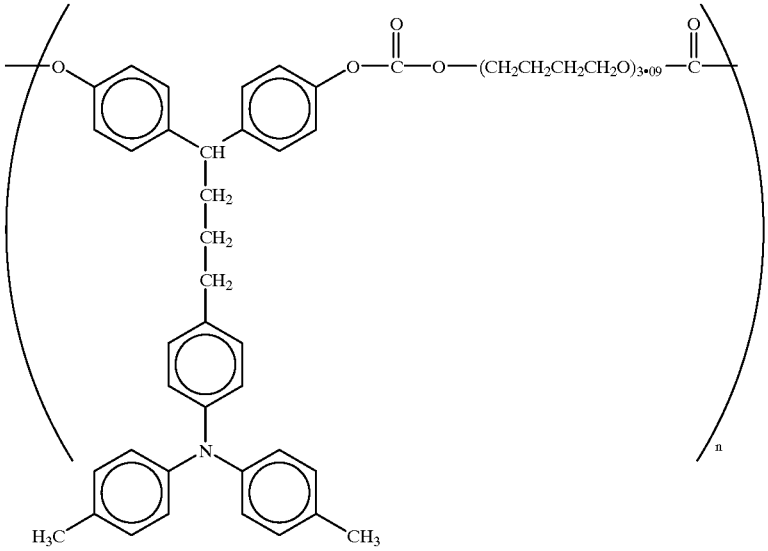
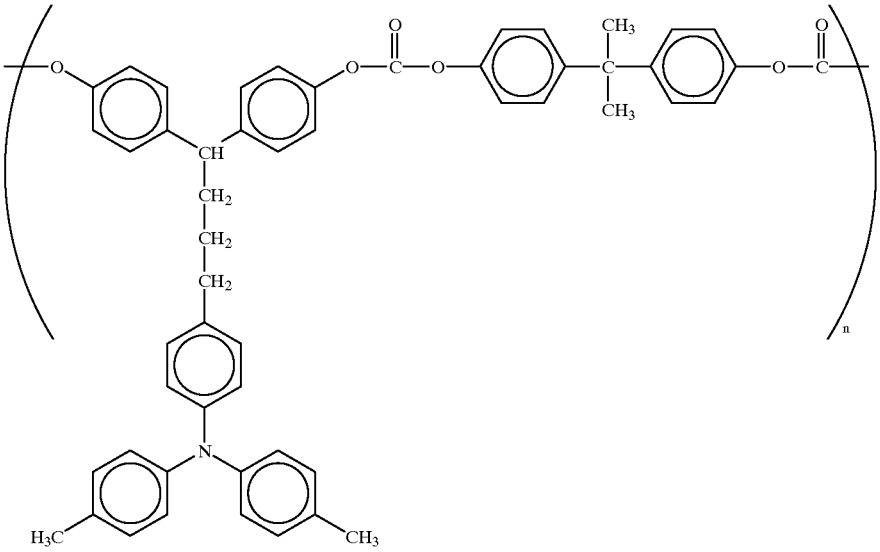

TABLE 4-continued
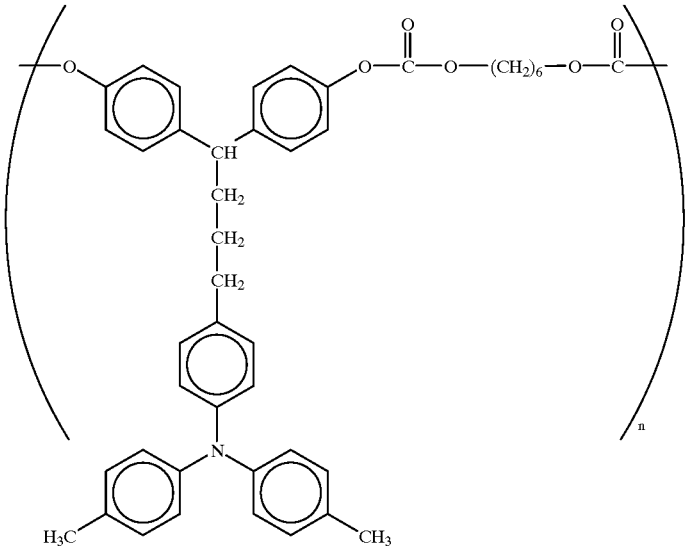
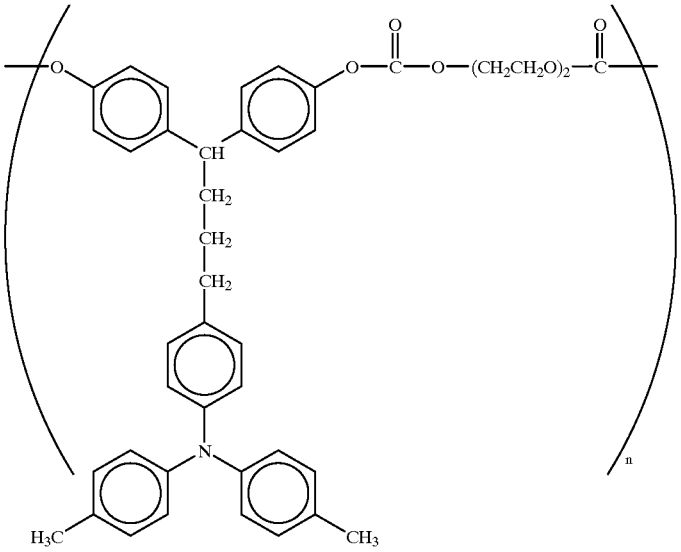

TABLE 4-continued
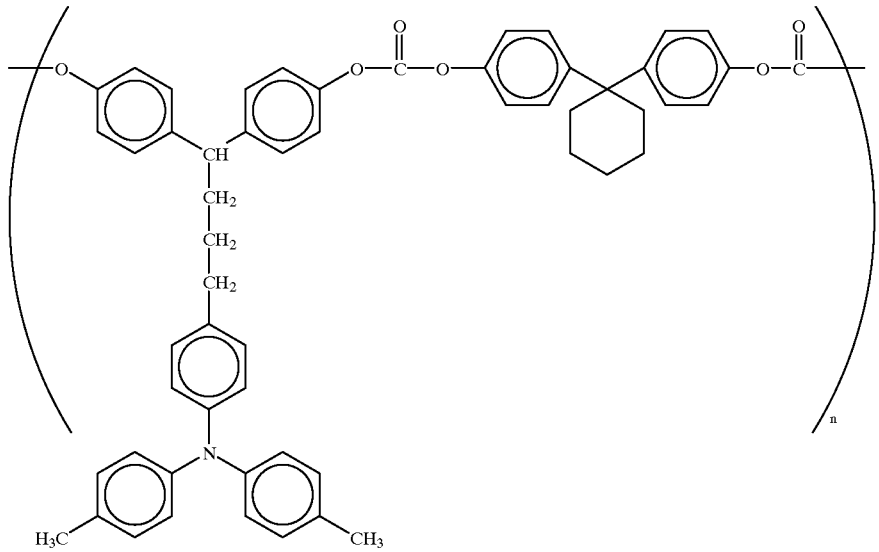
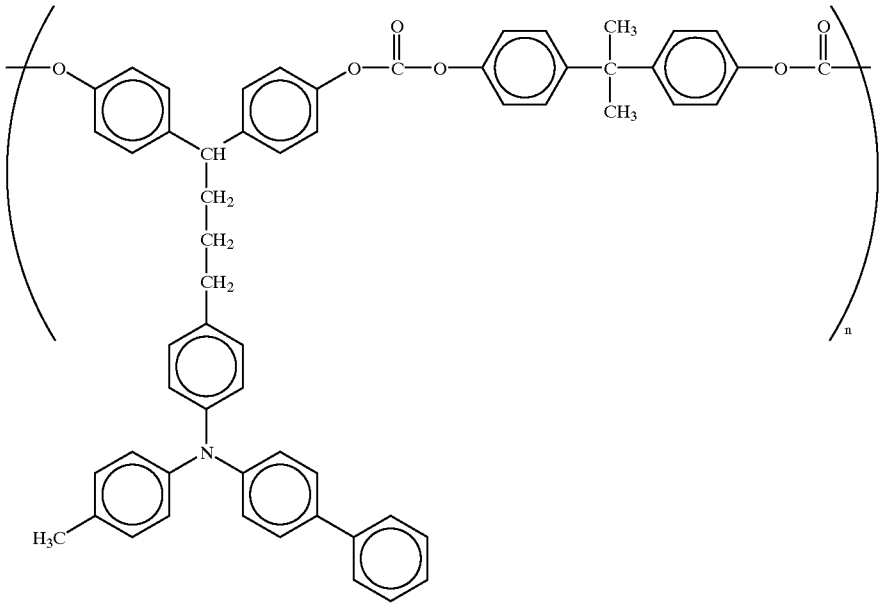
TABLE 5
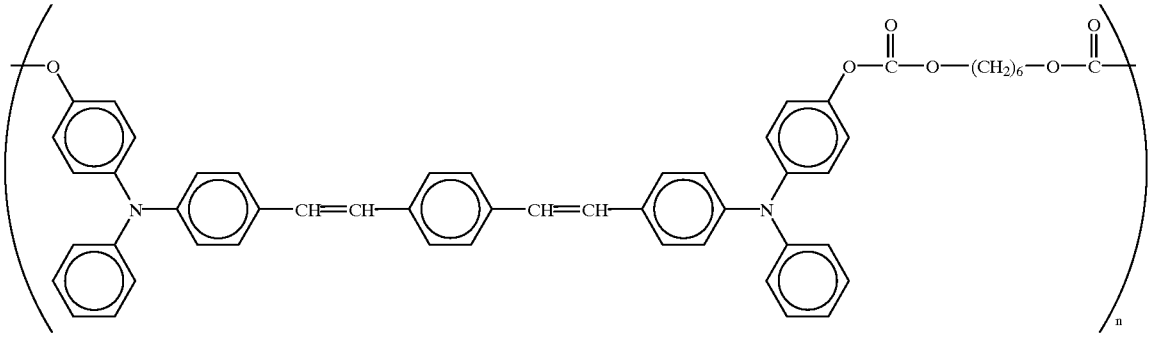

TABLE 5-continued
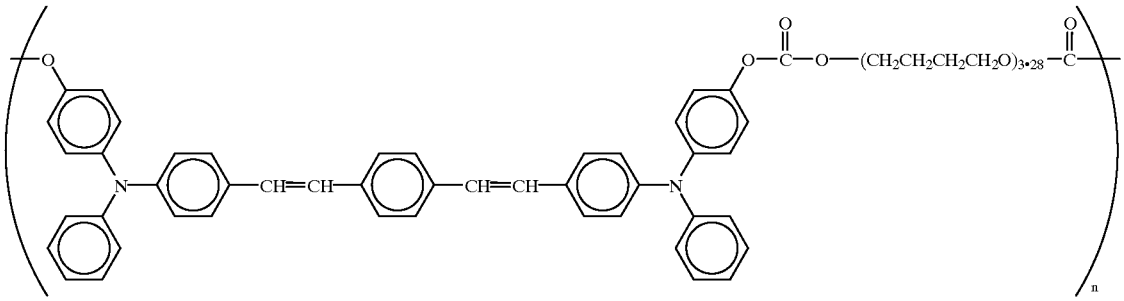
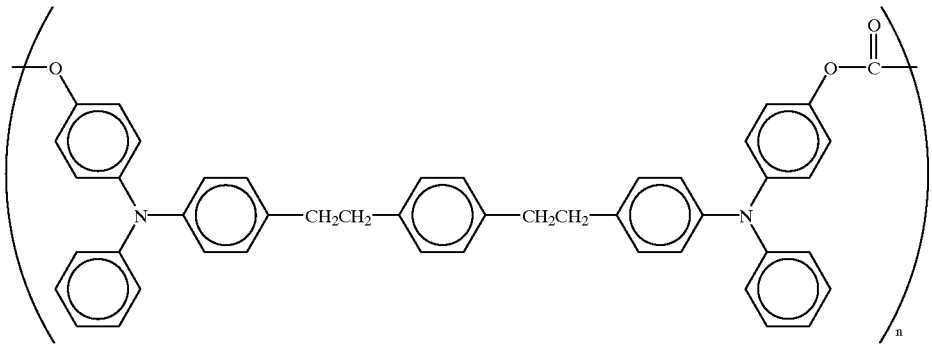
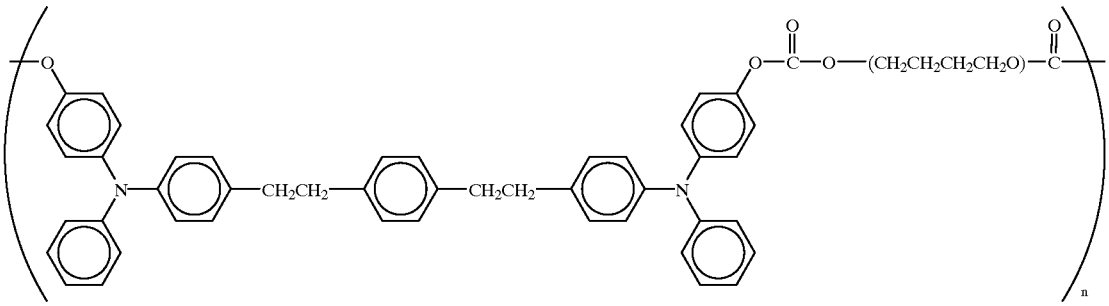
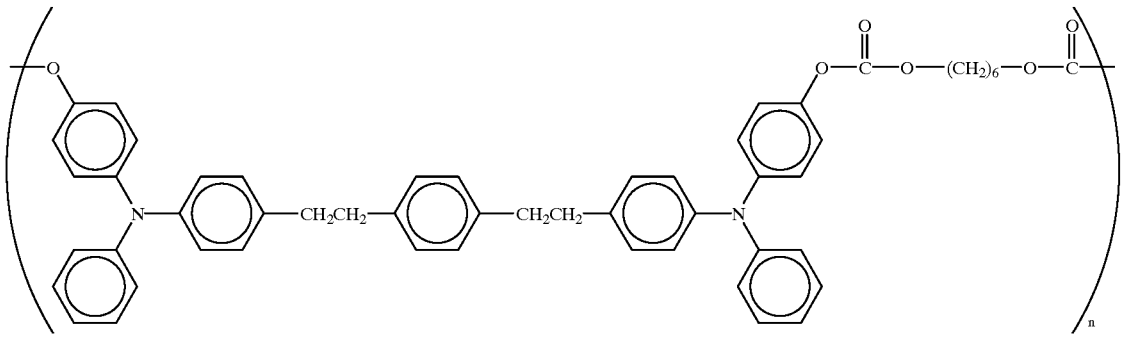

TABLE 5-continued
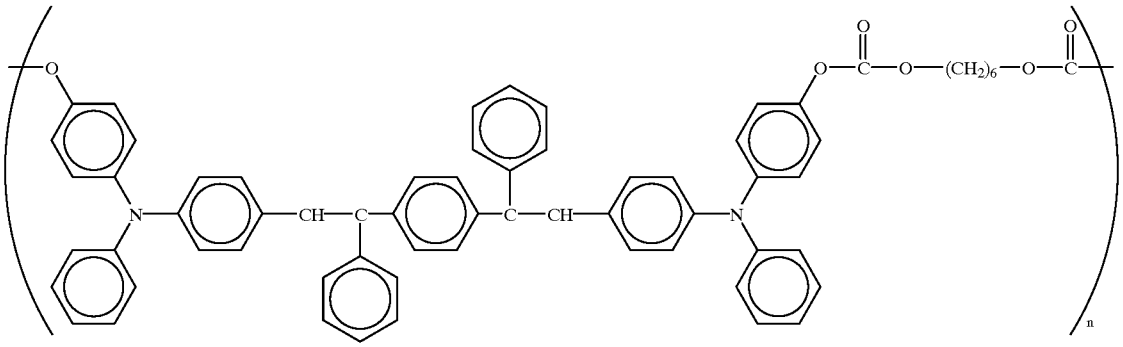
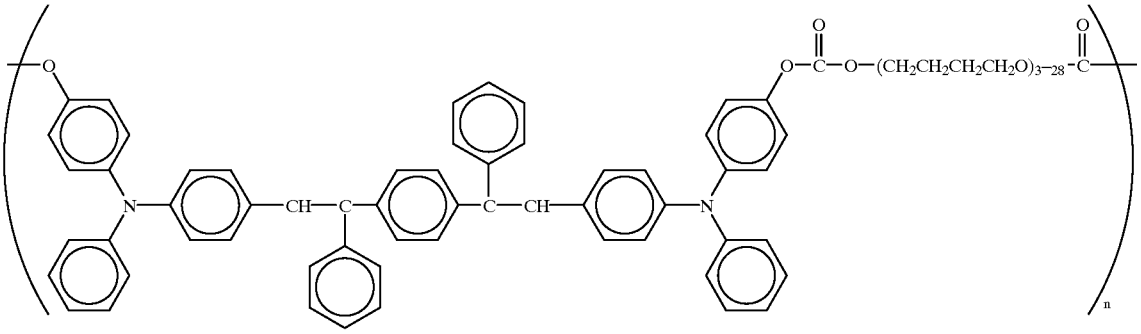
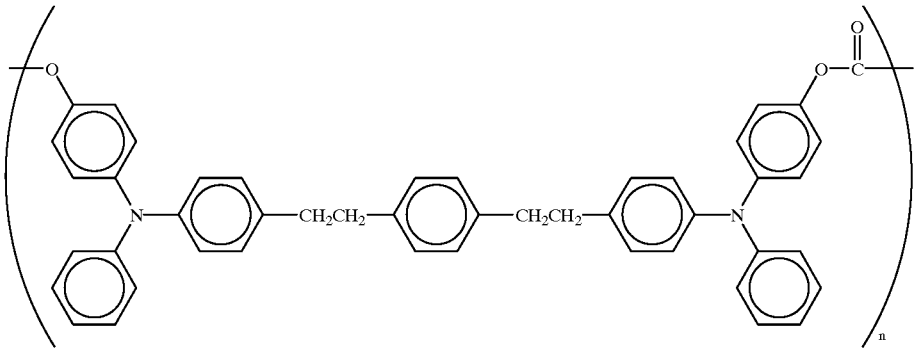
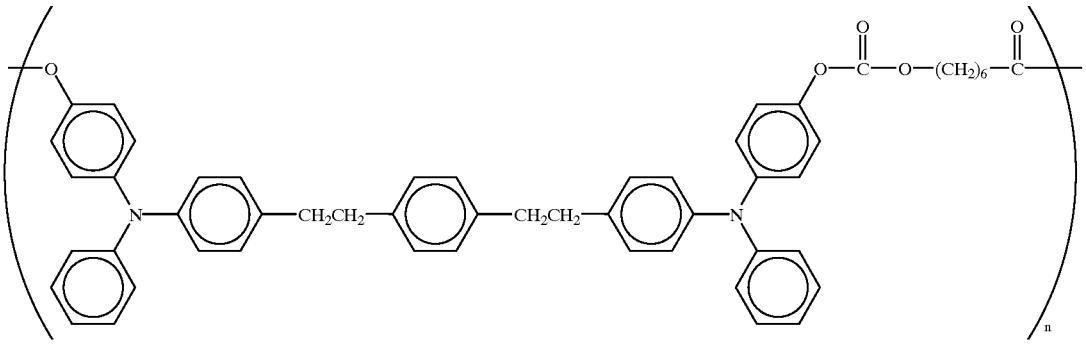

TABLE 5-continued
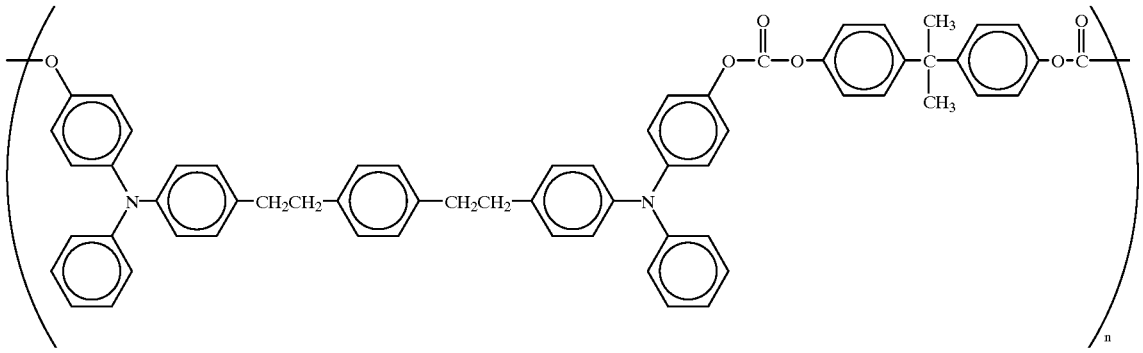
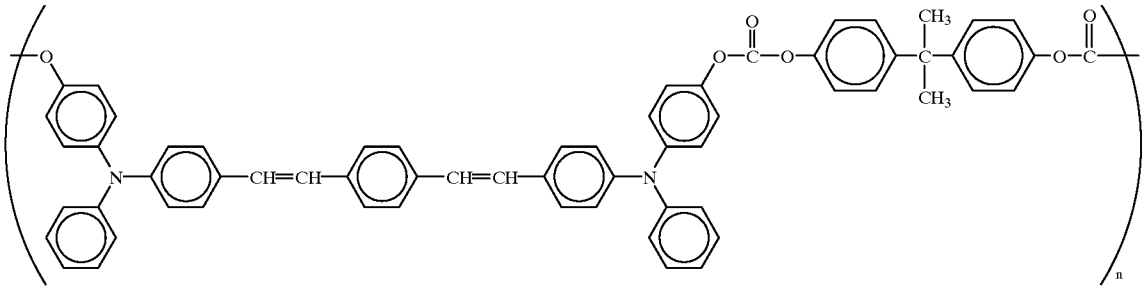
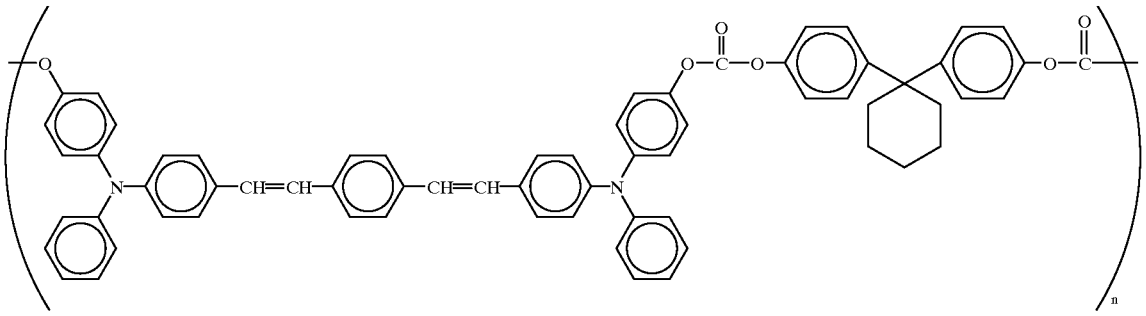
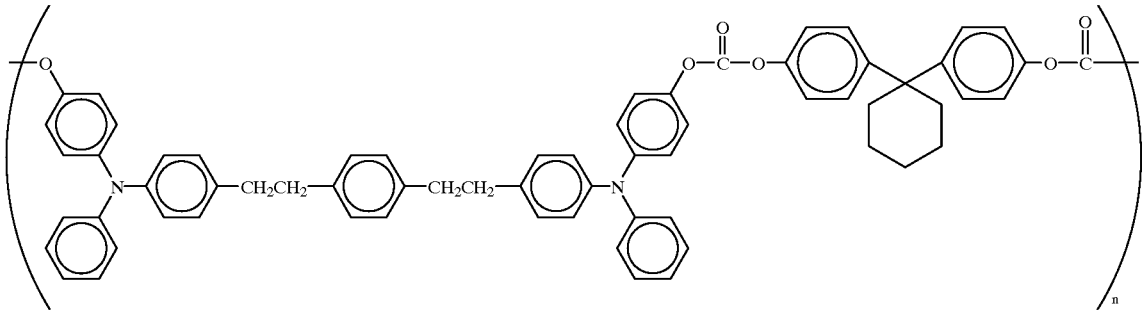

TABLE 6
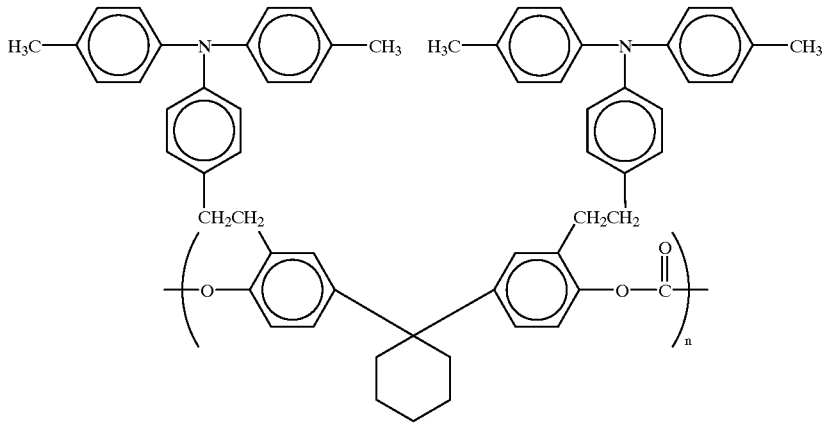
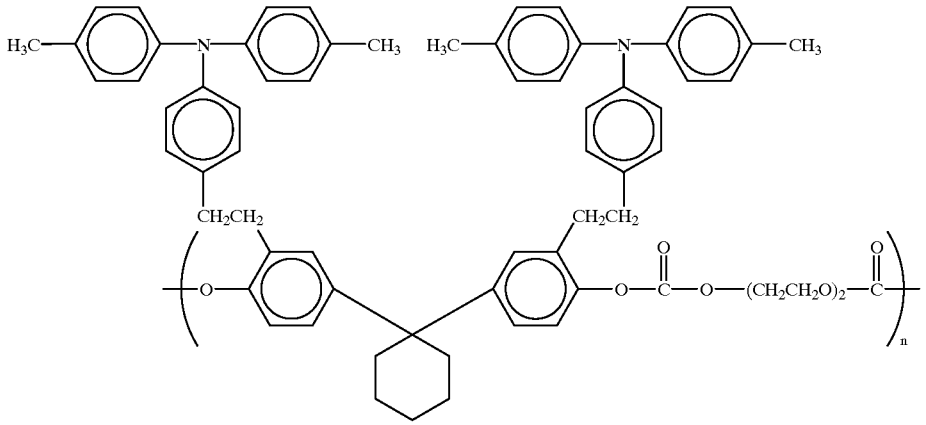
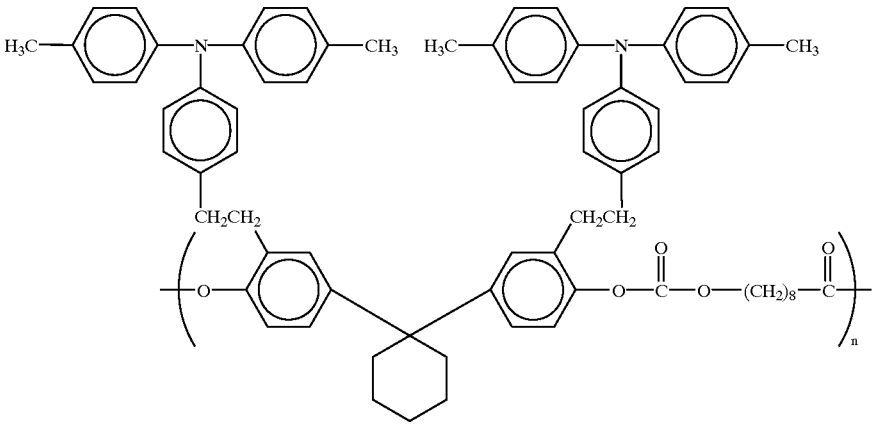

TABLE 6-continued
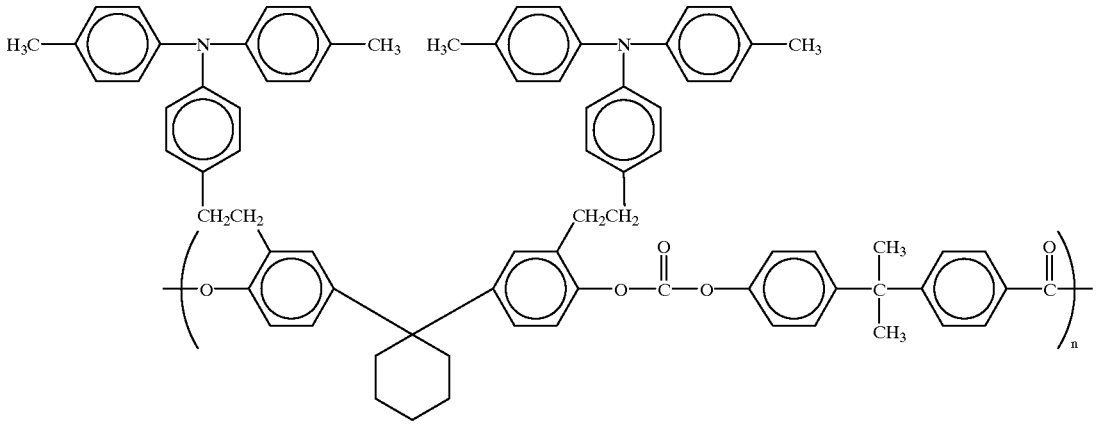
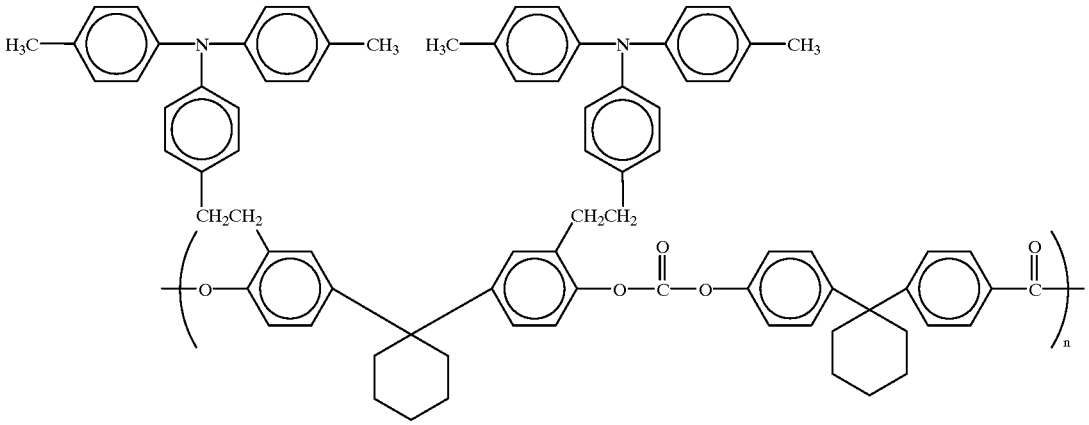
TABLE 7
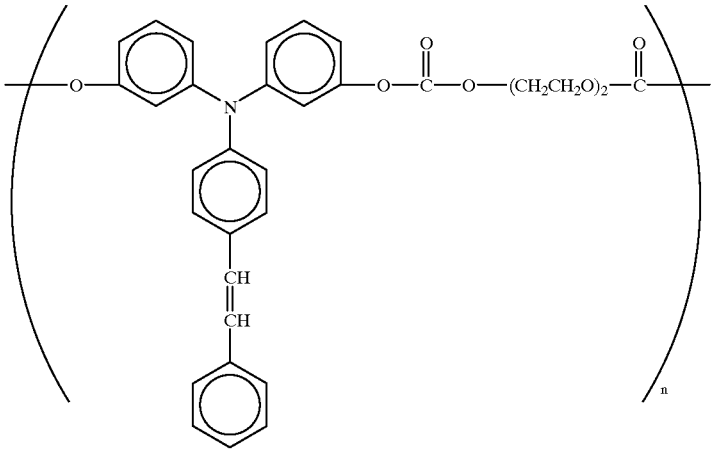

TABLE 7-continued
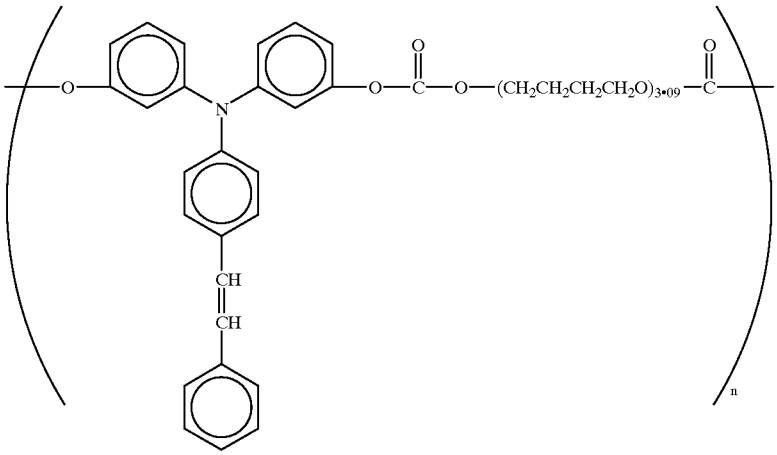
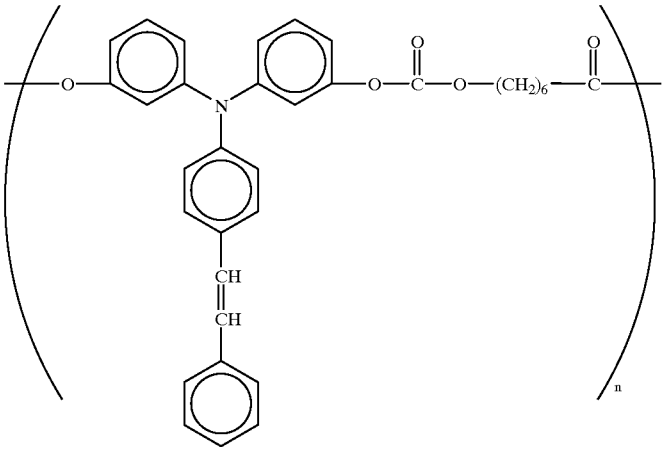
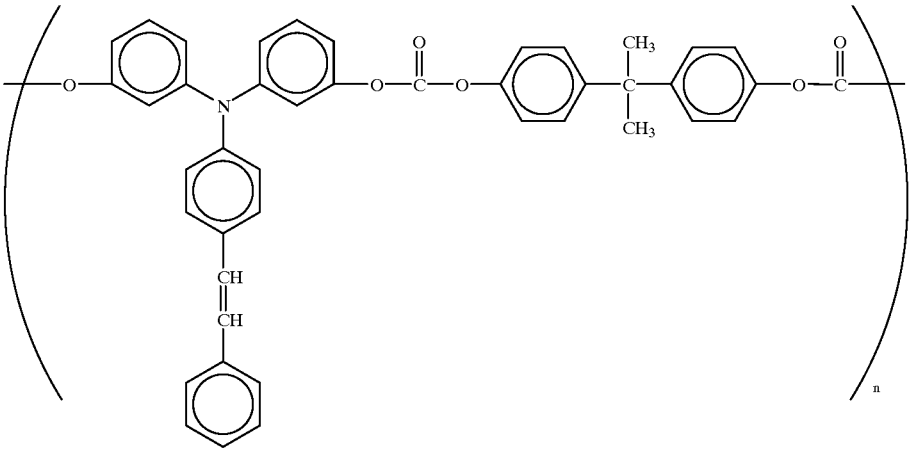

TABLE 7-continued
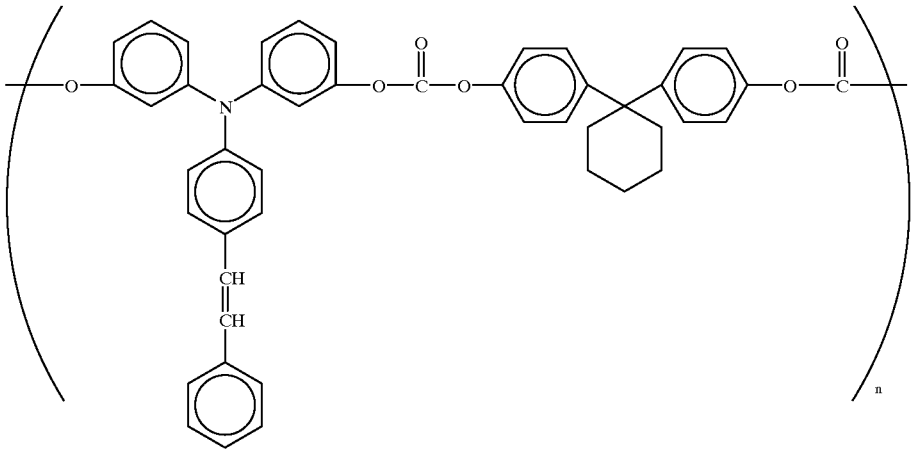
TABLE 8
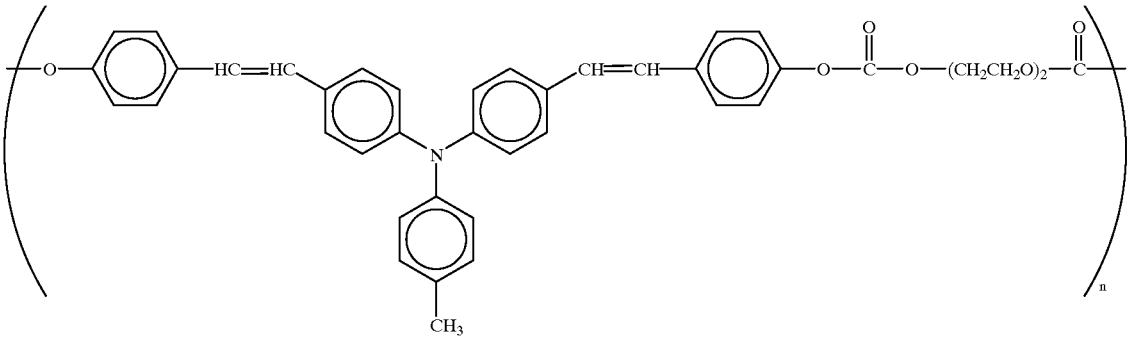
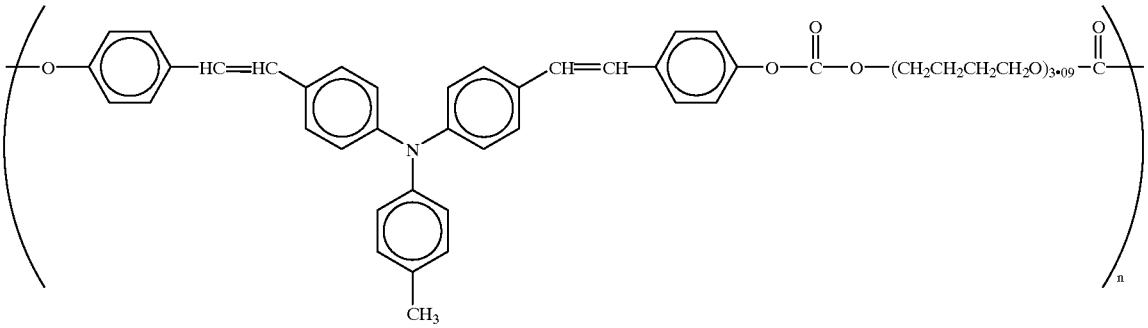
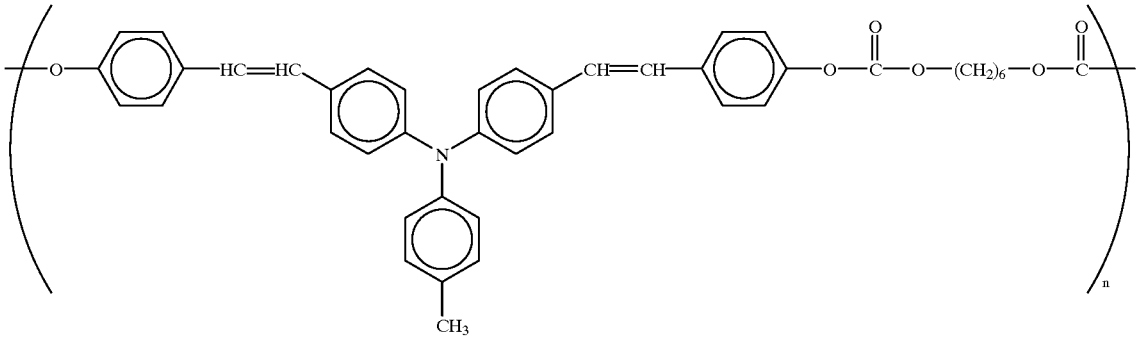

TABLE 8-continued
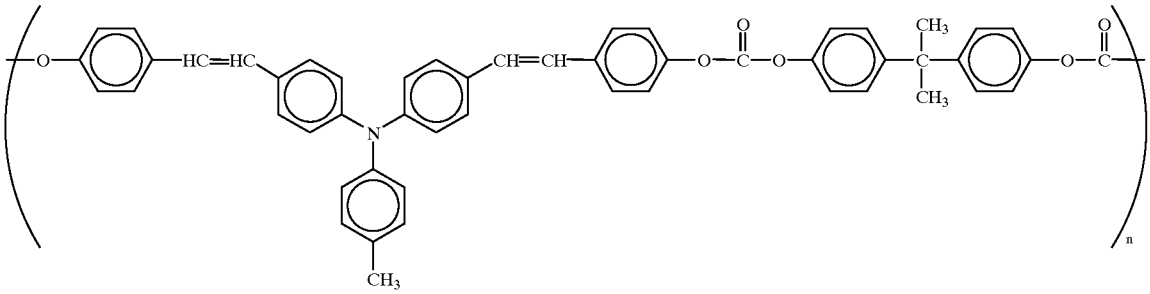
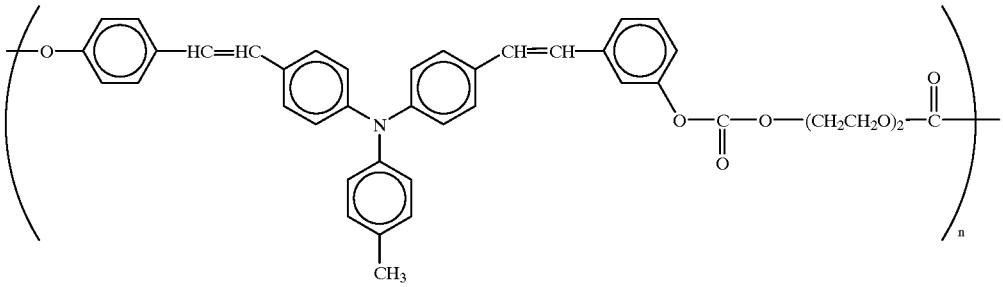
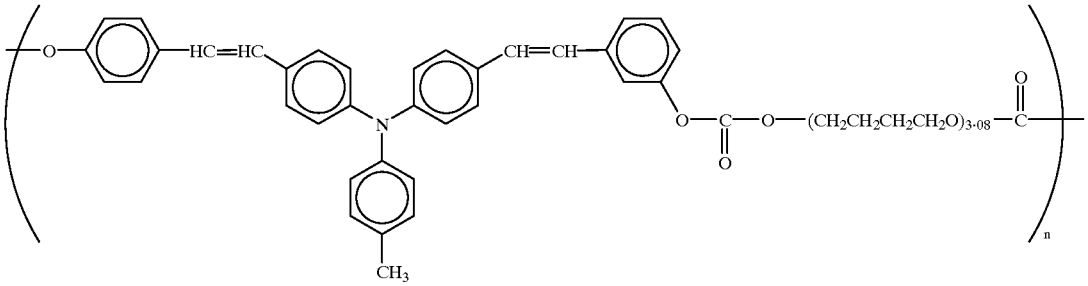
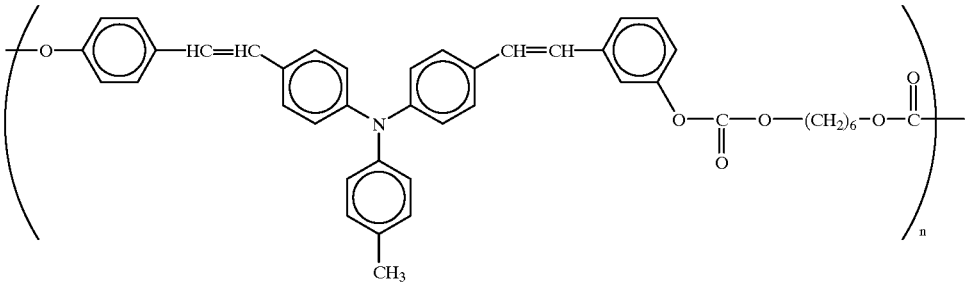
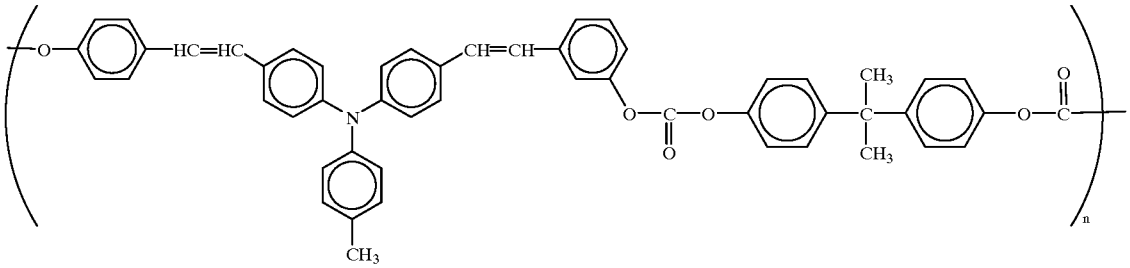

TABLE 8-continued
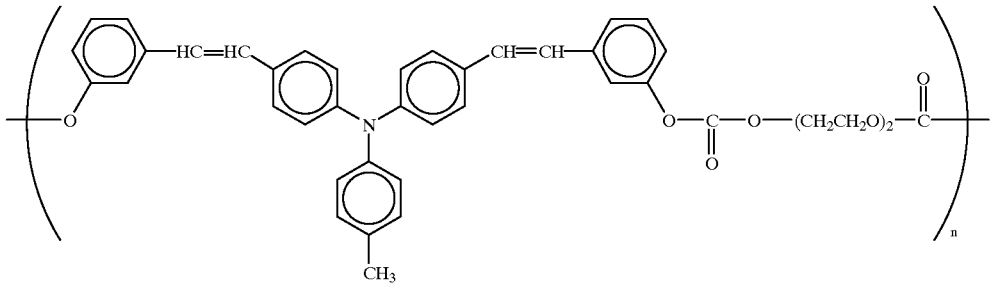
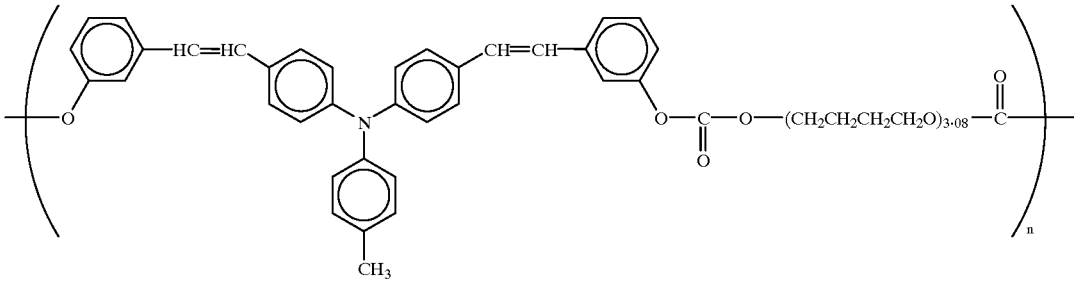
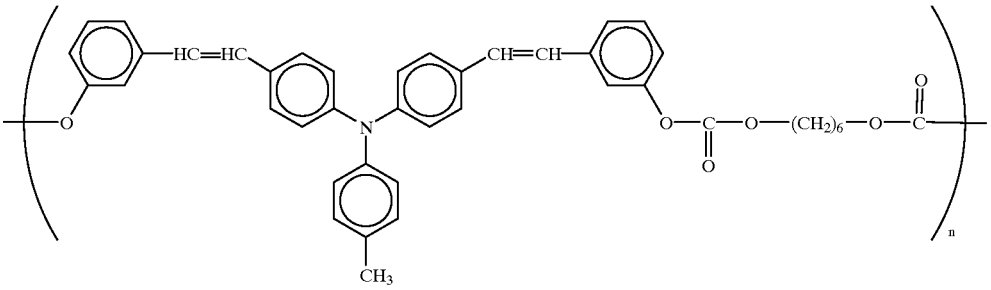
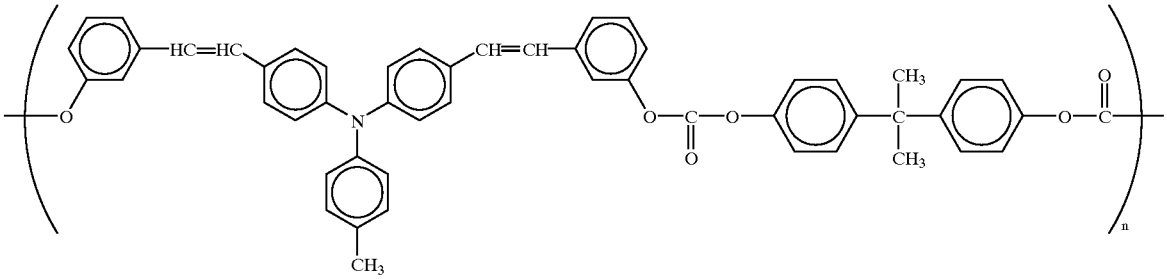
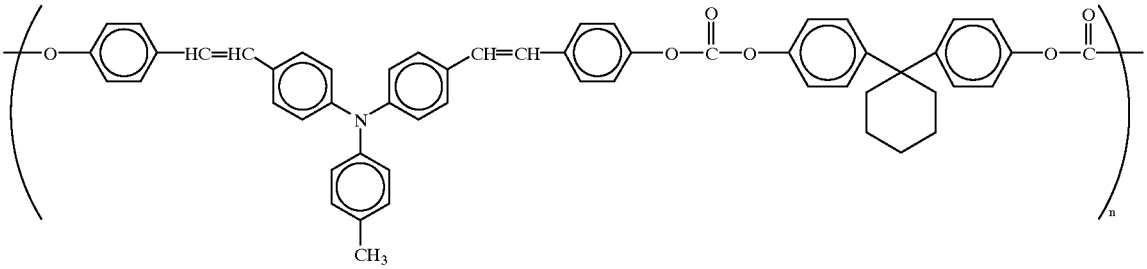

TABLE 8-continued
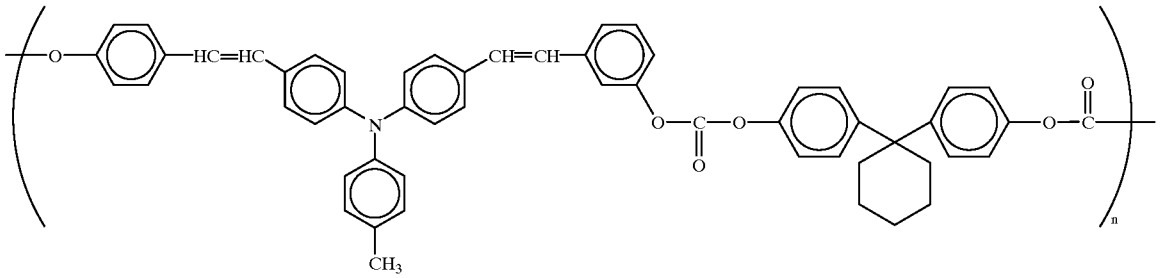
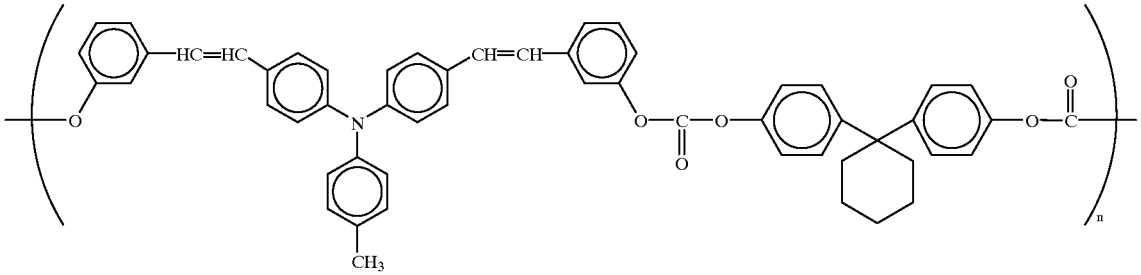
TABLE 9
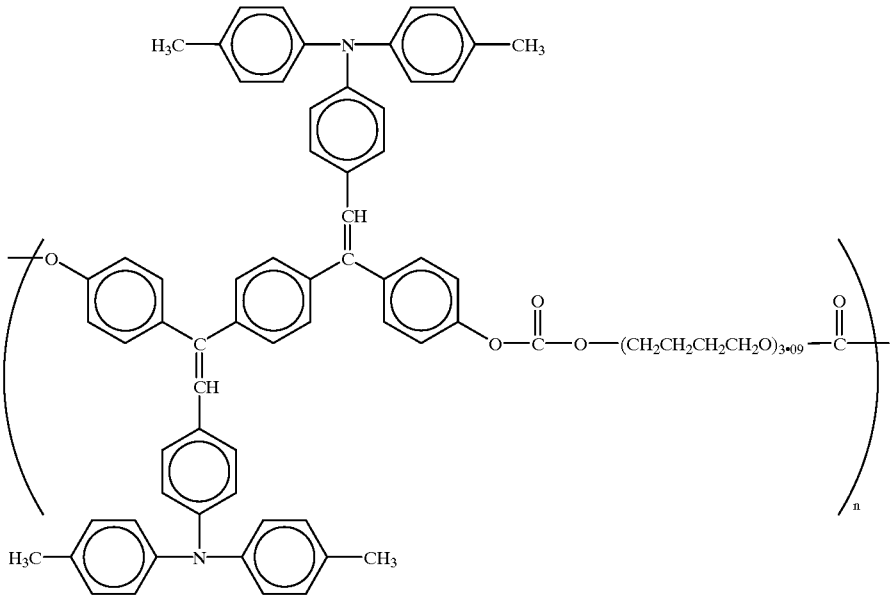

TABLE 9-continued
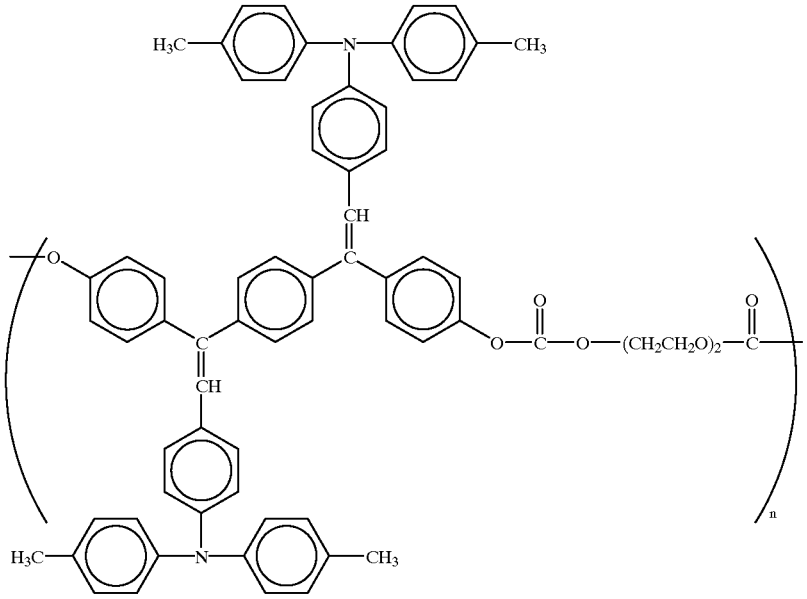
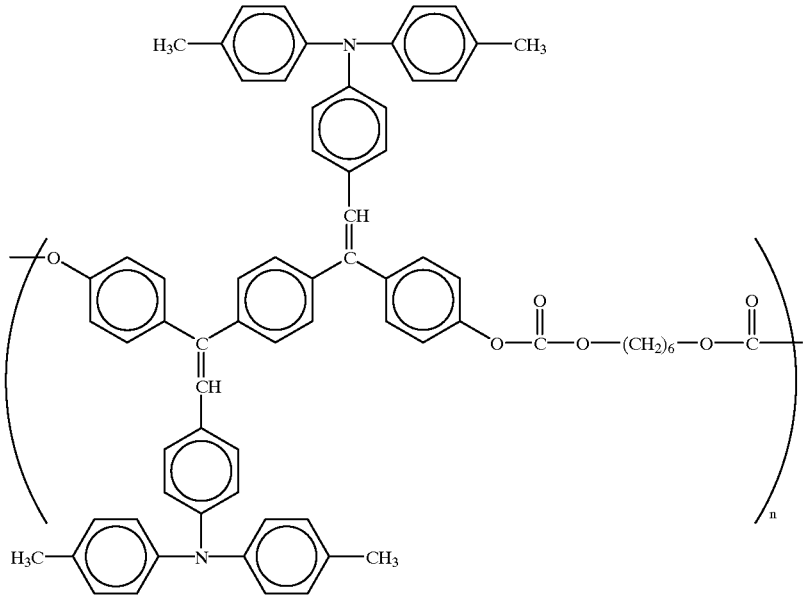

TABLE 9-continued
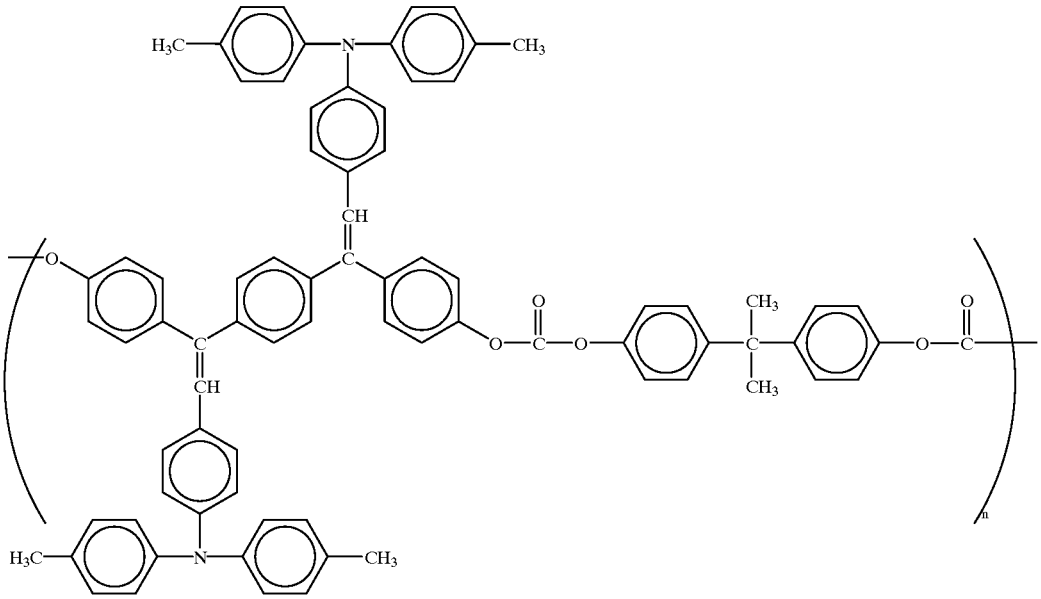
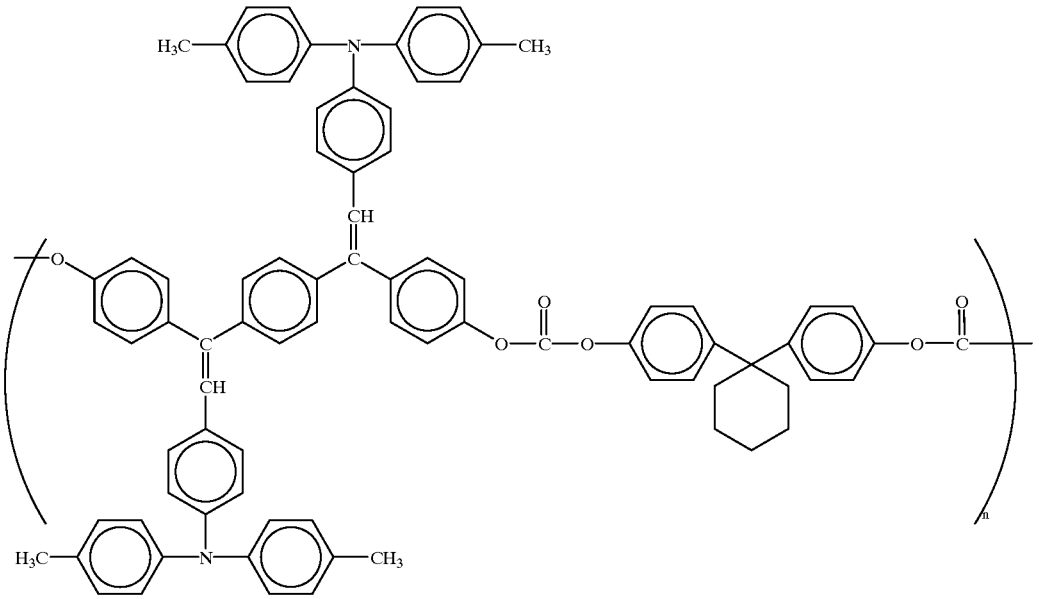
TABLE 10
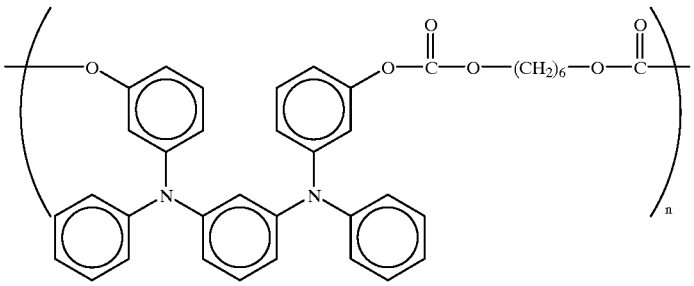

TABLE 10-continued
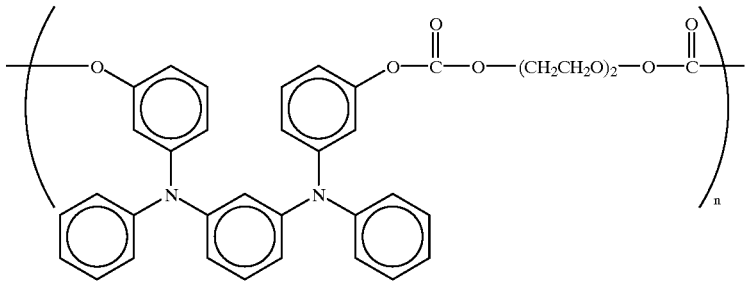
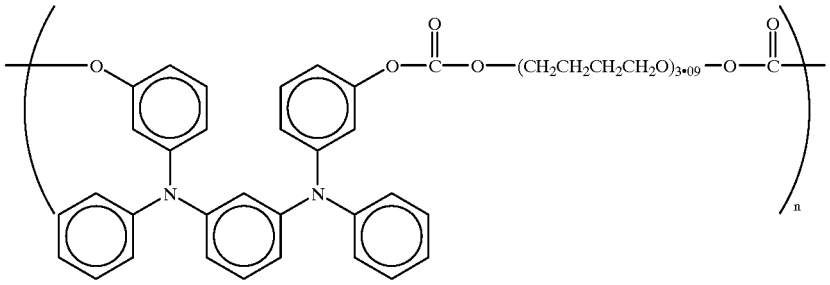
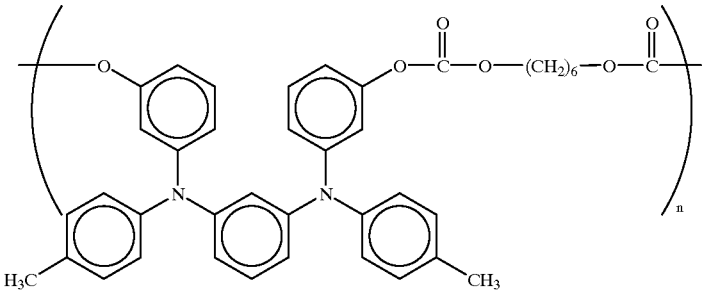
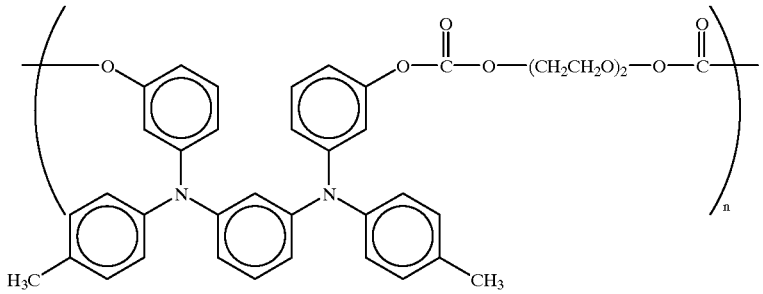
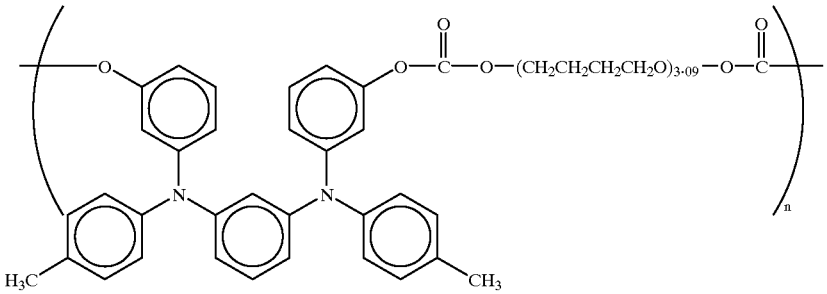

TABLE 10-continued
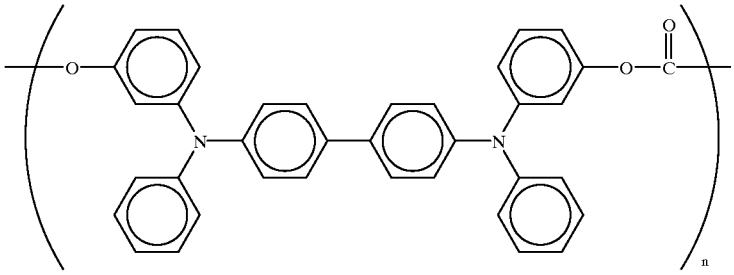
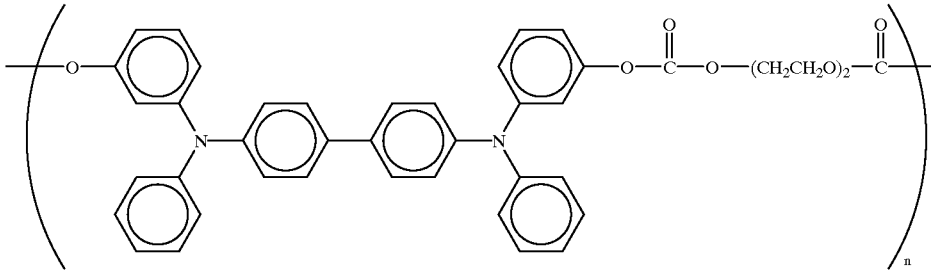
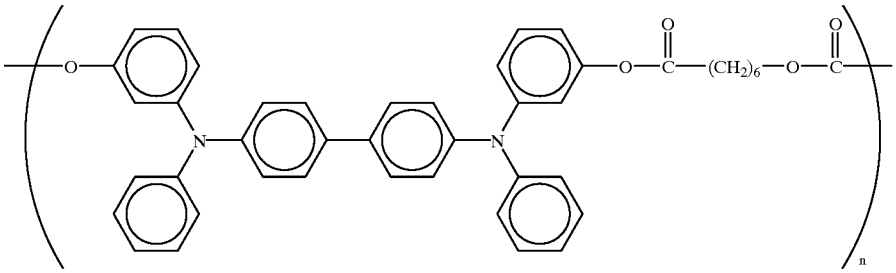
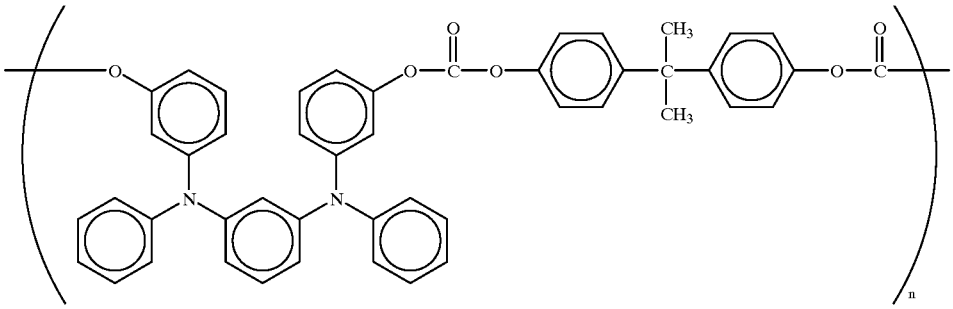
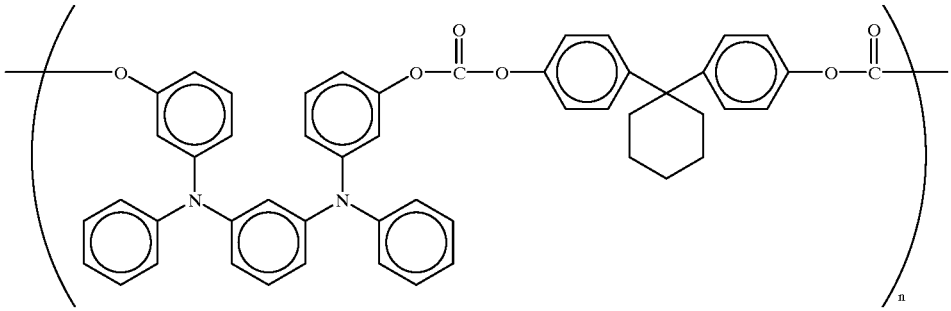

TABLE 10-continued

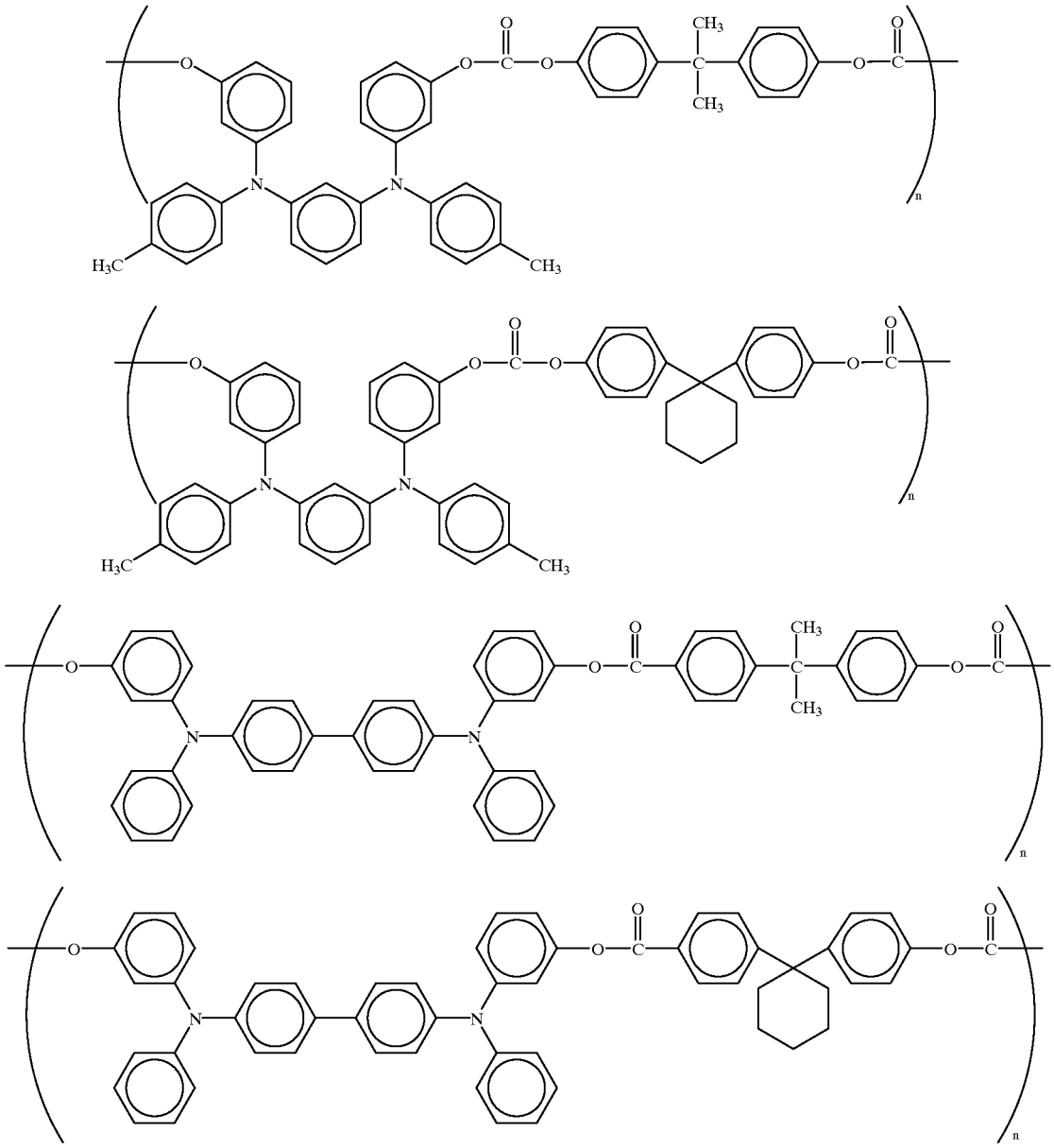

The charge transport layer 37 may include additives such as plasticizers and leveling agents. Specific examples of the plasticizers include known plasticizers, which are used for plasticizing resins, such as dibutyl phthalate, dioctyl phthalate and the like. The addition amount of the plasticizer is 0 to 30% by weight of the binder resin included in the CTL 37.

Specific examples of the leveling agents include silicone oils such as dimethyl silicone oil, and methyl phenyl silicone oil; polymers or oligomers including a perfluoroalkyl group in their side chain; and the like. The addition amount of the leveling agents is 0 to 1% by weight of the binder resin included in the CTL 37.

Next, the single-layered photosensitive layer as shown in FIG. 1 will be explained. The photosensitive layer 33 is a layer in which at least a TiOPc pigment serving as a charge generation material is dispersed in a binder resin. In addition, the photosensitive layer 33 may include a charge transport material to form a functionally-separated photosensitive layer. The photosensitive layer 33 can be formed, for example, by coating a coating liquid in which a charge generation material, a charge transport material and a binder resin are dissolved or dispersed in a solvent, and then drying the coated liquid. The photosensitive layer 33 may include a charge generation material other than titanyl phthalocyanine pigments and additives such as plasticizers, leveling agents and antioxidants.

Suitable binder resins for use in the photosensitive layer 33 include the resins mentioned above for use in the charge transport layer 37. The resins for use in the charge generation layer 35 can be added as a binder resin. In addition, the charge transport polymer materials mentioned above can also be used as a binder resin.

The content of the charge generation material is preferably from 5 to 40 parts by weight per 100 parts by weight of the binder resin included in the photosensitive layer 33. The content of the charge transport material is preferably from 0 to 190 parts, and more preferably from 50 to 150 parts by weight, per 100 parts by weight of the binder resin included in the photosensitive layer 33.

Suitable solvents for use in the photosensitive layer coating liquid include known organic solvents such as tetrahydrofuran, dioxane, dichloroethane, cyclohexane and the like solvents. Suitable coating methods include known coating methods such as dip coating, spray coating, bead coating, and the like. The thickness of the photosensitive layer 33 is preferably from 5 to 100 $\mu$m.

In the single-layered photosensitive layer 33, the concentrations of the ions relative to the charge generation material (organic pigment) included therein are preferably controlled as follows:

$K^+$: not greater than 50 ppm, and preferably from 0.1 to 50 ppm $Na^+$: not greater than 200 ppm, and preferably from 0.1 to 50 ppm $NO_3^-$: not greater than 50 ppm, and preferably from 0.1 to 50 ppm $HCOO^-$: not greater than 100 ppm, and preferably from 0.1 to 100 ppm $NO_2^-$: not greater than 50 ppm, and preferably from 0.1 to 50 ppm $Cl^-$: not greater than 100 ppm, and preferably from 0.1 to 50 ppm $Br^-$: not greater than 50 ppm, and preferably from 0.1 to 50 ppm $NH_4^+$: from 10 to 300 ppm When the contents of $K^+$ and $Na^+$ are too low (i.e., less than 0.1 ppm), a problem such that the background development problem tends to occur in the resultant images. When the contents of $NO_3^-$, $NO_2^-$, $Cl^-$ and $Br^-$ are too low (i.e., less than 0.1 ppm), a problem such that image density of the resultant images tends to decrease. In addition, when the content of $NH_4^+$ is too low (i.e., less than 10 ppm), problems such that the surface potential of the resultant photoreceptor decreases and background development occurs in the resultant images tend to occur.

Alternatively, the total content of water-soluble salts in the photosensitive layer 33 is not greater than 1000 ppm of the one or more organic pigments (i.e., charge generation material) included in the photosensitive layer 33.

The photoreceptor including the thus prepared photosensitive layer 33 has good charge properties and can produce good images without causing undesired black spot images.

The photoreceptor of the present invention may have an undercoat layer between the substrate 31 and the photosensitive layer (i.e., the photosensitive layer 33 in FIG. 1, the charge generation layer 35 in FIG. 2, or the charge transport layer 37 in FIG. 3).

The undercoat layer includes a resin as a main component. Since a photosensitive layer is typically formed on the undercoat layer by coating a liquid including an organic solvent, the resin in the undercoat layer preferably has good resistance to the organic solvent.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moire in the recorded images and to decrease the residual surface potential of the photoreceptor. The undercoat layer can also be formed by coating a coating liquid using a proper solvent and a proper coating method as mentioned above in the photosensitive layer.

A metal oxide layer which is formed, for example, by a sol-gel method using a silane coupling agent, titanium coupling agent or a chromium coupling agent can also be used as an undercoat layer.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as an undercoat layer.

The thickness of the undercoat layer is preferably 0 to about 5 $\mu$m.

The photoreceptor of the present invention may include a protective layer, which is formed overlying the photosensitive layer (i.e., the photosensitive layer 33 in FIG. 1, the charge transport layer 37 in FIG. 2, or the charge generation layer 35 in FIG. 3) , to protect the photosensitive layer.

Suitable materials for use in the protective layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like.

The protective layer may include a fluorine-containing resin such as polytetrafluoroethylene, or a silicone resin to improve the abrasion resistance of the photoreceptor. In addition, the protective layer may include an inorganic filler such as titanium oxide, tin oxide, potassium titanate and the like, which is dispersed in a resin. Among these inorganic materials, metal oxides are preferably used. In particular, titanium oxide, alumina, and silica are preferably used. In addition, it is preferable to include a charge transport material in the protective layer. Suitable charge transport materials include low molecular charge transport materials and charge transport polymer materials. Specific examples thereof include the materials mentioned above for use in the charge transport layer.

The protective layer can be formed by one of the known coating methods such as spray coating, bead coating, nozzle coating, spinner coating, ring coating methods and the like methods.

The thickness of the protective layer is preferably from 0.1 to 10 $\mu$m.

In addition, a layer of amorphous carbon or amorphous silicon carbide which is formed by a vacuum evaporation method can also be used as the protective layer.

In the present invention, an intermediate layer may be formed between the photosensitive layer and the protective layer. The intermediate layer includes a resin as a main component. Specific examples of the resin include polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 $\mu$m.

In the photoreceptor of the present invention, one or more additives such as antioxidants, plasticizers, lubricants, ultraviolet absorbents and leveling agents can be used in one or more of the layers to improve the stability to withstand environmental conditions, namely to avoid decrease of the photosensitivity and increase of the residual potential.

Suitable antioxidants for use in the layers of the photoreceptor include the following compounds but are not limited thereto.

(a) Phenolic compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic sulfur-including compounds dilauryl-3,3'-thiodipropionate, distearyl-3,3'-thiodipropionate, ditetradecyl-3,3'-thiodipropionate, and the like.

(e) Organic phosphorus-containing compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric acid esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic acid esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic carboxylic acid esters trioctyl trimellitate, tri-n-octyl trimellitate, octyl oxybenzoate, and the like.

(d) Dibasic fatty acid esters dibutyl adipate, di-n-hexyl adipate, di-2-ethylhexyl adipate, d-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty acid ester derivatives butyl oleate, glycerin monooleate, methyl acetylricinolate, pentaerythritol esters, dipentaerythritol hexaesters, triacetin, tributyrin, and the like.

(f) Oxyacid esters methyl acetylricinolate, butyl acetylricinolate, butylphthalylbutyl glycolate, tributyl acetylcitrate, and the like.

(g) Epoxy compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric alcohol esters diethylene glycol dibenzoate, triethylene glycol di-2-ethylbutyrate, and the like.

(i) Chlorine-containing compounds chlorinated paraffin, chlorinated diphenyl, methyl esters of chlorinated fatty acids, methyl esters of methoxychlorinated fatty acids, and the like.

(j) Polyester compounds polypropylene adipate, polypropylene sebacate, acetylated polyesters, and the like.

(k) Sulfonic acid derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric acid derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty acids lauric acid, myristic acid, palmitic acid, stearic acid, arachidic acid, behenic acid, and the like.

(c) Fatty acid amides

Stearic acid amide, palmitic acid amide, oleic acid amide, methylenebisstearamide, ethylenebisstearamide, and the like.

(d) Ester compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic soaps lead stearate, cadmium stearate, barium stearate, calcium stearate, zinc stearate, magnesium stearate, and the like.

(g) Natural waxes

Carnauba wax, candelilla wax, beeswax, spermaceti, insect wax, montan wax, and the like.

(h) Other compounds silicone compounds, fluorine compounds, and the like.

Suitable ultraviolet absorbing agents for use in the layers of the photoreceptor include the following compounds but are not limited thereto.

(a) Benzophenone compounds 2-hydroxybenzophenone, 2,4-dihydroxybenzophenone, 2,2',4-trihydroxybenzophenone, 2,2',4,4'- tetrahydroxybenzophenone, 2,2'-dihydroxy-4-methoxybenzophenone, and the like.

(b) Salicylate compounds phenyl salicylate, 2,4-di-t-butylphenyl-3,5-di-t-butyl-4-hydroxybenzoate, and the like.

(c) Benzotriazole compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano acrylate compounds ethyl-2-cyano-3,3-diphenyl acrylate, methyl-2-carbomethoxy-3-(paramethoxy) acrylate, and the like.

(e) Quenchers (metal complexes)

nickel(2,2'-thiobis(4-t-octyl)phenolate)-n-butylamine, nickeldibutyldithiocarbamate, cobaltdicyclohexyldithiophosphate, and the like.

(f) HALS (hindered amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Hereinafter the image forming method and image forming apparatus using the photoreceptor of the present invention will be explained referring to drawings.

Figure 4:
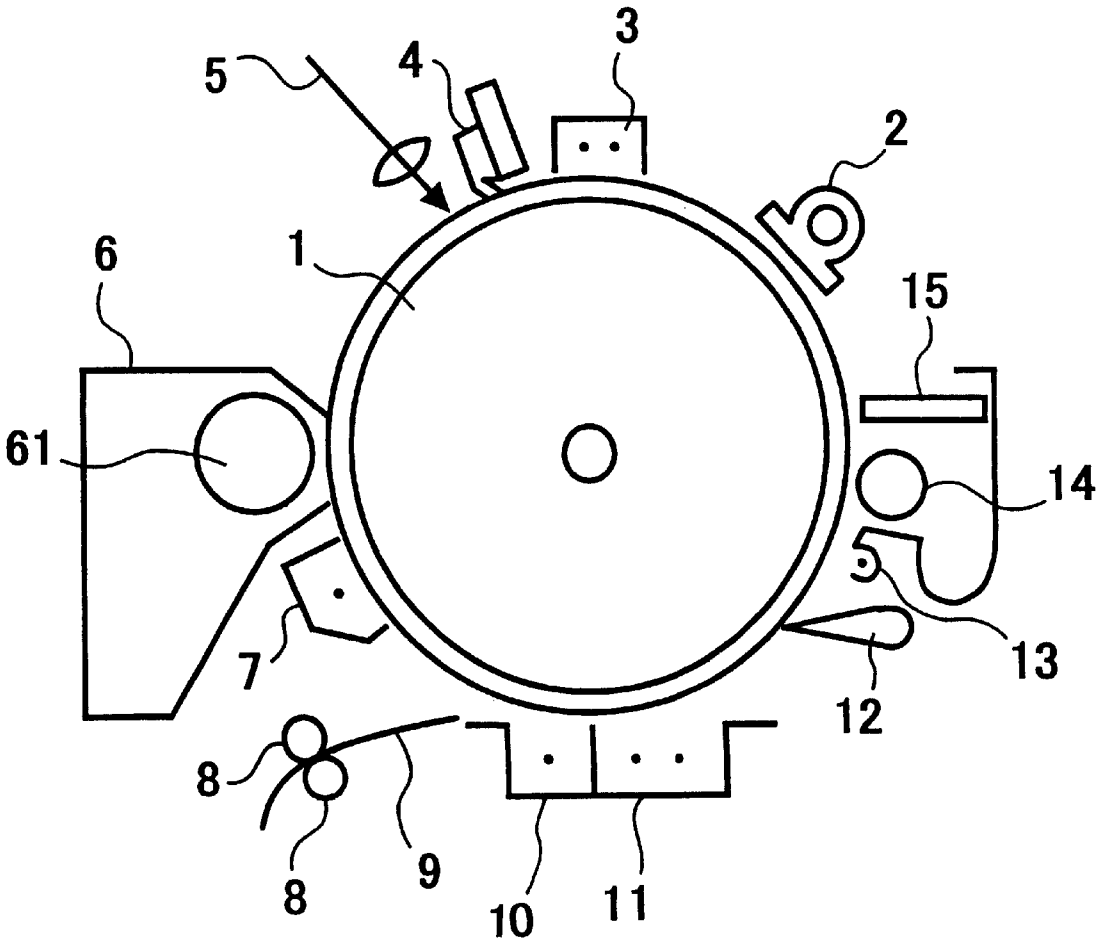
FIG. 4 is a schematic diagram used for explaining an embodiment of the electrophotographic image forming method and apparatus of the present invention.

FIG. 4 is a schematic view for explaining an embodiment of the image forming method and apparatus of the present invention.

In FIG. 4, numeral 1 denotes a cylindrical photoreceptor. The photoreceptor 1 is the photoreceptor of the present invention.

Around the photoreceptor 1, a discharging lamp 2, a charger 3, an eraser 4, an imagewise light irradiating device 5, a developing unit 6, a pre-transfer charger 7, a transfer charger 10, a separating charger 11, a separating pick 12, a pre-cleaning charger 13, a cleaning brush 14, and a cleaning blade 15 are counterclockwise configured in this order. In addition, a pair of registration rollers 8 are provided to feed a transfer paper 9 to the space between the photoreceptor 1 and the transfer charger 10 (and the separating charger 11). The photoreceptor 1 rotates in a counterclockwise direction.

In the image forming apparatuses of the present invention, the cleaning members such as the pre-cleaning charger 13, cleaning brush 14 and cleaning blade 15, and the discharging members such as the discharging lamp 2 may be removed from the image forming apparatuses.

The photoreceptor 1 is positively or negatively charged with the charger 3 while the photoreceptor 1 is rotating. Residual toner is removed from the photoreceptor 1 by the eraser 4, and then the imagewise light irradiating device 5 irradiates the photoreceptor 1 with imagewise light to form an electrostatic latent image on the photoreceptor 1.

Suitable charging devices for use as the charger 3, pre-transfer charger 7, transfer charger 10, separating charger 11, and pre-cleaning charger 13 include known charging devices such as corotrons, scorotrons, solid state chargers, charging rollers and the like.

Among these charging devices, chargers which contact or is configured closely to the photoreceptor 1 are preferably used because of generation of ozone and power consumption can be decreased. Among these chargers, charging mechanisms which is configured closely to the photoreceptor 1, i.e., charging mechanisms whose charging member is set closely to the photoreceptor with a proper gap therebetween are preferably used.

In addition, when the photoreceptor 1 is charged with a charging member, it is preferable to apply electric field, which is formed by overlapping an AC voltage with a DC voltage, to the charging member to perform uniform charging.

Any known charging devices can be used as the transfer charger 10; however, the transfer device as shown in FIG. 4, i.e., a combination of the transfer charger 10 with the separating charger 11, is preferable because of being efficient.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used. These light sources can also be used for the image transfer process, discharging process, and cleaning process, and a pre-exposure process which is optionally performed, if it is needed to irradiate the photoreceptor 1 with light in the processes.

The electrostatic latent image formed on the photoreceptor 1 is then developed with a toner on a developing roller 61 in the developing unit 6. The toner image formed on the photoreceptor 1 is then charged with the pre-transfer charger 7 so that the toner image has a charge suitable for transferring. The toner image is then transferred onto the transfer paper 9 while the transfer paper 9 is charged with the transfer charger 10. The transfer paper 9 is then charged with the separating charger 11 so as to easily separate from the photoreceptor 1 by being released from the state in which the transfer paper 9 and the photoreceptor 1 are electrostatically adhered to each other. The transfer paper 9 is then separated from the photoreceptor 1 with the separating pick 12. After the toner image transferring process, the surface of the photoreceptor 1 is cleaned using the pre-cleaning charger 13, the fur brush 14 and the cleaning blade 15. The residual toner remaining on the photoreceptor 1 can be removed by only a cleaning brush.

When the photoreceptor 1 which is previously charged positively or negatively is exposed to imagewise light, an electrostatic latent image having a positive or negative charge is formed on the photoreceptor 1. When the latent image having a positive (negative) charge is developed with a toner having a negative (positive) charge, a positive image (i.e., the same image as the latent image) can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

In the image forming apparatus as shown in FIG. 4, a cylindrical photoreceptor is used; however, a sheet-shaped or endless-belt-shaped photoreceptor can also be used. In addition, corotrons, scorotrons, solid state chargers, and charging rollers can be used as the pre-cleaning charger 13. These chargers can also be used as a substitute for the transfer charger 10 and the separating charger 11; however, the unity of the transfer charger 10 and the separating charger 11 is preferable because of being efficient. Further, known brushes such as fur brushes and magnetic fur brushes can be used as the cleaning brush 14.

Figure 5:
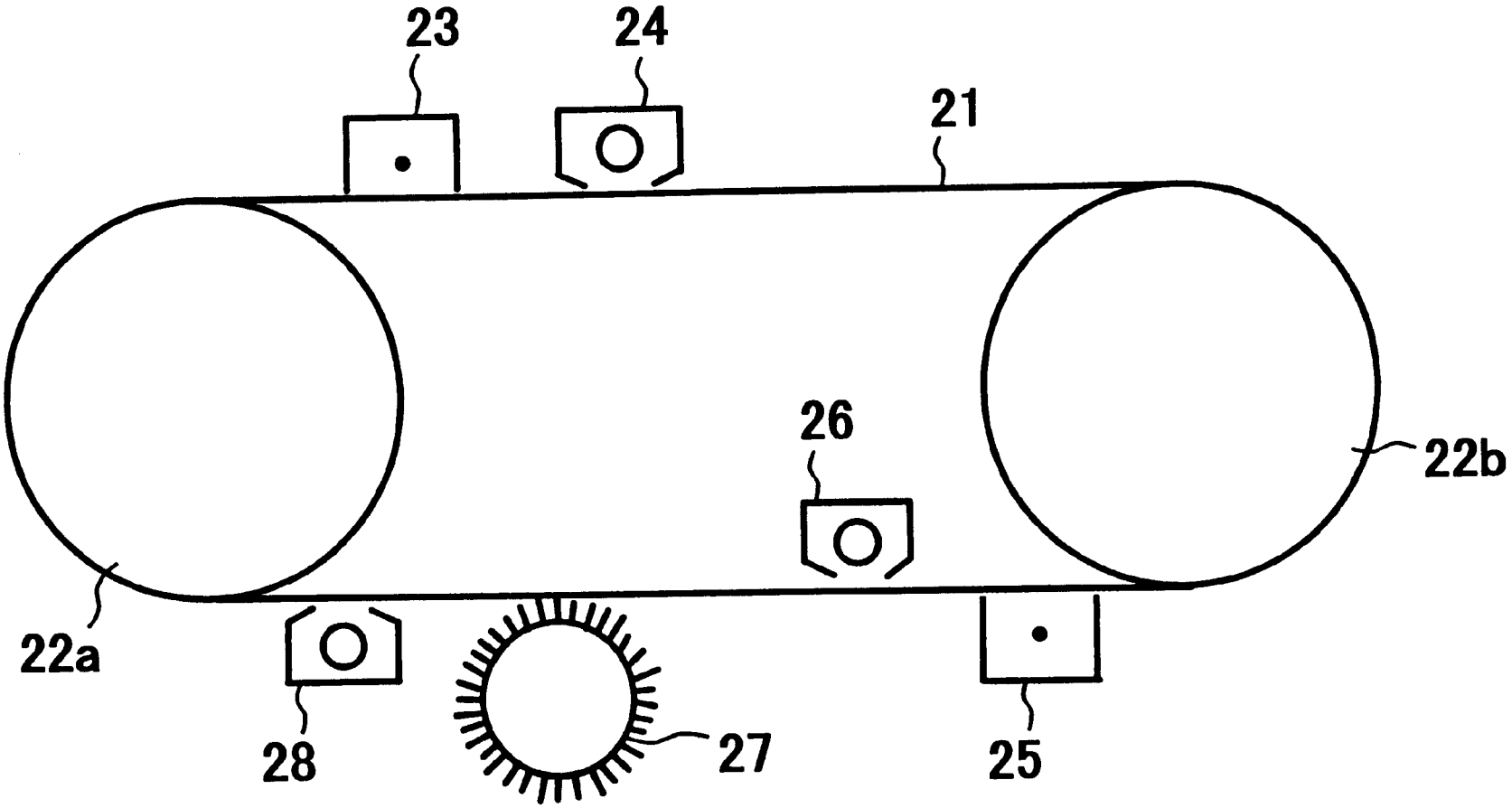
FIG. 5 is a schematic diagram used for explaining another embodiment of the electrophotographic image forming method and apparatus of the present invention.

FIG. 5 is a schematic view for explaining another embodiment of the image forming method and apparatus of the present invention. In this embodiment, a belt-shaped photoreceptor 21 is used. The photoreceptor 21 is the photoreceptor of the present invention.

The belt-shaped photoreceptor 21 is rotated by rollers 22*a* and 22*b*. The photoreceptor 21 is charged with a charger 23, and then exposed to imagewise light emitted by an imagewise light irradiating device 24 to form an electrostatic latent image in the photoreceptor 21. The latent image is developed with a developing unit (not shown in FIG. 5) to form a toner image on the photoreceptor 21. The toner image is transferred onto a transfer paper (not shown) using a transfer charger 25. After the toner image transferring process, the surface of the photoreceptor 21 is cleaned with a cleaning brush 27 after performing a pre-cleaning light irradiating operation using a pre-cleaning light irradiating device 26. Then the photoreceptor 21 is discharged by being exposed to light emitted by a discharging light source 28. In the pre-cleaning light irradiating process, light may irradiate the photoreceptor 21 from the side of the substrate thereof. In this case, the substrate has to be light-transmissive.

The image forming apparatus of the present invention is not limited to the image forming units as shown in FIGS. 4 and 5. For example, in FIG. 5, the pre-cleaning light irradiating operation can be performed from the photosensitive layer side of the photoreceptor 21. In addition, the light irradiation in the light image irradiating process and the discharging process may be performed from the substrate side of the photoreceptor 21.

Further, a pre-transfer light irradiation operation, which is performed before the transferring of the toner image, and a preliminary light irradiation operation, which is performed before the imagewise light irradiation, and other light irradiation operations may also be performed.

The above-mentioned image forming unit may be fixedly set in a copier, a facsimile or a printer. However, the image forming unit may be set therein as a process cartridge. The process cartridge means an image forming unit which includes at least a photoreceptor and one of a charging device, an imagewise light irradiation device, a developing device, a transfer device, a cleaning device, and a discharge device.

Figure 6:
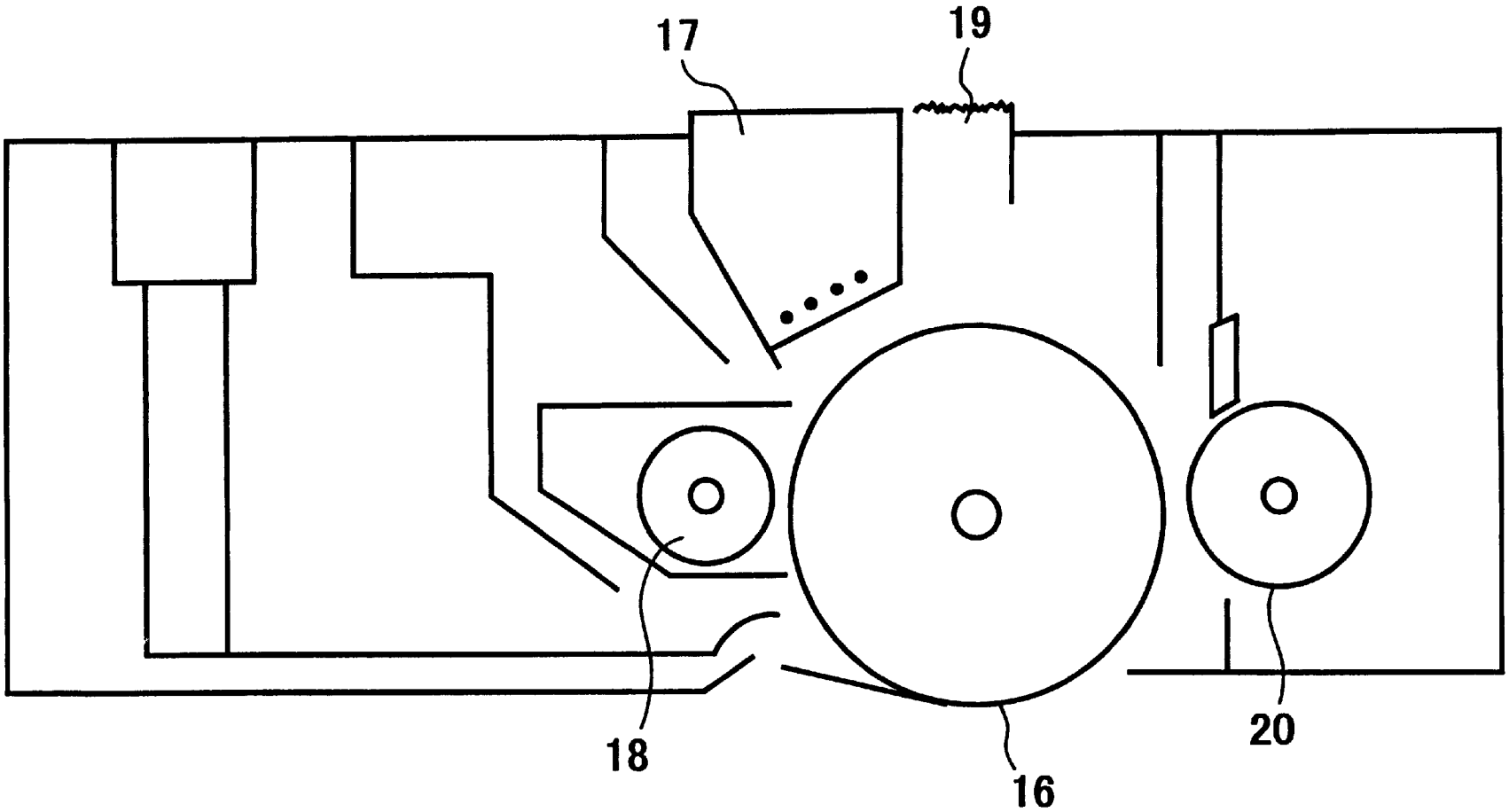
FIG. 6 is a schematic diagram illustrating an embodiment of the electrophotographic image forming process cartridge of the present invention.

FIG. 6 is a schematic view illustrating an embodiment of the process cartridge of the present invention. In FIG. 6, the process cartridge includes a photoreceptor 16, a charger 17, a cleaning brush 18, an imagewise light irradiation device 19 and a developing roller 20. The photoreceptor 16 is the photoreceptor of the present invention. The process cartridge of the present invention is not limited thereto, and includes at least the photoreceptor of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of titanyl phthalocyanine

At first, the method for synthesizing titanyl phthalocyanine pigments for use in the present invention will be explained in detail.

Synthesis Examples 1

In a container, 292 g of 1,3-diiminoisoindoline and 2000 ml of sulfolane were contained and stirred. Under a nitrogen gas flow, 204 g of titanium tetrabutoxide were dropped in the mixture. After the addition of titanium tetrabutoxide was finished, the temperature of the mixture was gradually increased to 180° C. The temperature of the mixture was maintained at a temperature range of from 170° C. to 180° C. for 5 hours while stirring the mixture to react the compounds. After the reaction was terminated, the reaction product was cooled. Then the reaction product was filtered to obtain the precipitate. Then the precipitate was washed with chloroform until the precipitate colored blue. The cake was then washed with methanol several times, and further washed with hot water of 80° C. several times. Then the cake was dried. Thus, a rough titanyl phthalocyanine powder was obtained. The thus prepared rough titanyl phthalocyanine powder was dissolved in concentrated sulfuric acid having a weight of 20 times the weight of the powder. The solution was dropped into iced water having a weight of 100 times the weight of the powder while stirring, to deposit a pigment. The mixture was filtered to obtain a wet cake of the pigment. The cake was washed with de-ionized water until $K^+$ ions were not detected from the filtrate. The detection of $K^+$ ions was performed using an ion chromatography analyzer tradenamed as IC7000P and manufactured by Yokogawa Electric Corporation. Thus, a wet cake of a titanyl phthalocyanine pigment was prepared.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 1 (hereinafter referred to as TiOPc 1) was prepared.

The TiOPc 1 was exposed to X-ray to obtain its X-ray diffraction spectrum. The conditions were as follows:

X-ray tube: copper

Voltage: 40 kV

Current: 20 mA

Scanning speed: 1°/min

Scanning range: 3° to 40°

Time constant: 2 seconds

Figure 7:
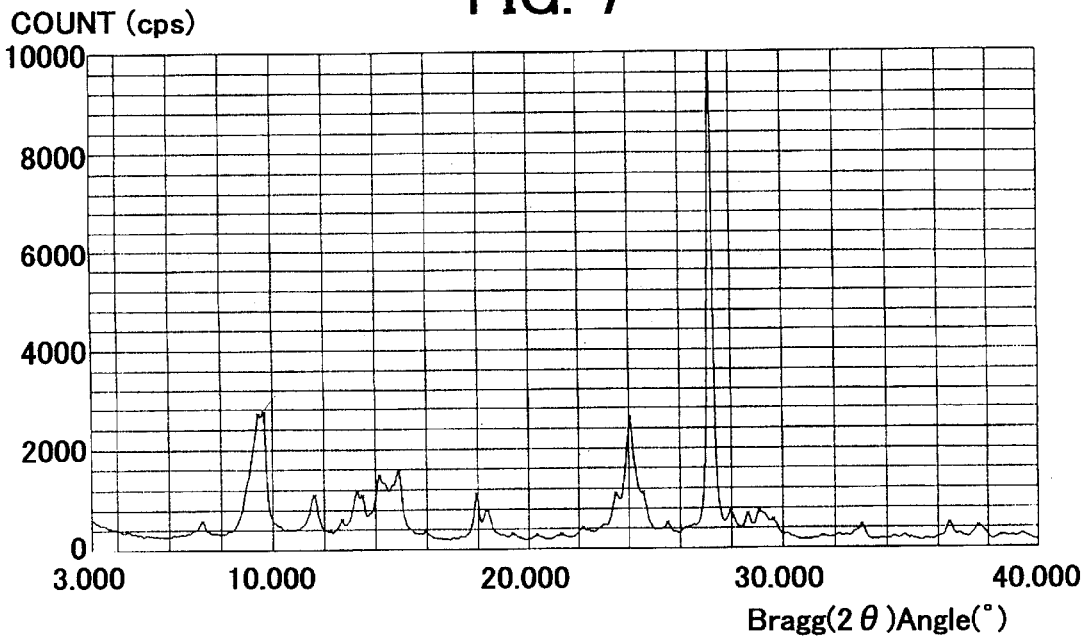
FIGS. 7–9 are graphs illustrating X-ray diffraction spectra of titanyl phthalocyanine pigments for use in the photoreceptor of the present invention.

The X-ray diffraction spectrum of the TiOPc 1 is shown in FIG. 7. As can be understood from FIG. 7, the TiOPc 1 has a crystal form such that main peaks of the X-ray diffraction spectrum are observed at least at Bragg (2 θ) angles of 9.6°±0.2°, 24.0°±0.2° and 27.2°±0.2°. The ratio of intensity of each main peak to the maximum peak is shown in Table 11.

TABLE 11

| Peak | Intensity ratio |
|---|---|
| Peak observed at 9.6° ± 0.2° | 0.27 |
| Peak observed at 24.0° ± 0.2° | 0.25 |
| Peak observed at 27.2° ± 0.2° | 1.0 |

Synthesis Example 2

Figure 8:
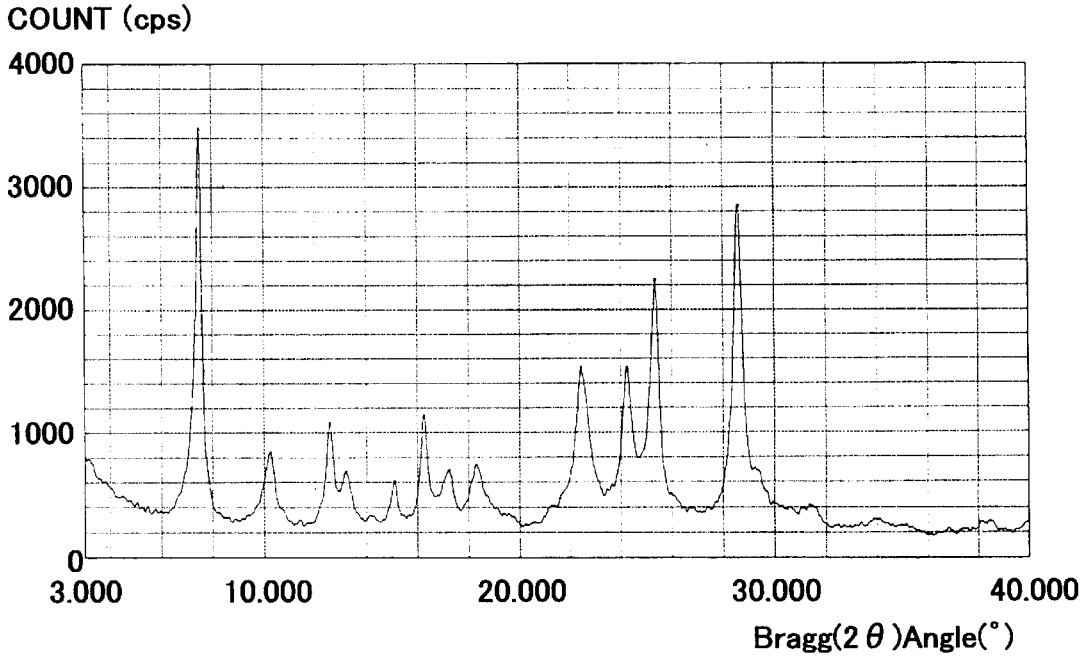

The TiOPc 1 was treated with 2-butanone, and then the solvent was dried to obtain a powder. Thus a TiOPc 2 was prepared. The X-ray diffraction spectrum of the TiOPc 2 is shown in FIG. 8. As can be understood from FIG. 8, main peaks were observed at least at Bragg (2 θ) angles of 7.5°±0.2°, 25.3°±0.2° and 28.6°±0.2°. The ratio of intensity of each main peak to the maximum peak is shown in Table 12.

TABLE 12

| Peak | Intensity ratio |
|---|---|
| Peak observed at 7.5° ± 0.2° | 1.0 |
| Peak observed at 25.3° ± 0.2° | 0.63 |
| Peak observed at 28.6° ± 0.2° | 0.81 |

Synthesis Example 3

Figure 9:
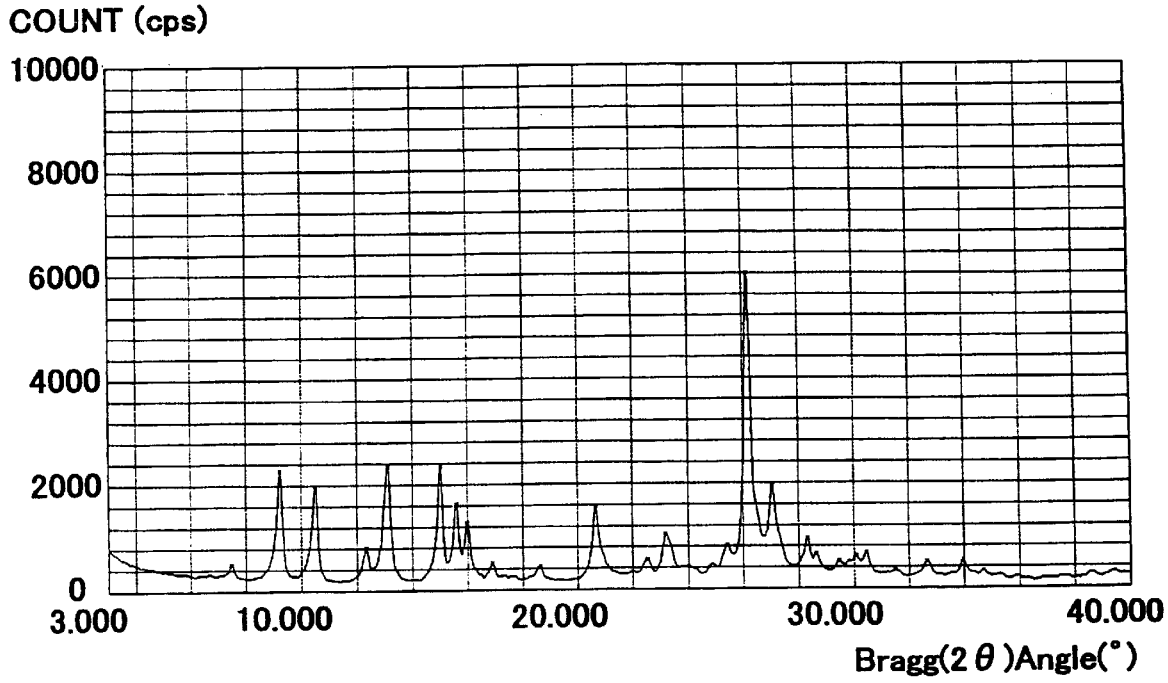

The TiOPc 1 was treated with tetrahydrofuran, and then the solvent was dried to obtain a powder. Thus a titanyl phthalocyanine pigment 3 was prepared. The X-ray diffraction spectrum of the TiOPc 3 is shown in FIG. 9 As can be understood from FIG. 9, main peaks were observed at least at Bragg (2 θ) angles of 9.3±0.2°, 13.1°±0.2° and 26.2°±0.2°. The ratio of intensity of each main peak to the maximum peak is shown in Table 13.

TABLE 13

| Peak | Intensity ratio |
|---|---|
| Peak observed at 9.3° ± 0.2° | 0.36 |
| Peak observed at 13.1° ± 0.2° | 0.37 |
| Peak observed at 26.2° ± 0.2° | 1.0 |

Synthesis Example 4

The wet cake of a titanyl phthalocyanine pigment which had been prepared in Synthesis Example 1 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 4 was prepared.

When the TiOPc 4 was exposed to X-ray, main peaks were observed at least at Bragg (2 θ) angles of 9.0°±0.2°, 14.2±0.2°, 23.9°±0.2° and 27.1°±0.2°. The ratio of intensity of each main peak to the maximum peak is shown in Table 14.

TABLE 14

| Peak | Intensity ratio |
|---|---|
| Peak observed at 9.0° ± 0.2° | 0.74 |
| Peak observed at 14.2° ± 0.2° | 0.42 |
| Peak observed at 23.9° ± 0.2° | 0.38 |
| Peak observed at 27.1° ± 0.2° | 1.0 |

Synthesis Example 5

The wet cake of a titanyl phthalocyanine pigment which had been prepared in Synthesis Example 1 was washed with deionized water while measuring $K^+$ ions in the filtrate. When the content of $K^+$ ions relative to the pigment was about 30 ppm, the washing treatment was stopped. The wet cake was further treated with 1,2-dichloroethane in the same method as performed in Synthesis Example 1. Thus a TiOPc 5 was prepared.

When the TiOPc 5 was exposed to X-ray, main peaks were observed at least at Bragg (2 θ) angles of 9.6°±0.2°, 24.0°±0.2°, and 27.2°±0.2°. The X-ray diffraction spectrum was almost the same as that of the TiOPc 1. The content of $K^+$ ions in the TiOPc 5 was 28 ppm.

Synthesis Example 6

The wet cake of a titanyl phthalocyanine pigment which had been prepared in Synthesis Example 1 was washed with deionized water while measuring $K^+$ ions in the filtrate. When the content of $K^+$ ions relative to the pigment was about 100 ppm, the washing treatment was stopped. The wet cake was further treated with 1,2-dichloroethane in the same method as performed in Synthesis Example 1. Thus a TiOPc 6 was prepared.

When the TiOPc 6 was exposed to X-ray, main peaks were observed at least at Bragg (2 θ) angles of9.6°±0.2°, 24.0°±0.2°, and 27.2°±0.2°. The content of $K^+$ ions in the TiOPc 6 was 115 ppm. The X-ray diffraction spectrum was almost the same as that of the TiOPc 1.

Then photoreceptors of the present invention and comparative photoreceptors were prepared.

Example 1

Preparation of undercoat layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of charge generation layer

The following components were mixed.

| | |
|---|---|
| TiOPc 1 prepared above | 3 |
| Polyvinyl butyral | 2 |
| Tetrahydrofuran | 50 |
| 4-methyl-2-pentanone | 90 |

Deionized water in which potassium sulfate was dissolved was added into the mixture such that the concentration of $K^+$ ions relative to the TiOPc 1 was 8 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of charge transport layer coating liquid

The following components were mixed to prepare a charge transport layer coating liquid.

| | |
|---|---|
| Polycarbonate resin | 10 |
| Charge transport material having the following formula | 8 |

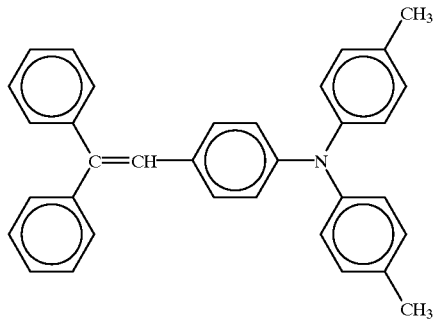

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 1 was prepared.

Examples 2 and 3 and Comparative Examples 1 and 2

The procedure for preparation of the photoreceptor in Example 1 was repeated except that the concentration of $K^+$ ions was changed as shown in Table 15.

Thus photoreceptors of Examples 2 and 3 and Comparative Examples 1 and 2 were prepared.

Evaluation method (1)

Each of the thus prepared photoreceptors of Examples 1 to 3 and Comparative Examples 1 and 2 was set one by one in an electrophotographic image forming apparatus as shown in FIG. 4 to perform a running test in which 10,000 copies were continuously produced. At this point, a laser diode emitting a laser having a wavelength of 780 nm was used as a light source of imagewise light irradiating device 5. In addition, a probe of a surface potential meter was set at a position just before the developing area to measure the surface potentials of a lighted area of the photoreceptor which had been exposed to light and a dark area which had not been exposed to light. This evaluation was performed with respect to the initial photoreceptors and the photoreceptors after the running test.

The results are shown in Table 15.

TABLE 15

| | Conc. of $K^+$ ions | Surface Potential (Initial) (V) | | Surface Potential (after running test) (V) | |
|---|---|---|---|---|---|
| | (ppm) | Dark area | Lighted area | Dark area | Lighted area |
| Ex. 1 | 8 | −850 | −130 | −840 | −135 |
| Ex. 2 | 18 | −855 | −130 | −840 | −135 |
| Ex. 3 | 40 | −860 | −135 | −840 | −140 |
| Comp. Ex. 1 | 100 | −865 | −155 | −850 | −190 |
| Comp. Ex. 2 | 200 | −865 | −160 | −850 | −210 |

As can be understood from Table 15, when the concentration of $K^+$ ions is not greater than 50 ppm, the resultant photoreceptor has good charge properties even after the running test.

Example 4 and Comparative Example 3

The procedure for preparation of the photoreceptor in Example 1 was repeated except that the TiOPc 1 was replaced with the TiOPc 5 or the TiOPc 6. Thus, photoreceptors of Example 4 and Comparative Example 3 were prepared. The photoreceptors were evaluated by the same method as performed in Example 1. The results are shown in Table 16.

TABLE 16

| | Conc. of $K^+$ ions | Surface Potential (Initial) (V) | | Surface Potential (after running test) (V) | |
|---|---|---|---|---|---|
| | (ppm) | Dark area | Lighted area | Dark area | Lighted area |
| Ex. 4 | 28 | −860 | −130 | −840 | −135 |
| Comp. Ex. 2 | 115 | −865 | −160 | −850 | −200 |

As can be understood from Table 16, the photoreceptor of Example 4 which includes the TiOPc including $K^+$ ions in an amount of 28 ppm has good charging properties even after the running test. On the contrary, the photoreceptor of Comparative Example 3, which includes the TiOPc including $K^+$ ions in an amount of 115 ppm, has poor charging properties (high residual potential) after the running test.

Example 5

The photoreceptor of Example 1 was evaluated in the same method as performed in Example 1 except that the charging device was changed from a scorotron charger to a charging roller which contacted the photoreceptor and to which a DC bias voltage of −850V was applied.

The image qualities of the initial images were good. The image qualities of the images after the running test were almost good, however, the images had slight undesired background fouling which was caused by toner filming on the charging roller. The odor of ozone during the running test was much less than that during the running test using the scorotron charger.

Example 6

The photoreceptor of Example 1 was evaluated in the same method as performed in Example 5 except that a tape having a thickness of 50 μm and a width of 5 mm was adhered to both ends of the charging roller to form a gap of 50 μm between the charging roller and the photoreceptor.

The filming problem occurred in Example 5 did not occur. However, when a half tone image was produced after the running test, the half tone image was slightly uneven, which was caused by uneven charging.

Example 7

The photoreceptor of Example 1 was evaluated in the same method as performed in Example 6 except that the charging conditions were changed as follows:

| | |
|---|---|
| DC bias voltage: | −850 V |
| AC bias voltage: | 1.8 kV (peak to peak value) in voltage<br>1.7 kHz in frequency |

The filming problem occurred in Example 5 did not occur, and in addition the uneven half tone image was not observed. In addition, when a half tone image was produced after the running test, the half tone image had good evenness.

Example 8

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Butanol | 20 |

The thus prepared undercoat layer coating liquid was coated on the surface of a nickel belt prepared by an electroforming method and then dried to form an undercoat layer of 2 $\mu$m thick thereon.

Preparation of Charge Generation Layer

The following components were mixed.

| | |
|---|---|
| TiOPc 2 prepared above | 4 |
| Polyvinyl butyral | 2 |
| Cyclohexanone | 50 |
| Tetrahydrofuran | 100 |

Deionized water in which potassium sulfate was dissolved was added into the mixture such that the concentration of $K^+$ ions relative to the TiOPc 2 was 5 ppm. Thus, a charge generation layer coating liquid was prepared.

The thus prepared charge generation layer coating liquid was coated on the undercoat layer and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

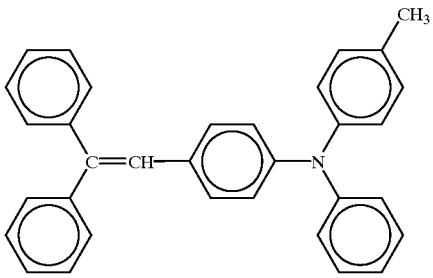

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 8 was prepared.

Examples 9 and 10 and Comparative Examples 4 and 5

The procedure for preparation of the photoreceptor in Example 8 was repeated except that the concentration of $K^+$ ions was changed as shown in Table 17.

Thus photoreceptors of Examples 9 and 10 and Comparative Examples 4 and 5 were prepared.

Evaluation Method (2)

Each of the thus prepared photoreceptors of Examples 8 to 10 and Comparative Examples 4 and 5 was set one by one in an electrophotographic image forming apparatus as shown in FIG. 5 to perform a running test in which 9,000 copies were continuously produced. At this point, a laser diode emitting a laser having a wavelength of 780 nm was used as a light source of imagewise light irradiating device 24. Laser light emitted from the laser diode was irradiated to the photoreceptor via a polygon mirror. The image qualities of the initial copy images and the images after the running test were visually evaluated.

The results are shown in Table 17.

TABLE 17

| | Conc. of $K^+$ ions (ppm) | Initial image qualities | Image qualities after running test |
|---|---|---|---|
| Ex. 8 | 5 | Good | Good |
| Ex. 9 | 20 | Good | Good |
| Ex. 10 | 40 | Good | Good |
| Comp. Ex. 4 | 80 | Good | Low image density |
| Comp. Ex. 5 | 160 | Slightly low image density | Low image density |

As can be understood from Table 17, when the concentration of $K^+$ ions is not greater than 50 ppm, the resultant photoreceptor produces good images.

Example 11

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 3 prepared above | 3 |
| Polyvinyl butyral | 1 |
| Cyclohexanone | 250 |
| Cyclohexane | 50 |

Deionized water in which potassium sulfate was dissolved was added into the mixture such that the concentration of $K^+$ ions relative to the TiOPc 3 was 1 ppm. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

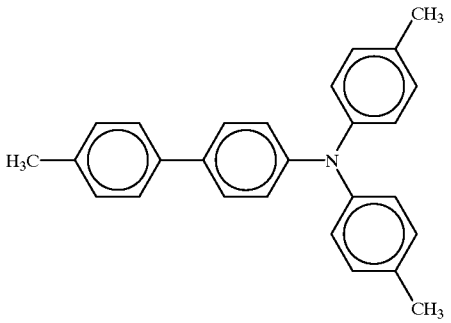

| | |
|---|---|
| Methylene chloride | 80 |

The thus prepared charge transport layer coating liquid was coated on the charge generation layer and then dried to form a charge transport layer having a thickness thereof was 23 μm.

Thus a photoreceptor of Example 11 was prepared.

Examples 12 and 13 and Comparative Examples 6 and 7

The procedure for preparation of the photoreceptor in Example 11 was repeated except that the concentration of $K^+$ ions was changed as shown in Table 18.

Thus photoreceptors of Examples 12 and 13 and Comparative Examples 6 and 7 were prepared.

Evaluation Method (3)

Each of the thus prepared photoreceptors of Examples 11 to 13 and Comparative Examples 6 and 7 was set one by one in an electrophotographic process cartridge as shown in FIG. 6 and then the cartridge was set in an image forming apparatus to perform a running test in which 5,000 copies were continuously produced. At this point, a laser diode emitting a laser having a wavelength of 780 nm was used as a light source of imagewise light irradiating device 19. Laser light emitted from the laser diode was irradiated to the photoreceptor via a polygon mirror. In addition, a probe of a surface potential meter was set at a position just before the developing area to measure the surface potentials of a lighted area of the photoreceptor which had been exposed to light and a dark area which had not been exposed to light. This evaluation was performed with respect to the initial photoreceptors and the photoreceptors after the running test.

The results are shown in Table 18.

TABLE 18

| | Conc. Of $K^+$ ion | Surface Potential (Initial) (V) | | Surface Potential (after running test) (V) | |
|---|---|---|---|---|---|
| | (ppm) | Dark area | Lighted area | Dark area | Lighted area |
| Ex. 11 | 1 | −870 | −120 | −860 | −115 |
| Ex. 12 | 19 | −870 | −125 | −860 | −115 |
| Ex. 13 | 34 | −880 | −130 | −865 | −120 |
| Comp. Ex. 6 | 85 | −900 | −150 | −860 | −190 |
| Comp. Ex. 7 | 120 | −905 | −180 | −860 | −220 |

As can be understood from Table 18, when the concentration of $K^+$ ions is not greater than 50 ppm, the resultant photoreceptor has good charge properties even after the running test.

Example 14

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 μm thick thereon.

Preparation of Charge Generation Layer

The following components were mixed.

| | |
|---|---|
| TiOPc 4 prepared above | 4 |
| Polyvinyl butyral | 2 |
| Cyclohexanone | 50 |
| Tetrahydrofuran | 100 |

Deionized water in which potassium sulfate was dissolved was added into the mixture such that the concentration of $K^+$ ions relative to the TiOPc 4 was 3 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

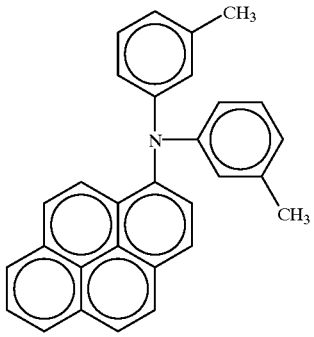

| | |
|---|---|
| Tetrahydrofuran | 80 |

The thus prepared charge transport layer coating liquid was coated on the charge generation layer and then dried to form a charge transport layer having a thickness thereof was 25 μm.

Thus a photoreceptor of Example 14 was prepared.

Examples 15 and 16 and Comparative Examples 8 and 9

The procedure for preparation of the photoreceptor in Example 14 was repeated except that the concentration of $K^+$ ions was changed as shown in Table 19.

Thus photoreceptors of Examples 15 and 16 and Comparative Examples 8 and 9 were prepared.

Example 17

The procedure for preparation of the photoreceptor in Example 14 was repeated except that the deionized water including potassium sulfate was not added to the charge generation layer coating liquid.

toreceptor produces images whose background area is slightly soiled after the running test.

Example 18

The procedure for preparation of the photoreceptor in Example 1 was repeated except that the formulation of the charge transport layer coating liquid was changed as follows.

Charge transport polymer material having the following formula 10

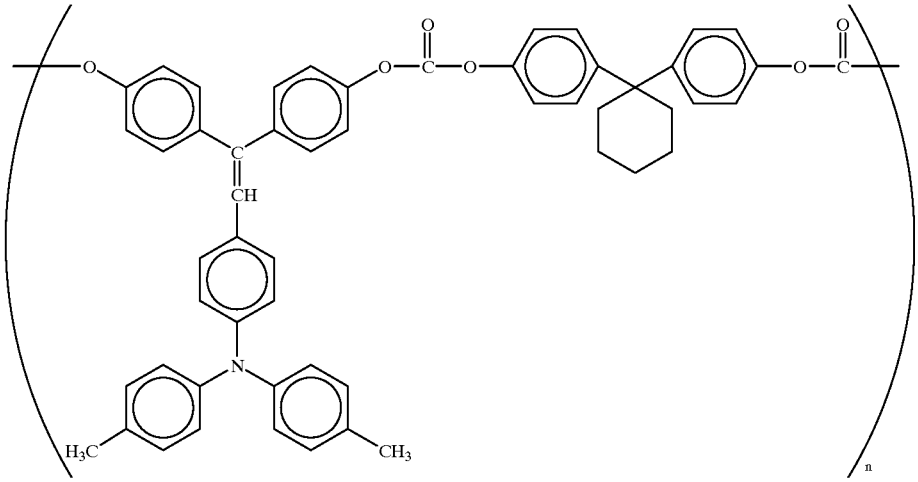

Methylene chloride 100

Thus photoreceptors of Example 17 was prepared.

Each of the thus prepared photoreceptors of Examples 14 to 17 and Comparative Examples 8 and 9 was evaluated by the evaluation method (2) mentioned above. In the running test 10,000 copies were continuously produced.

The results are shown in Table 19.

TABLE 19

| | Conc. of $K^+$ ions (ppm) | Initial image qualities | Image qualities after running test |
|---|---|---|---|
| Ex. 14 | 3 | Good | Good |
| Ex. 15 | 15 | Good | Good |
| Ex. 16 | 30 | Good | Good |
| Ex. 17 | 0 ($K^+$ ions were not detected) | Good | Background was slightly developed |
| Comp. Ex. 8 | 100 | Good | Low image density |
| Comp. Ex. 9 | 500 | Low image density | Low image density |

As can be understood from Table 19, when the concentration of $K^+$ ions is not greater than 50 ppm, the resultant photoreceptor produces good images. When $K^+$ ions are not included in the charge generation layer, the resultant pho- Thus, a photoreceptor of Example 18 was prepared.

Evaluation method (4)

Each of the photoreceptors of Examples 1 and 18 was set one by one in an electrophotographic image forming apparatus as shown in FIG. 4 to perform a running test in which 13,000 copies were continuously produced. At this point, a laser diode emitting a laser having a wavelength of 780 nm was used as a light source of imagewise light irradiating device 5. The image qualities of the initial copy images and the images after the running test were visually evaluated. In addition, the thickness of the charge transport layer was measured before and after the running test to determine the abrasion amount of each of the charge transport layers.

The results are shown in Table 20.

TABLE 20

| | Image qualities (initial) | Image qualities after running test | Abrasion amount of CTL ($\mu$m) |
|---|---|---|---|
| Ex. 1 | Good | A few black streaks (still acceptable) | 3.2 |
| Ex. 18 | Good | Good | 1.4 |

As can be understood from Table 15, the photoreceptor of Example 14 has good abrasion resistance.

Synthesis Example 7

The procedure for preparation of the wet cake of the titanyl phthalocyanine pigment in Synthesis Example 1 was repeated. The wet cake was further washed with deionized water until $Na^+$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 7 (hereinafter referred to as TiOPc 7) was prepared.

The TiOPc 7 was exposed to X-ray to obtain its X-ray diffraction spectrum. The conditions of the X-ray irradiation were the same as those mentioned in Synthesis Example 1.

The X-ray diffraction spectrum of the TiOPc 7 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 8

The TiOPc 7 was treated with 2-butanone, and then the solvent was dried to obtain a powder. Thus a TiOPc 8 was prepared. The X-ray diffraction spectrum of the TiOPc 8 was almost the same as that of the TiOPc 2 which is shown in FIG. 8 (i.e., main peaks were observed at least at Bragg (2 θ) angles of 7.50°±0.2°, 25.3°±0.2° and 28.6°±0.2°).

Synthesis Example 9

The TiOPc 7 was treated with tetrahydrofuran, and then the solvent was dried to obtain a powder. Thus a TiOPc 9 was prepared. The X-ray diffraction spectrum of the TiOPc 9 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 10

The wet cake of a titanyl phthalocyanine pigment which had been prepared in Synthesis Example 7 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 10 was prepared.

The X-ray diffraction spectrum of the TiOPc 10 was almost the same as that of the TiOPc 4 (i.e., main peaks were observed at least at Bragg (2 θ) angles of 9.0°±0.2°, 14.2°±0.2°, 23.9°±0.2° and 27.1°±0.2°.

Synthesis Example 11

The wet cake of a titanyl phthalocyanine pigment which had been prepared in Synthesis Example 7 was repeatedly treated with deionized water while measuring the concentration of $Na^+$ ions in the filtrate. When the content of $Na^+$ ions relative to the pigment was about 50 ppm, the washing treatment was stopped. The wet cake was further treated with 1,2-dichloroethane in the same method as performed in Synthesis Example 7. Thus a TiOPc 11 was prepared.

The X-ray diffraction spectrum was almost the same as that of the TiOPc 7 (i.e., main peaks were observed at least at Bragg (2 θ) angles of 9.6°±0.2°, 24.0°±0.2°, and 27.2°±0.2°). The content of $Na^+$ ions in the TiOPc 7 was 48 ppm.

Synthesis Example 12

The wet cake of a titanyl phthalocyanine pigment which had been prepared in Synthesis Example 7 was washed with deionized water while measuring $Na^+$ ions in the filtrate. When the content of $Na^+$ ions relative to the pigment was about 400 ppm, the washing treatment was stopped. The wet cake was further treated with 1,2-dichloroethane in the same method as performed in Synthesis Example 7. Thus a TiOPc 12 was prepared.

The X-ray diffraction spectrum was almost the same as that of the TiOPc 7 (i.e., main peaks were observed at least at Bragg (2 θ) angles of 9.6°±0.2°, 24.0°±0.2°, and 27.2°±0.2°) . The content of $Na^+$ ions in the TiOPc 12 was 387 ppm.

Example 19

Preparation of Undercoat Layer

The procedure for preparation of the undercoat layer in Example 1 was repeated to form an aluminum cylinder having an undercoat layer having 2.5 μm.

Preparation of Charge Generation Layer

The following components were mixed.

| | |
|---|---|
| TiOPc 7 prepared above | 3 |
| Polyvinyl butyral | 2 |
| Tetrahydrofuran | 50 |
| 4-methyl-2-pentanone | 90 |

Deionized water in which sodium sulfate was dissolved was added into the mixture such that the concentration of $Na^+$ ions relative to the TiOPc 7 was 3 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The procedure for preparation of the charge transport layer in Example 1 was repeated. Thus a charge transport layer having a thickness of 22 μm was formed on the charge generation layer.

Thus a photoreceptor of Example 19 was prepared.

Examples 20 to 22 and Comparative Examples 10 and 11

The procedure for preparation of the photoreceptor in Example 19 was repeated except that the concentration of $Na^+$ ions was changed as shown in Table 21.

Thus photoreceptors of Examples 20 to 22 and Comparative Examples 10 and 11 were prepared.

Each of the thus prepared photoreceptors of Examples 19 to 22 and Comparative Examples 10 and 11 was evaluated by the evaluation method (1). In the running test 8,000 copies were continuously produced.

The results are shown in Table 21.

TABLE 21

| | Conc. Of $Na^+$ ions | Surface Potential (Initial) (V) | | Surface Potential (after running test) (V) | |
|---|---|---|---|---|---|
| | (ppm) | Lighted area | Dark area | Lighted area | Dark area |
| Ex. 19 | 3 | −843 | −120 | −840 | −125 |
| Ex. 20 | 20 | −850 | −120 | −845 | −125 |
| Ex. 21 | 80 | −855 | −125 | −850 | −130 |
| Ex. 22 | 150 | −858 | −130 | −850 | −130 |

TABLE 21-continued

| | Conc. Of $Na^+$ ions | Surface Potential (Initial) (V) | | Surface Potential (after running test) (V) | |
|---|---|---|---|---|---|
| | (ppm) | Lighted area | Dark area | Lighted area | Dark area |
| Comp. Ex. 10 | 300 | −860 | −150 | −840 | −180 |
| Comp. Ex. 11 | 800 | −860 | −160 | −840 | −210 |

As can be understood from Table 21, when the concentration of $Na^+$ ions is not greater than 200 ppm, the resultant photoreceptor has good charge properties even after the running test.

Example 23 and Comparative Example 12

The procedure for preparation of the photoreceptor in Example 1 was repeated except that the TiOPc 1 was replaced with the TiOPc 11 or the TiOPc 12. Thus, photoreceptors of Example 23 and Comparative Example 12 were prepared. The photoreceptors were evaluated by the same method as performed in Example 19. The results are shown in Table 22.

TABLE 22

| | Conc. Of $Na^+$ ions | Surface Potential (Initial) (V) | | Surface Potential (after running test) (V) | |
|---|---|---|---|---|---|
| | (ppm) | Dark area | Lighted area | Dark area | Lighted area |
| Ex. 23 | 48 | −855 | −120 | −850 | −130 |
| Comp. Ex. 12 | 387 | −860 | −155 | −840 | −200 |

As can be understood from Table 22, the photoreceptor of Example 23 which includes the TiOPc including $Na^+$ ions in an amount of 48 ppm has good charging properties even after the running test. On the contrary, the photoreceptor of Comparative Example 12, which includes the TiOPc including $Na^+$ ions in an amount of 387 ppm, has poor charging properties (high residual potential) after the running test.

Example 24

The photoreceptor of Example 19 was evaluated in the same method as performed in Example 1 except that the charging device was changed from a scorotron charger to a charging roller which contacted the photoreceptor and to which a DC bias voltage of −850 V was applied.

The image qualities of the initial images were good. The image qualities of the images after the running test were almost good, however, the images had slight undesired background fouling which was caused by toner filming on the charging roller. The odor of ozone during the running test was much less than that during the running test using the scorotron charger.

Example 25

The photoreceptor of Example 19 was evaluated in the same method as performed in Example 24 except that a tape having a thickness of 50 $\mu$m and a width of 5 mm was adhered to both ends of the charging roller to form a gap of 50 $\mu$m between the charging roller and the photoreceptor.

The filming problem occurred in Example 24 did not occur. However, when a half tone image was produced after the running test, the half tone image was slightly uneven, which was caused by uneven charging.

Example 26

The photoreceptor of Example 19 was evaluated in the same method as performed in Example 25 except that the charging conditions were changed as follows:

DC bias voltage: −850 V

AC bias voltage: 1.8 kV (peak to peak value) in voltage 1.7 kHz in frequency

The filming problem occurred in Example 24 did not occur, and in addition the uneven half tone image was not observed. In addition, when a half tone image was produced after the running test, the half tone image had good evenness.

Example 27

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Butanol | 20 |

The thus prepared undercoat layer coating liquid was coated on the surface of a nickel belt prepared by an electroforming method and then dried to form an undercoat layer of 2 $\mu$m thick thereon.

Preparation of Charge Generation Layer

The following components were mixed.

| | |
|---|---|
| TiOPc 8 prepared above | 4 |
| Polyvinyl butyral | 2 |
| Cyclohexanone | 50 |
| Tetrahydrofuran | 100 |

Deionized water in which sodium sulfate was dissolved was added into the mixture such that the concentration of $Na^+$ ions relative to the TiOPc 8 was 2 ppm. Thus, a charge generation layer coating liquid was prepared.

The thus prepared charge generation layer coating liquid was coated on the undercoat layer and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

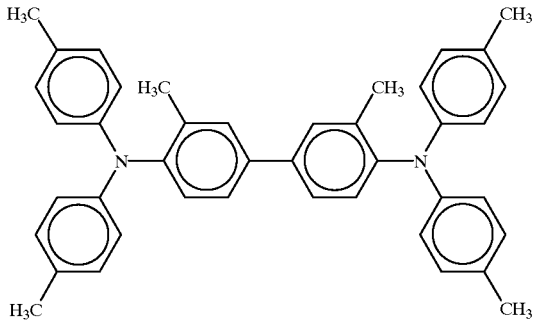

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 27 was prepared.

Examples 28 to 30 and Comparative Examples 13 and 14

The procedure for preparation of the photoreceptor in Example 27 was repeated except that the concentration of $Na^+$ ions was changed as shown in Table 23.

Thus photoreceptors of Examples 28 to 30 and Comparative Examples 13 and 14 were prepared.

Each of the thus prepared photoreceptors of Examples 27 to 30 and Comparative Examples 13 and 14 was evaluated by the evaluation method (2) mentioned above. In the running test 8,000 copies were continuously produced.

The results are shown in Table 23.

TABLE 23

| | Conc. of $Na^+$ ions (ppm) | Initial image qualities | Image qualities after running test |
|---|---|---|---|
| Ex. 27 | 2 | Good | Good |
| Ex. 28 | 15 | Good | Good |
| Ex. 29 | 60 | Good | Good |
| Ex. 30 | 180 | Good | Good |
| Comp. Ex. 13 | 250 | Good | Low image density |
| Comp. Ex. 14 | 600 | Slightly low image density | Low image density |

As can be understood from Table 23, when the concentration of $Na^+$ ions is not greater than 200 ppm, the resultant photoreceptor produces good images.

Example 31

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 9 prepared above | 3 |
| Polyvinyl butyral | 1 |
| Cyclohexanone | 250 |
| Cyclohexane | 50 |

Deionized water in which sodium sulfate was dissolved was added into the mixture such that the concentration of $Na^+$ ions relative to the TiOPc 9 was 0.5 ppm. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

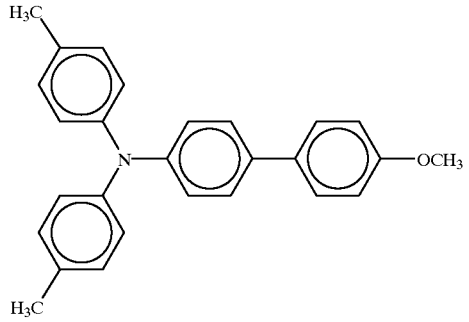

| | |
|---|---|
| Methylene chloride | 80 |

The thus prepared charge transport layer coating liquid was coated on the charge generation layer and then dried to form a charge transport layer having a thickness thereof was 23 $\mu$m.

Thus a photoreceptor of Example 31 was prepared.

Examples 32 to 34 and Comparative Examples 15 and 16

The procedure for preparation of the photoreceptor in Example 31 was repeated except that the concentration of $Na^+$ ions was changed as shown in Table 24.

Thus photoreceptors of Examples 32 to 34 and Comparative Examples 15 and 16 were prepared.

Each of the thus prepared photoreceptors of Examples 31 to 34 and Comparative Examples 15 and 16 was evaluated by the evaluation method (3) mentioned above. In the running test 6,000 copies were continuously produced.

The results are shown in Table 24.

TABLE 24

| | Conc. of $Na^+$ ions | Surface Potential (Initial) (V) | | Surface Potential (after running test) (V) | |
|---|---|---|---|---|---|
| | (ppm) | Dark area | Lighted area | Dark area | Lighted area |
| Ex. 31 | 0.5 | −860 | −130 | −850 | −130 |
| Ex. 32 | 13 | −865 | −130 | −850 | −135 |
| Ex. 33 | 40 | −870 | −135 | −860 | −135 |
| Ex. 34 | 160 | −870 | −135 | −860 | −140 |
| Comp. Ex. 15 | 320 | −870 | −160 | −860 | −190 |
| Comp. Ex. 16 | 700 | −875 | −180 | −860 | −215 |

As can be understood from Table 24, when the concentration of $Na^+$ ions is not greater than 200 ppm, the resultant photoreceptor has good charge properties even after the running test.

Example 35

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 $\mu$m thick thereon.

Preparation of Charge Generation Layer

The following components were mixed.

| | |
|---|---|
| TiOPc 10 prepared above | 4 |
| Polyvinyl butyral | 2 |
| Cyclohexanone | 50 |
| Tetrahydrofuran | 100 |

Ionized water in which sodium sulfate was dissolved was added into the mixture such that the concentration of $Na^+$ ions relative to the TiOPc 10 was 3 ppm. Thus, a charge generation layer coating liquid was prepared.

The thus prepared charge generation layer coating liquid was coated on the undercoat layer and then dried to form a charge generation layer having a thickness of 0.3 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

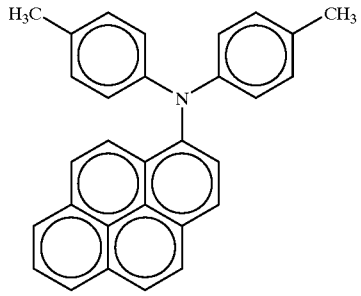

| | |
|---|---|
| Tetrahydrofuran | 80 |

The thus prepared charge transport layer coating liquid was coated on the charge generation layer and then dried to form a charge transport layer having a thickness thereof was 22 $\mu$m.

Thus a photoreceptor of Example 35 was prepared.

Examples 36 to 38 and Comparative Examples 17 and 18

The procedure for preparation of the photoreceptor in Example 35 was repeated except that the concentration of $Na^+$ ions was changed as shown in Table 25.

Thus photoreceptors of Examples 36 to 38 and Comparative Examples 17 and 18 were prepared.

Example 39

The procedure for preparation of the photoreceptor in Example 35 was repeated except that the deionized water was not added to the charge generation layer coating liquid.

Each of the thus prepared photoreceptors of Examples 35 to 39 and Comparative Examples 17 and 18 was evaluated by the evaluation method (2). In the running test 8,000 copies were continuously produced.

The results are shown in Table 25.

TABLE 25

| | Conc. of $Na^+$ ions (ppm) | Initial image qualities | Image qualities after running test |
|---|---|---|---|
| Ex. 35 | 3 | Good | Good |
| Ex. 36 | 18 | Good | Good |
| Ex. 37 | 35 | Good | Good |
| Ex. 38 | 100 | Good | Good |
| Ex. 39 | 0 ($Na^+$ ion was not detected) | Good | Background was slightly developed |
| Comp. Ex. 17 | 250 | Good | Low image density |
| Comp. Ex. 18 | 500 | Slightly low image density | Low image density |

As can be understood from Table 25, when the concentration of $Na^+$ ions is not greater than 200 ppm, the resultant photoreceptor produces good images. When $Na^+$ ions are not included in the charge generation layer, the resultant photoreceptor produces images whose background area is slightly soiled after the running test.

Example 40

The procedure for preparation of the photoreceptor in Example 19 was repeated except that the formulation of the charge transport layer coating liquid was changed as follows.

Charge transport polymer material having the following formula 10

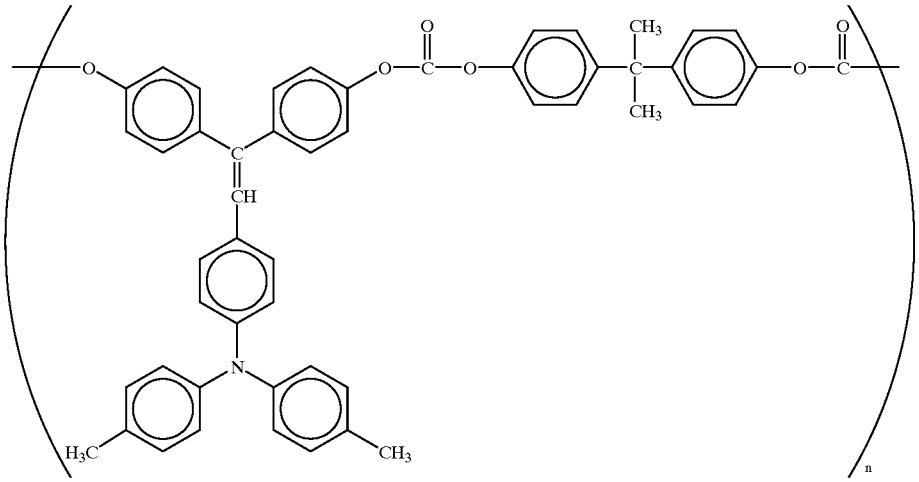

Methylene chloride 100

Thus a photoreceptor of Example 40 was prepared.

Each of the photoreceptors of Examples 19 and 40 was evaluated by the evaluation method (4) mentioned above. In the running test 12,000 copies were continuously produced.

The results are shown in Table 26.

TABLE 26

| | Image qualities (initial) | Image qualities after running test | Abrasion amount of CTL (μm) |
|---|---|---|---|
| Ex. 19 | Good | A few black streaks (still acceptable) | 3.0 |
| Ex. 40 | Good | Good | 1.5 |

As can be understood from Table 26, the photoreceptor of Example 40 has good abrasion resistance.

Synthesis Example 13

The procedure for preparation of the wet cake of the titanyl phthalocyanine pigment in Synthesis Example 1 was repeated. The wet cake was further washed with de-ionized water until $NO_3^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 13 (hereinafter referred to as TiOPc 13) was prepared.

The TiOPc 13 was exposed to X-ray to obtain its X-ray diffraction spectrum. The conditions of the X-ray irradiation were the same as those mentioned in Synthesis Example 1.

The X-ray diffraction spectrum of the TiOPc 13 was almost the same as that of the TiOPc 1 which is shown in FIG. 7 (i.e., main peaks were observed at least at Bragg (2 θ) angles of 9.6°±0.2°, 24.0°±0.2° and 27.2±0.2°).

Synthesis Example 14

The TiOPc 13 was treated with 2-butanone, and then the solvent was dried to obtain a powder. Thus a TiOPc 14 was prepared. The X-ray diffraction spectrum of the TiOPc 10 was almost the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 15

The TiOPc 13 was treated with tetrahydrofuran, and then the solvent was dried to obtain a powder. Thus a TiOPc 15 was prepared. The X-ray diffraction spectrum of the TiOPc 15 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 16

The wet cake of a titanyl phthalocyanine pigment which had been prepared in Synthesis Example 13 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 16 was prepared.

The X-ray diffraction spectrum of the TiOPc 16 was almost the same as that of the TiOPc 4, and main peaks were observed at least at Bragg (2 θ) angles of 9.0°±0.2°, 14.2°±0.2°, 23.9°±0.2° and 27.1°±0.2°.

Synthesis Example 17

The wet cake of a titanyl phthalocyanine pigment which had been prepared in Synthesis Example 13 was repeatedly treated with deionized water while measuring the concentration of $NO_3^-$ ions in the filtrate. When the content of $NO_3^-$ ions relative to the pigment was about 20 ppm, the washing treatment was stopped. The wet cake was further treated with 1,2-dichloroethane in the same method as performed in Synthesis Example 13. Thus a TiOPc 17 was prepared.

The X-ray diffraction spectrum was almost the same as that of the TiOPc 13 (i.e., main peaks were observed at least at Bragg (2 θ) angles of 9.60°±0.2°, 24.0°±0.2°, and 27.2°±0.2°). The content of $NO_3^-$ ions in the TiOPc 17 was 21 ppm.

Synthesis Example 18

The wet cake of a titanyl phthalocyanine pigment which had been prepared in Synthesis Example 17 was washed with deionized water while measuring $NO_3^-$ ions in the filtrate. When the content of $NO_3^-$ ions relative to the pigment was about 120 ppm, the washing treatment was stopped. The wet cake was further treated with 1,2-dichloroethane in the same method as performed in Synthesis Example 13. Thus a TiOPc 18 was prepared.

The X-ray diffraction spectrum was almost the same as that of the TiOPc 13 (i.e., main peaks were observed at least at Bragg (2 θ) angles of 9.6°±0.2°, 24.0°±0.2°, and 27.2°±0.2°). The content of $NO_3^-$ ions in the TiOPc 18 was 123 ppm.

Example 41

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 3 μm thick thereon.

Preparation of Charge Generation Layer

The following components were mixed.

| | |
|---|---|
| TiOPc 13 prepared above | 3 |
| Polyvinyl butyral | 2 |
| Tetrahydrofuran | 50 |
| 4-methyl-2-pentanone | 90 |

Ionized water in which ammonium nitrate was dissolved was added into the mixture such that the concentration of $NO_3^-$ ions relative to the TiOPc 13 was 5 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

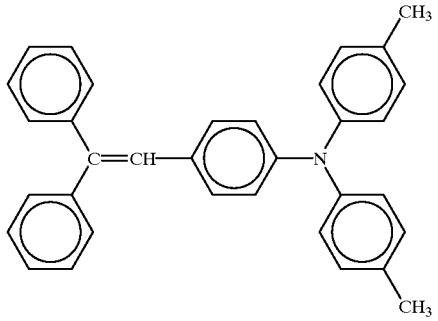

| | |
|---|---|
| Methylene chloride | 80 |

The thus prepared charge transport layer coating liquid was coated on the charge generation layer and then dried to form a charge transport layer having a thickness thereof was 21 μm.

Thus a photoreceptor of Example 41 was prepared.

Examples 42 and 43 and Comparative Examples 19 and 20

The procedure for preparation of the photoreceptor in Example 41 was repeated except that the concentration of $NO_3^-$ ions was changed as shown in Table 27.

Thus photoreceptors of Examples 42 and 43 and Comparative Examples 19 and 20 were prepared.

Each of the thus prepared photoreceptors of Examples 41 to 43 and Comparative Examples 19 and 20 was evaluated by the evaluation method (1) mentioned above. In the running test 15,000 copies were continuously produced.

The results are shown in Table 27.

TABLE 27

| | Conc. of $NO_3^-$ ion | Surface Potential (Initial) (V) | | Surface Potential (after running test) (V) | |
|---|---|---|---|---|---|
| | (ppm) | Dark area | Lighted area | Dark area | Lighted area |
| Ex. 41 | 5 | −855 | −130 | −840 | −120 |
| Ex. 42 | 15 | −850 | −135 | −840 | −125 |
| Ex. 43 | 30 | −850 | −135 | −840 | −125 |
| Comp. Ex. 19 | 90 | −830 | −120 | −770 | −115 |
| Comp. Ex. 20 | 250 | −800 | −120 | −620 | −120 |

As can be understood from Table 27, when the concentration of $NO_3^-$ ion is not greater than 50 ppm, the resultant photoreceptor has good charge properties even after the running test.

Example 44 and Comparative Example 21

The procedure for preparation of the photoreceptor in Example 41 was repeated except that the TiOPc 13 was replaced with the TiOPc 17 or the TiOPc 18. Thus, photoreceptors of Example 44 and Comparative Example 21 were prepared. The photoreceptors were evaluated by the same method as performed in Example 19. The results are shown in Table 28.

TABLE 28

| | Conc. of $NO_3^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 44 | 21 | −850 | −135 | −840 | −125 |
| Comp. Ex. 21 | 123 | −820 | −120 | −740 | −115 |

As can be understood from Table 28, the photoreceptor of Example 44 which includes the TiOPc including $NO_3^-$ ions in an amount of 21 ppm has good charging properties even after the running test. On the contrary, the photoreceptor of Comparative Example 21, which includes the TiOPc including $NO_3^-$ ions in an amount of 123 ppm, has a low surface potential after the running test.

Example 45

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Butanol | 20 |

The thus prepared undercoat layer coating liquid was coated on the surface of a nickel belt prepared by an electroforming method and then dried to form an undercoat layer of 1 μm thick thereon. Preparation of charge generation layer The following components were mixed.

| | |
|---|---|
| TiOPc 14 prepared above | 4 |
| Polyvinyl butyral | 2 |
| Cyclohexanone | 50 |
| Tetrahydrofuran | 100 |

Deionized water in which ammonium nitrate was dissolved was added into the mixture such that the concentration of $NO_3^-$ ions relative to the TiOPc 14 was 8 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

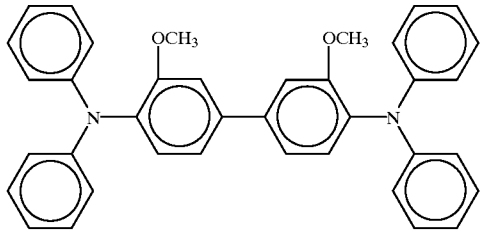

| | |
|---|---|
| Tetrahydrofuran | 80 |

The thus prepared charge transport layer coating liquid was coated on the charge generation layer and then dried to form a charge transport layer having a thickness thereof was 24 μm.

Thus a photoreceptor of Example 45 was prepared.

Examples 46 and 47 and Comparative Examples 22 and 23

The procedure for preparation of the photoreceptor in Example 45 was repeated except that the concentration of $NO_3^-$ ions was changed as shown in Table 29.

Thus photoreceptors of Examples 46 and 47 and Comparative Examples 22 and 23 were prepared.

Each of the thus prepared photoreceptors of Examples 45 to 47 and Comparative Examples 22 and 23 was evaluated by the evaluation method (2) mentioned above. In the running test 8,000 copies were continuously produced.

The results are shown in Table 29.

TABLE 29

| | Conc. of $NO_3^-$ ions (ppm) | Initial image qualities | Image qualities after running test |
|---|---|---|---|
| Ex. 45 | 8 | Good | Good |
| Ex. 46 | 20 | Good | Good |
| Ex. 47 | 40 | Good | Good |
| Comp. Ex. 22 | 100 | Good | Background soiling |
| Comp. Ex. 23 | 300 | Background soiling | Background soiling |

As can be understood from Table 29, when the concentration of $NO_3^-$ ion is not greater than 50 ppm, the resultant photoreceptor produces good images even when used for a long period of time.

Example 48

The photoreceptor of Example 45 was evaluated in the same method as performed in Example 45 except that the charging device was changed from a scorotron charger to a charging roller which contacted the photoreceptor and to which a DC bias voltage of −870 V was applied.

The image qualities of the initial images were good. The image qualities of the images after the running test of producing 8,000 images were almost good, however, the images had slight background fouling which was caused by toner filming on the charging roller. The odor of ozone during the running test was much less than that during the running test using the scorotron charger.

Example 49

The photoreceptor of Example 45 was evaluated in the same method as performed in Example 48 except that a tape having a thickness of 50 μm and a width of 5 mm was adhered to both ends of the charging roller to form a gap of 50 μm between the charging roller and the photoreceptor.

The filming problem occurred in Example 48 did not occur. However, when a half tone image was produced after the running test, the half tone image was slightly uneven, which was caused by uneven charging.

Example 50

The photoreceptor of Example 45 was evaluated in the same method as performed in Example 49 except that the charging conditions were changed as follows:

DC bias voltage: −870 V

AC bias voltage: 2.0 kV (peak to peak value) in voltage 2.0 kHz in frequency

The filming problem occurred in Example 48 did not occur, and in addition the uneven half tone image was not observed. In addition, when a half tone image was produced after the running test of producing 8,000 images, the half tone image had good evenness.

Example 51

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 15 prepared above | 3 |
| Polyvinyl butyral | 1 |
| Cyclohexanone | 250 |
| Cyclohexane | 50 |

Deionized water in which ammonium nitrate was dissolved was added into the mixture such that the concentration of $NO_3^-$ ions relative to the TiOPc 15 was 0.5 ppm. Thus, a charge generation layer coating liquid was prepared.

The thus prepared charge generation layer coating liquid was coated on the anodic oxidation coating and then dried to form a charge generation layer having a thickness of 0.2 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

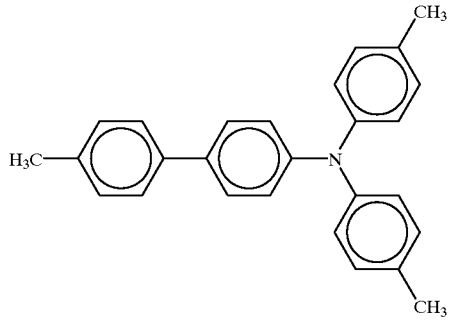

| | |
|---|---|
| Methylene chloride | 80 |

The thus prepared charge transport layer coating liquid was coated on the charge generation layer and then dried to form a charge transport layer having a thickness thereof was 21 μm.

Thus a photoreceptor of Example 51 was prepared.

Examples 52 and 53 and Comparative Examples 24 and 25

The procedure for preparation of the photoreceptor in Example 51 was repeated except that the concentration of $NO_3^-$ ions was changed as shown in Table 30.

Thus photoreceptors of Examples 52 and 53 and Comparative Examples 24 and 25 were prepared.

Each of the thus prepared photoreceptors of Examples 51 to 53 and Comparative Examples 24 and 25 was evaluated by the evaluation method (3) mentioned above. In the running test 7,000 copies were continuously produced.

The results are shown in Table 30.

TABLE 30

| | Conc. of $NO_3^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 51 | 0.5 | −870 | −115 | −860 | −105 |
| Ex. 52 | 10 | −865 | −115 | −850 | −105 |
| Ex. 53 | 25 | −860 | −115 | −850 | −100 |
| Comp. Ex. 24 | 100 | −850 | −115 | −740 | −100 |
| Comp. Ex. 25 | 700 | −805 | −110 | −590 | −95 |

As can be understood from Table 30, when the concentration of $NO_3^-$ ions is not greater than 50 ppm, the resultant photoreceptor has good charge properties even after the running test.

Example 54

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 3 $\mu$m thick thereon.

Preparation of Charge Generation Layer

The following components were mixed.

| | |
|---|---|
| TiOPc 16 prepared above | 4 |
| Polyvinyl butyral | 2 |
| Cyclohexanone | 50 |
| Tetrahydrofuran | 100 |

Deionized water in which ammonium nitrate was dissolved was added into the mixture such that the concentration of $NO_3^-$ ion relative to the TiOPc 16 was 2 ppm. Thus, a charge generation layer coating liquid was prepared.

The thus prepared charge generation layer coating liquid was coated on the undercoat layer and then dried to form a charge generation layer having a thickness of 0.3 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

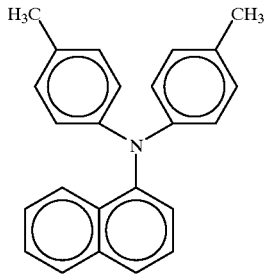

| | |
|---|---|
| Tetrahydrofuran | 80 |

The thus prepared charge transport layer coating liquid was coated on the charge generation layer and then dried to form a charge transport layer having a thickness thereof was 22 $\mu$m.

Thus a photoreceptor of Example 54 was prepared.

Examples 55 and 56 and Comparative Examples 26 and 27

The procedure for preparation of the photoreceptor in Example 54 was repeated except that the concentration of $NO_3^-$ ions was changed as shown in Table 31.

Thus photoreceptors of Examples 55 and 56 and Comparative Examples 26 and 27 were prepared.

Example 57

The procedure for preparation of the photoreceptor in Example 54 was repeated except that the deionized water including ammonium nitrate was not added to the charge generation layer coating liquid.

Each of the thus prepared photoreceptors of Examples 54 to 57 and Comparative Examples 26 and 27 was evaluated by the evaluation method (2) mentioned above. In the running test in which 8,000 copies were continuously produced.

The results are shown in Table 31.

TABLE 31

| | Conc. of $NO_3^-$ ions (ppm) | Initial image qualities | Image qualities after running test |
|---|---|---|---|
| Ex. 54 | 2 | Good | Good |
| Ex. 55 | 18 | Good | Good |
| Ex. 56 | 30 | Good | Good |
| Ex. 57 | 0 ($NO_3^-$ ion was not detected) | Good | Slightly low image density |
| Comp. Ex. 26 | 90 | Background was slightly developed | Background was developed |
| Comp. Ex. 27 | 200 | Background was developed | Background was developed |

As can be understood from Table 31, when the concentration of $NO_3^-$ ions is not greater than 50 ppm, the resultant photoreceptor produces good images even after the running test. When $NO_3^-$ ion is not included in the charge generation layer, the resultant photoreceptor produces images whose background area is slightly developed after the running test.

Example 58

The procedure for preparation of the photoreceptor in Example 41 was repeated except that the formulation of the charge transport layer coating liquid was changed as follows.

Charge transport polymer material having the following formula 10

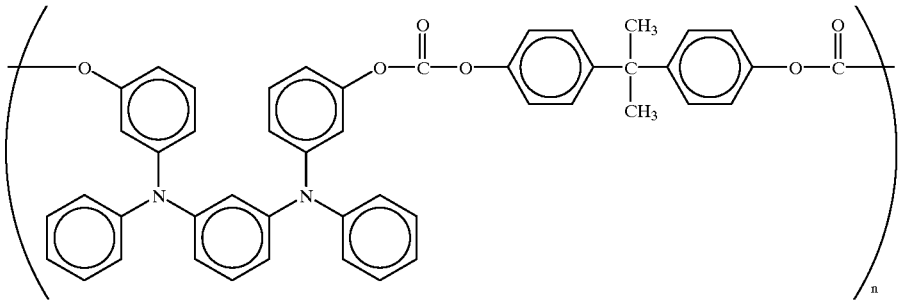

Methylene chloride 100

Thus, a photoreceptor of Example 58 was prepared.

Each of the photoreceptors of Examples 41 and 58 was evaluated by the evaluation method (4) mentioned above. In the running test 20,000 copies were continuously produced.

The results are shown in Table 32.

TABLE 32

| | Image qualities (initial) | Image qualities after running test | Abrasion amount of CTL (μm) |
|---|---|---|---|
| Ex. 41 | Good | A few black streaks (still acceptable) | 4.3 |
| Ex. 58 | Good | Good | 1.9 |

As can be understood from Table 32, the photoreceptor of Example 58 has good abrasion resistance.

Synthesis Example 19

The procedure for preparation of the wet cake of the titanyl phthalocyanine pigment in Synthesis Example 1 was repeated. The wet cake was further washed with de-ionized water until $HCOO^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 19 (hereinafter referred to as TiOPc 19) was prepared.

The TiOPc 19 was exposed to X-ray to obtain its X-ray diffraction spectrum. The conditions of the X-ray irradiation were the same as those mentioned in Synthesis Example 1.

The X-ray diffraction spectrum of the TiOPc 19 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 20

The TiOPc 19 was treated with 2-butanone, and then the solvent was dried to obtain a powder. Thus a TiOPc 20 was prepared. The X-ray diffraction spectrum of the TiOPc 20 was almost the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 21

The TiOPc 19 was treated with tetrahydrofuran, and then the solvent was dried to obtain a powder. Thus a TiOPc 21 was prepared. The X-ray diffraction spectrum of the TiOPc 21 was the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 22

The wet cake of a titanyl phthalocyanine pigment which had been prepared in Synthesis Example 19 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 22 was prepared.

The X-ray diffraction spectrum of the TiOPc 12 was almost the same as that of the TiOPc 4 (i.e., main peaks was observed at least at Bragg (2 θ) angles of 9.0°±0.2°, 14.2°±0.2°, 23.9°±0.2° and 27.1°±0.2°).

Synthesis Example 23

The wet cake of a titanyl phthalocyanine pigment which had been prepared in Synthesis Example 19 was repeatedly treated with deionized water while measuring the concentration of $HCOO^-$ ions in the filtrate. When the content of $HCOO^-$ ions relative to the pigment was about 50 ppm, the washing treatment was stopped. The wet cake was further treated with 1,2-dichloroethane in the same method as performed in Synthesis Example 19. Thus a TiOPc 23 was prepared.

The X-ray diffraction spectrum was almost the same as that of the TiOPc 19 (i.e., main peaks were observed at least at Bragg (2 θ) angles of 9.6°±0.2°, 24.0°±0.2°, and 27.2°±0.2°). The content of $HCOO^-$ ions in the TiOPc 23 was 53 ppm.

Synthesis Example 24

The wet cake of a titanyl phthalocyanine pigment which had been prepared in Synthesis Example 19 was washed with deionized water while measuring $HCOO^-$ ions in the filtrate. When the content of $HCOO^-$ ions relative to the pigment was about 300 ppm, the washing treatment was stopped. The wet cake was further treated with 1,2-dichloroethane in the same method as performed in Synthesis Example 19. Thus a TiOPc 24 was prepared.

The X-ray diffraction spectrum was almost the same as that of the TiOPc 19 (i.e., main peaks were observed at least at Bragg (2 θ) angles of 9.6°±0.2°, 24.0°±0.2°, and 27.2°±0.2°) . The content of $HCOO^-$ ions in the TiOPc 24 was 315 ppm.

Example 59

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of Charge Generation Layer

The following components were mixed.

| | |
|---|---|
| TiOPc 19 prepared above | 3 |
| Polyvinyl butyral | 2 |
| Tetrahydrofuran | 50 |
| 4-methyl-2-pentanone | 90 |

Deionized water in which ammonium formate was dissolved was added into the mixture such that the concentration of $HCOO^-$ ions relative to the TiOPc 19 was 1 ppm. Thus, a charge generation layer coating liquid was prepared.

The thus prepared charge generation layer coating liquid was coated on the undercoat layer and then dried to form a charge generation layer having a thickness of 0.2 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

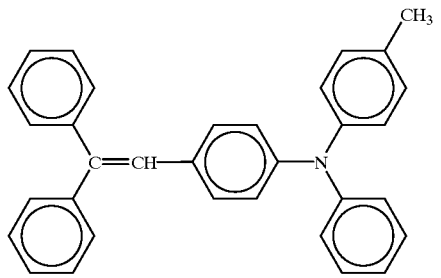

| | |
|---|---|
| Methylene chloride | 80 |

The thus prepared charge transport layer coating liquid was coated on the charge generation layer and then dried to form a charge transport layer having a thickness thereof was 20 μm.

Thus a photoreceptor of Example 59 was prepared.

Examples 60 to 62 and Comparative Examples 28 and 29

The procedure for preparation of the photoreceptor in Example 59 was repeated except that the concentration of $HCOO^-$ ions was changed as shown in Table 33.

Thus photoreceptors of Examples 60 and 62 and Comparative Examples 28 and 29 were prepared.

Each of the thus prepared photoreceptors of Examples 59 to 62 and Comparative Examples 28 and 29 was evaluated by the evaluation method (1) mentioned above. In the running test 10,000 copies were continuously produced.

The results are shown in Table 33.

TABLE 33

| | Conc. of $HCOO^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 59 | 1 | −860 | −130 | −850 | −120 |
| Ex. 60 | 10 | −860 | −130 | −850 | −120 |
| Ex. 61 | 30 | −855 | −130 | −850 | −120 |
| Ex. 62 | 70 | −855 | −125 | −850 | −120 |
| Comp. Ex. 28 | 200 | −840 | −120 | −740 | −110 |
| Comp. Ex. 29 | 500 | −780 | −120 | −630 | −100 |

As can be understood from Table 33, when the concentration of $HCOO^-$ ions is not greater than 100 ppm, the resultant photoreceptor has good charge properties even after the running test.

Example 63 and Comparative Example 30

The procedure for preparation of the photoreceptor in Example 59 was repeated except that the TiOPc 19 was replaced with the TiOPc 23 or the TiOPc 24. Thus, photoreceptors of Example 63 and Comparative Example 30 were prepared. The photoreceptors were evaluated by the same method as performed in Example 59. The results are shown in Table 34.

TABLE 34

| | Conc. Of $HCOO^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 63 | 53 | −855 | −130 | −850 | −120 |
| Comp. Ex. 30 | 315 | −800 | −120 | −690 | −105 |

As can be understood from Table 34, the photoreceptor of Example 63 which includes the TiOPc including $HCOO^-$ ions in an amount of 53 ppm has good charging properties even after the running test. On the contrary, the photoreceptor of Comparative Example 30, which includes the TiOPc including $HCOO^-$ ions in an amount of 315 ppm, has a low surface potential after the running test.

Example 64

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Butanol | 20 |

The thus prepared undercoat layer coating liquid was coated on the surface of a nickel belt prepared by an electroforming method and then dried to form an undercoat layer of 1.5 μm thick thereon.

Preparation of Charge Generation Layer

The following components were mixed.

| | |
|---|---|
| TiOPc 20 prepared above | 4 |
| Polyvinyl butyral | 2 |
| Cyclohexanone | 50 |
| Tetrahydrofuran | 100 |

Deionized water in which ammonium formate was dissolved was added into the mixture such that the concentration of $HCOO^-$ ions relative to the TiOPc 20 was 0.5 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

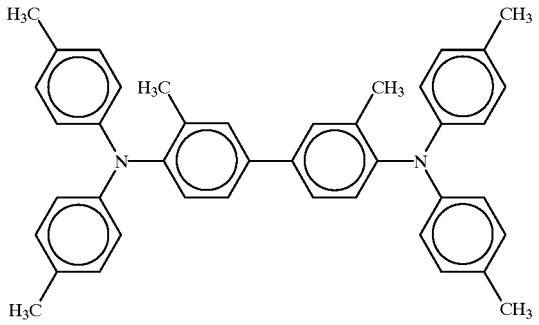

| | |
|---|---|
| Tetrahydrofuran | 80 |

The thus prepared charge transport layer coating liquid was coated on the charge generation layer and then dried to form a charge transport layer having a thickness thereof was 23 μm.

Thus a photoreceptor of Example 64 was prepared.

Examples 65 to 67 and Comparative Examples 31 and 32

The procedure for preparation of the photoreceptor in Example 64 was repeated except that the concentration of $HCOO^-$ ion was changed as shown in Table 35.

Thus photoreceptors of Examples 65 to 67 and Comparative Examples 31 and 32 were prepared.

Each of the thus prepared photoreceptors of Examples 64 to 67 and Comparative Examples 31 and 32 was evaluated by the evaluation method (2) mentioned above. In the running test 7,000 copies were continuously produced.

The results are shown in Table 35.

TABLE 35

| | Conc. of $HCOO^-$ ions (ppm) | Initial image qualities | Image qualities after running test |
|---|---|---|---|
| Ex. 64 | 0.5 | Good | Good |
| Ex. 65 | 10 | Good | Good |
| Ex. 66 | 40 | Good | Good |
| Ex. 67 | 80 | Good | Good |
| Comp. Ex. 31 | 150 | Good | Background was developed |
| Comp. Ex. 32 | 400 | Background was developed | Background was developed |

As can be understood from Table 35, when the concentration of $HCOO^-$ ions is not greater than 100 ppm, the resultant photoreceptor produces good images even when used for a long period of time.

Example 68

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 21 prepared above | 3 |
| Polyvinyl butyral | 1 |
| Cyclohexanone | 250 |
| Cyclohexane | 50 |

Deionized water in which ammonium formate was dissolved was added into the mixture such that the concentration of $HCOO^-$ ions relative to the TiOPc 21 was 3 ppm. Thus, a charge generation layer coating liquid was prepared.

The thus prepared charge generation layer coating liquid was coated on the anodic oxidation coating and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

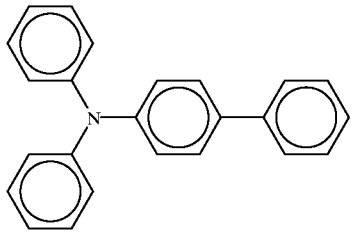

| | |
|---|---|
| Methylene chloride | 80 |

The thus prepared charge transport layer coating liquid was coated on the charge generation layer and then dried to form a charge transport layer having a thickness thereof was 25 μm.

Thus a photoreceptor of Example 68 was prepared.

Examples 69 to 71 and Comparative Examples 33 and 34

The procedure for preparation of the photoreceptor in Example 68 was repeated except that the concentration of $NO_3^-$ ion was changed as shown in Table 36.

Thus photoreceptors of Examples 69 to 71 and Comparative Examples 33 and 34 were prepared.

Each of the thus prepared photoreceptors of Examples 68 to 71 and Comparative Examples 33 and 34 was evaluated by the evaluation method (3) mentioned above. In the running test 5,000 copies were continuously produced.

The results are shown in Table 36.

TABLE 36

| | Conc. of $HCOO^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 68 | 3 | −870 | −140 | −860 | −130 |
| Ex. 69 | 20 | −865 | −140 | −860 | −130 |
| Ex. 70 | 50 | −865 | −135 | −850 | −130 |
| Ex. 71 | 80 | −860 | −130 | −850 | −125 |
| Comp. Ex. 33 | 150 | −850 | −125 | −720 | −120 |
| Comp. Ex. 34 | 600 | −800 | −120 | −660 | −115 |

As can be understood from Table 36, when the concentration of $HCOO^-$ ions is not greater than 100 ppm, the resultant photoreceptor has good charge properties even after the running test.

Example 72

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Butanol | 20 |

The thus prepared undercoat layer coating liquid was coated on the surface of a nickel belt prepared by an electroforming method and then dried to form an undercoat layer of 1 μm thick thereon.

Preparation of Charge Generation Layer

The following components were mixed.

| | |
|---|---|
| TiOPc 22 prepared above | 4 |
| Polyvinyl butyral | 2 |
| Cyclohexanone | 50 |
| Tetrahydrofuran | 100 |

Deionized water in which ammonium formate was dissolved was added into the mixture such that the concentration of $HCOO^-$ ion relative to the TiOPc 22 was 5 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

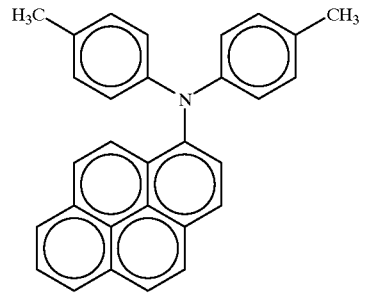

| | |
|---|---|
| Tetrahydrofuran | 80 |

The thus prepared charge transport layer coating liquid was coated on the charge generation layer and then dried to form a charge transport layer having a thickness thereof was 22 μm.

Thus a photoreceptor of Example 72 was prepared.

Examples 73 and 75 and Comparative Examples 35 and 36

The procedure for preparation of the photoreceptor in Example 72 was repeated except that the concentration of $HCOO^-$ ion was changed as shown in Table 37.

Thus photoreceptors of Examples 73 and 75 and Comparative Examples 35 and 36 were prepared.

Example 76

The procedure for preparation of the photoreceptor in Example 72 was repeated except that the deionized water including ammonium formate was not added to the charge generation layer coating liquid.

Each of the thus prepared photoreceptors of Examples 72 to 76 and Comparative Examples 35 and 36 was evaluated by the evaluation method (2) mentioned above. In the running test 8,000 copies were continuously produced.

The results are shown in Table 37.

TABLE 37

| | Conc. of $HCOO^-$ ions (ppm) | Initial image qualities | Image qualities after running test |
|---|---|---|---|
| Ex. 72 | 5 | Good | Good |
| Ex. 73 | 15 | Good | Good |
| Ex. 74 | 30 | Good | Good |
| Ex. 75 | 70 | Good | Good |
| Ex. 76 | 0 ($HCOO^-$ ions were not detected) | Good | Slightly low image density |
| Comp. Ex. 35 | 200 | Background was slightly developed | Background was developed |
| Comp. Ex. 36 | 400 | Background was slightly developed | Background was developed |

As can be understood from Table 37, when the concentration of $HCOO^-$ ion is not greater than 100 ppm, the resultant photoreceptor produces good images even after the running test. When $HCOO^-$ ions are not included in the charge generation layer, the resultant photoreceptor produces images whose background area is slightly developed after the running test.

Example 77

The procedure for preparation of the photoreceptor in Example 59 was repeated except that the formulation of the charge transport layer coating liquid was changed as follows.

Charge transport polymer material having the following formula 10

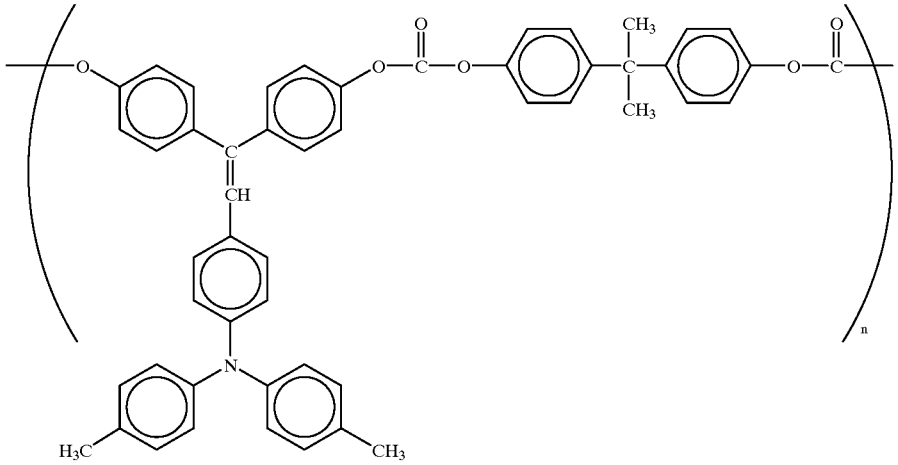

Methylene chloride 100

Thus, a photoreceptor of Example 77 was prepared.

Each of the photoreceptors of Examples 59 and 77 was evaluated by the evaluation method (4) mentioned above. In the running test 15,000 copies were continuously produced.

The results are shown in Table 38.

TABLE 38

| | Image qualities (initial) | Image qualities after running test | Abrasion amount of CTL (μm) |
|---|---|---|---|
| Ex. 59 | Good | A few black streaks (still acceptable) | 3.6 |
| Ex. 77 | Good | Good | 2.0 |

As can be understood from Table 38, the photoreceptor of Example 77 has good abrasion resistance.

Synthesis Example 25

The procedure for preparation of the wet cake in Synthesis Example 1 was repeated. The wet cake was further washed with deionized water until $NO_2^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 25 (hereinafter referred to as TiOPc 25) was prepared.

The TiOPc 25 was exposed to X-ray to obtain its X-ray diffraction spectrum. The conditions of the X-ray irradiation were the same as those mentioned in Synthesis Example 1.

The X-ray diffraction spectrum of the TiOPc 25 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 26

The TiOPc 25 was treated with 2-butanone, and then the solvent was dried to obtain a powder. Thus a TiOPc 26 was prepared. The X-ray diffraction spectrum of the TiOPc 26 was the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 27

The TiOPc 25 was treated with tetrahydrofuran, and then the solvent was dried to obtain a powder. Thus a TiOPc 27 was prepared. The X-ray diffraction spectrum of the TiOPc 27 was the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 28

The wet cake of a titanyl phthalocyanine pigment which had been prepared in Synthesis Example 25 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 28 was prepared.

The X-ray diffraction spectrum of the TiOPc 28 was almost the same as that of the TiOPc 4 (i.e., main peaks was observed at least at Bragg (2 θ) angles of 9.0°±0.2°, 14.2°±0.2°, 23.9°±0.2° and 27.1°±0.2°).

Synthesis Example 29

The wet cake of a titanyl phthalocyanine pigment which had been prepared in Synthesis Example 25 was repeatedly treated with deionized water while measuring the concentration of $NO_2^-$ ions in the filtrate. When the content of $NO_2^-$ ions relative to the pigment was about 10 ppm, the washing treatment was stopped. The wet cake was further treated with 1,2-dichloroethane in the same method as performed in Synthesis Example 25. Thus a TiOPc 29 was prepared.

The X-ray diffraction spectrum was almost the same as that of the TiOPc 25 (i.e., main peaks were observed at least at Bragg (2 θ) angles of 9.6°±0.2°, 24.0°±0.2°, and 27.2°±0.2°). The content of $NO_2^-$ ions in the TiOPc 29 was 9 ppm.

Synthesis Example 30

The wet cake of a titanyl phthalocyanine pigment which had been prepared in Synthesis Example 25 was washed with deionized water while measuring $NO_2^-$ ions in the filtrate. When the content of $NO_2^-$ ions relative to the pigment was about 50 ppm, the washing treatment was stopped. The wet cake was further treated with 1,2-dichloroethane in the same method as performed in Synthesis Example 25. Thus a TiOPc 30 was prepared.

The X-ray diffraction spectrum was almost the same as that of the TiOPc 25 (i.e., main peaks were observed at least at Bragg (2 θ) angles of 9.6°±0.2°, 24.0°±0.2°, and 27.2°±0.2°). The content of $NO_2^-$ ions in the TiOPc 30 was 52 ppm.

Example 78

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of Charge Generation Layer

The following components were mixed.

| | |
|---|---|
| TiOPc 25 prepared above | 3 |
| Polyvinyl butyral | 2 |
| Tetrahydrofuran | 50 |
| 4-methyl-2-pentanone | 90 |

One part of deionized water in which ammonium nitrite was dissolved was added into the mixture such that the concentration of $NO_2^-$ ion relative to the TiOPc 25 was 0.05 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

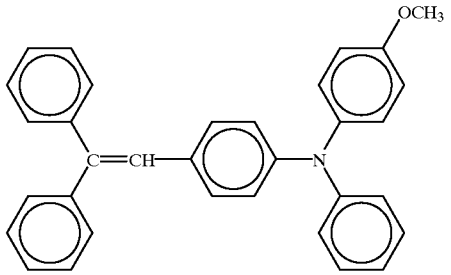

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 78 was prepared.

Examples 79 to 82 and Comparative Example 37

The procedure for preparation of the photoreceptor in Example 78 was repeated except that the concentration of $NO_2^-$ ion was changed as shown in Table 39.

Thus photoreceptors of Examples 79 and 82 and Comparative Example 37 were prepared.

Each of the thus prepared photoreceptors of Examples 78 to 82 and Comparative Example 37 was evaluated by the evaluation method (1) mentioned above. In the running test 18,000 copies were continuously produced.

The results are shown in Table 39.

TABLE 39

| | Conc. of $NO_2^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 78 | 0.05 | −960 | −140 | −940 | −155 |
| Ex. 79 | 1 | −945 | −125 | −930 | −145 |
| Ex. 80 | 6 | −950 | −135 | −935 | −150 |
| Ex. 81 | 12 | −950 | −120 | −940 | −135 |
| Ex. 82 | 33 | −955 | −130 | −945 | −140 |
| Comp. Ex. 37 | 85 | −845 | −130 | −690 | −145 |

As can be understood from Table 39, when the concentration of $NO_2^-$ ions is not greater than 50 ppm, the resultant photoreceptor has good charge properties even after the running test.

Example 83 and Comparative Example 38

The procedure for preparation of the photoreceptor in Example 78 was repeated except that the TiOPc 25 was replaced with the TiOPc 29 or the TiOPc 30. Thus, photoreceptors of Example 83 and Comparative Example 38 were prepared. The photoreceptors were evaluated by the same method as performed in Example 78. The results are shown in Table 40.

TABLE 40

| | Conc. of $NO_2^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 83 | 9 | −950 | −130 | −940 | −140 |
| Comp. Ex. 38 | 50 | −870 | −130 | −750 | −140 |

As can be understood from Table 40, the photoreceptor of Example 83 which includes the TiOPc including $NO_2^-$ ions in an amount of 9 ppm has good charging properties even after the running test. On the contrary, the photoreceptor of Comparative Example 38, which includes the TiOPc including $NO_2^-$ ions in an amount of 50 ppm, has a low surface potential after the running test.

Example 84

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 $\mu$m thick thereon.

Preparation of Charge Generation Layer

The following components were mixed.

| | |
|---|---|
| TiOPc 26 prepared above | 4 |
| Polyvinyl butyral | 2 |
| Cyclohexanone | 50 |
| Tetrahydrofuran | 100 |

One part of deionized water in which ammonium nitrite was dissolved was added into the mixture such that the concentration of $NO_2^-$ ions relative to the TiOPc 26 was 0.07 ppm. Thus, a charge generation layer coating liquid was prepared.

The thus prepared charge generation layer coating liquid was coated on the undercoat layer and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

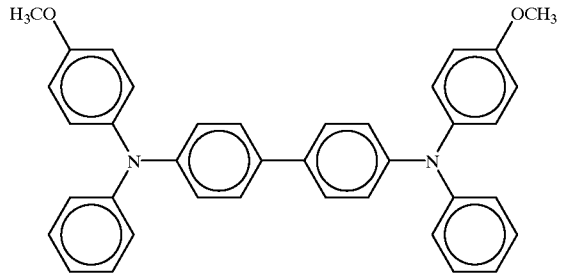

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 84 was prepared.

Examples 85 to 88 and Comparative Example 39

The procedure for preparation of the photoreceptor in Example 84 was repeated except that the concentration of $NO_2^-$ ions was changed as shown in Table 40.

Thus photoreceptors of Examples 85 to 88 and Comparative Example 39 were prepared.

Each of the thus prepared photoreceptors of Examples 84 to 88 and Comparative Example 39 was evaluated by the evaluation method (2) mentioned above. In the running test 12,000 copies were continuously produced.

The results are shown in Table 40.

TABLE 40

| | Conc. of $NO_2^-$ ions (ppm) | Initial image qualities | Image qualities after running test |
|---|---|---|---|
| Ex. 84 | 0.07 | Good | Good |
| Ex. 85 | 4 | Good | Good |
| Ex. 86 | 11 | Good | Good |
| Ex. 87 | 23 | Good | Good |
| Ex. 88 | 41 | Good | Good |
| Comp. Ex. 39 | 84 | Background was slightly developed (still acceptable) | Background was developed |

As can be understood from Table 40, when the concentration of $NO_2^-$ ions is not greater than 50 ppm, the resultant photoreceptor produces good images even when used for a long period of time.

Example 89

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 27 prepared above | 3 |
| Polyvinyl butyral | 1 |
| Cyclohexanone | 250 |
| Cyclohexane | 50 |

One part of deionized water in which ammonium nitrite was dissolved was added into the mixture such that the concentration of $NO_2^-$ ions relative to the TiOPc 27 was 0.1 ppm. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

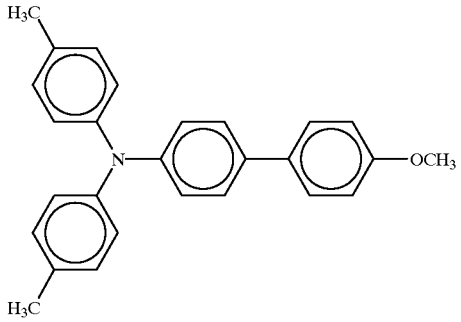

| | |
|---|---|
| Methylene chloride | 80 |

The thus prepared charge transport layer coating liquid was coated on the charge generation layer and then dried to form a charge transport layer having a thickness thereof was 20 $\mu$m.

Thus a photoreceptor of Example 89 was prepared.

Examples 90 to 93 and Comparative Example 40

The procedure for preparation of the photoreceptor in Example 89 was repeated except that the concentration of $NO_2^-$ ions was changed as shown in Table 41.

Thus photoreceptors of Examples 90 to 93 and Comparative Example 40 were prepared.

Each of the thus prepared photoreceptors of Examples 89 to 93 and Comparative Example 40 was evaluated by the evaluation method (3) mentioned above. In the running test 8,000 copies were continuously produced.

The results are shown in Table 41.

TABLE 41

| | Conc. of $NO_2^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 89 | 0.1 | −715 | −125 | −700 | −150 |
| Ex. 90 | 2 | −690 | −120 | −675 | −130 |
| Ex. 91 | 8 | −710 | −120 | −700 | −135 |
| Ex. 92 | 15 | −705 | −135 | −690 | −145 |
| Ex. 93 | 34 | −695 | −120 | −675 | −130 |
| Comp. Ex. 40 | 70 | −645 | −120 | −575 | −130 |

As can be understood from Table 41, when the concentration of $NO_2^-$ ions is not greater than 50 ppm, the resultant photoreceptor has good charge properties even after the running test.

Example 94

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 $\mu$m thick thereon.

Preparation of Charge Generation Layer

The following components were mixed.

| | |
|---|---|
| TiOPc 28 prepared above | 4 |
| Polyvinyl butyral | 2 |
| Cyclohexanone | 50 |
| Tetrahydrofuran | 100 |

One part of deionized water in which ammonium nitrite was dissolved was added into the mixture such that the concentration of $NO_2^-$ ions relative to the TiOPc 28 was 1 ppm. Thus, a charge generation layer coating liquid was prepared.

The thus prepared charge generation layer coating liquid was coated on the undercoat layer and then dried to form a charge generation layer having a thickness of 0.3 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |
| Tetrahydrofuran | 80 |

The thus prepared charge transport layer coating liquid was coated on the charge generation layer and then dried to form a charge transport layer having a thickness thereof was 25 $\mu$m.

Thus a photoreceptor of Example 94 was prepared.

Examples 95 and 97 and Comparative Example 41

The procedure for preparation of the photoreceptor in Example 94 was repeated except that the concentration of $NO_2^-$ ions was changed as shown in Table 42.

Thus photoreceptors of Examples 95 and 97 and Comparative Example 41 were prepared.

Example 98

The procedure for preparation of the photoreceptor in Example 94 was repeated except that the deionized water including ammonium nitrite was not added to the charge generation layer coating liquid.

Each of the thus prepared photoreceptors of Examples 94 to 98 and Comparative Example 41 was evaluated by the evaluation method (2) mentioned above. In the running test 10,000 copies were continuously produced.

The results are shown in Table 42.

TABLE 42

| | Conc. of $NO_2^-$ ions (ppm) | Initial image qualities | Image qualities after running test |
|---|---|---|---|
| Ex. 94 | 1 | Good | Good |
| Ex. 95 | 8 | Good | Good |
| Ex. 96 | 21 | Good | Good |
| Ex. 97 | 38 | Good | Good |
| Ex. 98 | 0 ($NO_2^-$ ions were not detected) | Good | Slightly low image density (still acceptable) |
| Comp. Ex. 41 | 68 | Background was slightly developed | Background was developed |

As can be understood from Table 42, when the concentration of $NO_2^-$ ions is not greater than 50 ppm, the resultant photoreceptor produces good images even after the running test. When $NO_2^-$ ions are not included in the charge generation layer, the resultant photoreceptor produces images whose background area is slightly developed after the running test.

Example 99

The procedure for preparation of the photoreceptor in Example 78 was repeated except that the formulation of the charge transport layer coating liquid was changed as follows.

| | |
|---|---|
| Charge transport polymer material having the following formula | 10 |
| Methylene chloride | 100 |

Thus, a photoreceptor of Example 99 was prepared.

Each of the photoreceptors of Examples 78 and 99 was evaluated by the evaluation method (4) mentioned above. In the running test 10,000 copies were continuously produced.

The results are shown in Table 43.

TABLE 43

| | Image qualities (initial) | Image qualities after running test | Abrasion amount of CTL (μm) |
|---|---|---|---|
| Ex. 78 | Good | Slight black streak (still acceptable) | 3.1 |
| Ex. 99 | Good | Good | 1.6 |

As can be understood from Table 43, the photoreceptor of Example 99 has good abrasion resistance.

Synthesis Example 31

The procedure for preparation of the wet cake of the titanyl phthalocyanine pigment in Synthesis Example 1 was repeated. The wet cake was further washed with deionized water until $Cl^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 31 (hereinafter referred to as TiOPc 31) was prepared.

The TiOPc 31 was exposed to X-ray to obtain its X-ray diffraction spectrum. The conditions of the X-ray irradiation were the same as those mentioned above in Synthesis Example 1.

The X-ray diffraction spectrum of the TiOPc 31 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 32

The TiOPc 31 was treated with 2-butanone, and then the solvent was dried to obtain a powder. Thus a TiOPc 32 was prepared. The X-ray diffraction spectrum of the TiOPc 32 was almost the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 33

The TiOPc 31 was treated with tetrahydrofuran, and then the solvent was dried to obtain a powder. Thus a TiOPc 33 was prepared. The X-ray diffraction spectrum of the TiOPc 33 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 34

The wet cake of a titanyl phthalocyanine pigment which had been prepared in Synthesis Example 31 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 34 was prepared.

The X-ray diffraction spectrum of the TiOPc 34 was the same as that of the TiOPc 4 (i.e., main peaks was observed at least at Bragg (2 θ) angles of 9.0°±0.2°, 14.2°±0.2°, 23.9°±0.2° and 27.1°±0.2°).

Synthesis Example 35

The wet cake of a titanyl phthalocyanine pigment which had been prepared in Synthesis Example 31 was repeatedly treated with deionized water while measuring the concentration of $Cl^-$ ions in the filtrate. When the content of $Cl^-$ ions relative to the pigment was about 60 ppm, the washing treatment was stopped. The wet cake was further treated with 1,2-dichloroethane in the same method as performed in Synthesis Example 31. Thus a TiOPc 35 was prepared.

The X-ray diffraction spectrum was almost the same as that of the TiOPc 31 (i.e., main peaks were observed at least at Bragg (2 θ) angles of 9.6°±0.2°, 24.0°±0.2°, and 27.2°±0.2°). The content of $Cl^-$ ions in the TiOPc 35 was 65 ppm.

Synthesis Example 36

The wet cake of a titanyl phthalocyanine pigment which had been prepared in Synthesis Example 31 was washed with deionized water while measuring $Cl^-$ ions in the filtrate. When the content of $Cl^-$ ions relative to the pigment was about 200 ppm, the washing treatment was stopped. The wet cake was further treated with 1,2-dichloroethane in the same method as performed in Synthesis Example 31. Thus a TiOPc 36 was prepared.

The X-ray diffraction spectrum was almost the same as that of the TiOPc 31 (i.e., main peaks were observed at least at Bragg (2 θ) angles of 9.6°±0.2°, 24.0°±0.2°, and 27.2°±0.2°). The content of $Cl^-$ ions in the TiOPc 36 was 210 ppm.

Example 100

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of Charge Generation Layer

The following components were mixed.

| | |
|---|---|
| TiOPc 31 prepared above | 3 |
| Polyvinyl butyral | 2 |
| Tetrahydrofuran | 50 |
| 4-methyl-2-pentanone | 90 |

One part of deionized water in which ammonium chloride was dissolved was added into the mixture such that the concentration of $Cl^-$ ions relative to the TiOPc 31 was 0.05 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

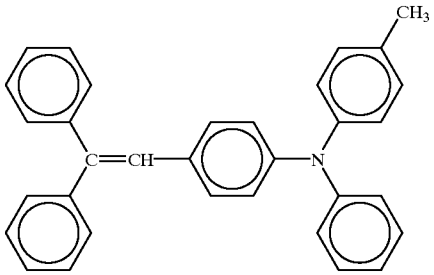

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 100 was prepared.

Examples 101 to 104 and Comparative Example 42

The procedure for preparation of the photoreceptor in Example 100 was repeated except that the concentration of $Cl^-$ ion was changed as shown in Table 44.

Thus photoreceptors of Examples 101 and 104 and Comparative Example 42 were prepared.

Each of the thus prepared photoreceptors of Examples 100 to 104 and Comparative Example 42 was evaluated by the evaluation method (1) mentioned above. In the running test 18,000 copies were continuously produced.

The results are shown in Table 44.

TABLE 44

| | Conc. of $Cl^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 100 | 0.05 | −985 | −150 | −975 | −165 |
| Ex. 101 | 4 | −975 | −145 | −955 | −155 |
| Ex. 102 | 11 | −960 | −145 | −950 | −155 |
| Ex. 103 | 40 | −970 | −140 | −945 | −155 |
| Ex. 104 | 82 | −965 | −145 | −955 | −155 |
| Comp. Ex. 42 | 123 | −830 | −140 | −660 | −150 |

As can be understood from Table 44, when the concentration of $Cl^-$ ions is not greater than 100 ppm, the resultant photoreceptor has good charge properties even after the running test.

Example 105 and Comparative Example 43

The procedure for preparation of the photoreceptor in Example 100 was repeated except that the TiOPc 31 was replaced with the TiOPc 35 or the TiOPc 36. Thus, photoreceptors of Example 105 and Comparative Example 43 were prepared. The photoreceptors were evaluated by the same method as performed in Example 78. The results are shown in Table 45.

TABLE 45

| | Conc. Of $Cl^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 105 | 65 | −970 | −145 | −950 | −155 |
| Comp. Ex. 43 | 210 | −780 | −140 | −600 | −150 |

As can be understood from Table 45, the photoreceptor of Example 105 which includes the TiOPc including $Cl^-$ ions in an amount of 65 ppm has good charging properties even after the running test. On the contrary, the photoreceptor of Comparative Example 43, which includes the TiOPc including $Cl^-$ ions in an amount of 210 ppm, has a low surface potential after the running test.

Example 106

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 μm thick thereon.

Preparation of Charge Generation Layer

The following components were mixed.

| | |
|---|---|
| TiOPc 32 prepared above | 4 |
| Polyvinyl butyral | 2 |
| Cyclohexanone | 50 |
| Tetrahydrofuran | 100 |

One part of deionized water in which ammonium chloride was dissolved was added into the mixture such that the concentration of $Cl^-$ ions relative to the TiOPc 32 was 0.04 ppm. Thus, a charge generation layer coating liquid was prepared.

The thus prepared charge generation layer coating liquid was coated on the undercoat layer and then dried to form a charge generation layer having a thickness of 0.2 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

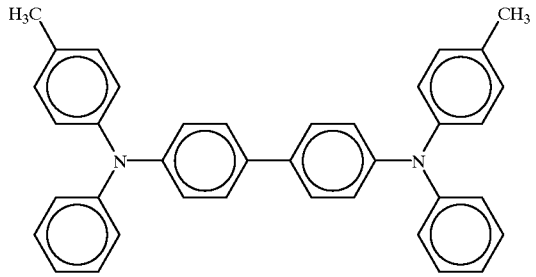

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 106 was prepared.

Examples 107 to 110 and Comparative Example 44

The procedure for preparation of the photoreceptor in Example 106 was repeated except that the concentration of $Cl^-$ ions was changed as shown in Table 46.

Thus photoreceptors of Examples 107 to 110 and Comparative Example 44 were prepared.

Each of the thus prepared photoreceptors of Examples 107 to 110 and Comparative Example 44 was evaluated by the evaluation method (2) mentioned above. In the running test 12,000 copies were continuously produced.

The results are shown in Table 46.

TABLE 46

| | Conc. of $Cl^-$ ions (ppm) | Initial image qualities | Image qualities after running test |
|---|---|---|---|
| Ex. 106 | 0.04 | Good | Slightly low image density (still acceptable) |
| Ex. 107 | 9 | Good | Good |
| Ex. 108 | 13 | Good | Good |
| Ex. 109 | 55 | Good | Good |
| Ex. 110 | 79 | Good | Good |
| Comp. Ex. 44 | 130 | Background was slightly developed (still acceptable) | Background was developed |

As can be understood from Table 46, when the concentration of $Cl^-$ ions is not greater than 100 ppm, the resultant photoreceptor produces good images even when used for a long period of time.

Example 111

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 33 prepared above | 3 |
| Polyvinyl butyral | 1 |
| Cyclohexanone | 250 |
| Cyolohexane | 50 |

One part of deionized water in which ammonium chloride was dissolved was added into the mixture such that the concentration of $Cl^-$ ions relative to the TiOPc 33 was 0.1 ppm. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

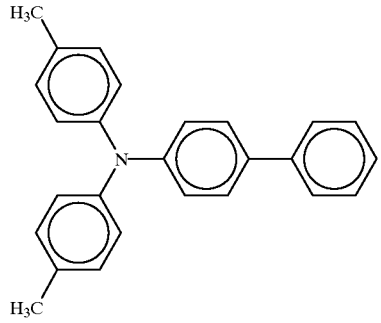

| | |
|---|---|
| Methylene chloride | 80 |

The thus prepared charge transport layer coating liquid was coated on the charge generation layer and then dried to form a charge transport layer having a thickness thereof was 20 $\mu$m.

Thus a photoreceptor of Example 111 was prepared.

Examples 112 to 115 and Comparative Example 45

The procedure for preparation of the photoreceptor in Example 111 was repeated except that the concentration of $Cl^-$ ion was changed as shown in Table 47.

Thus photoreceptors of Examples 112 to 115 and Comparative Examples 45 were prepared.

Each of the thus prepared photoreceptors of Examples 111 to 115 and Comparative Example 45 was evaluated by the evaluation method (3) mentioned above. In the running test 8,000 copies were continuously produced.

The results are shown in Table 47.

TABLE 47

| | Conc. of $Cl^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 111 | 0.1 | −730 | −125 | −710 | −150 |
| Ex. 112 | 3 | −710 | −120 | −675 | −125 |
| Ex. 113 | 9 | −725 | −125 | −705 | −130 |
| Ex. 114 | 25 | −715 | −135 | −695 | −140 |
| Ex. 115 | 75 | −720 | −115 | −700 | −125 |
| Comp. Ex. 45 | 135 | −645 | −120 | −560 | −130 |

As can be understood from Table 47, when the concentration of $Cl^-$ ions is not greater than 100 ppm, the resultant photoreceptor has good charge properties even after the running test.

Example 116

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 $\mu$m thick thereon.

Preparation of Charge Generation Layer

The following components were mixed.

| | |
|---|---|
| TiOPc 34 prepared above | 4 |
| Polyvinyl butyral | 2 |
| Cyclohexanone | 50 |
| Tetrahydrofuran | 100 |

One part of deionized water in which ammonium chloride was dissolved was added into the mixture such that the concentration of $Cl^-$ ions relative to the TiOPc 34 was 1 ppm. Thus, a charge generation layer coating liquid was prepared.

The thus prepared charge generation layer coating liquid was coated on the undercoat layer and then dried to form a charge generation layer having a thickness of 0.3 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

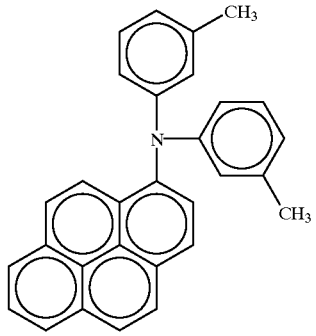

| | |
|---|---|
| Tetrahydrofuran | 80 |

The thus prepared charge transport layer coating liquid was coated on the charge generation layer and then dried to form a charge transport layer having a thickness thereof was 25 $\mu$m.

Thus a photoreceptor of Example 116 was prepared.

Examples 117 and 119 and Comparative Example 46

The procedure for preparation of the photoreceptor in Example 116 was repeated except that the concentration of $Cl^-$ ions was changed as shown in Table 48.

Thus photoreceptors of Examples 117 and 119 and Comparative Example 46 were prepared.

Example 120

The procedure for preparation of the photoreceptor in Example 116 was repeated except that the deionized water including ammonium chloride was not added to the charge generation layer coating liquid.

Each of the thus prepared photoreceptors of Examples 116 to 120 and Comparative Example 46 was evaluated by the evaluation method (2) mentioned above. In the running test 10,000 copies were continuously produced.

The results are shown in Table 48.

TABLE 48

| | Conc. of $Cl^-$ ions (ppm) | Initial image qualities | Image qualities after running test |
|---|---|---|---|
| Ex. 116 | 1 | Good | Good |
| Ex. 117 | 12 | Good | Good |
| Ex. 118 | 35 | Good | Good |
| Ex. 119 | 68 | Good | Good |
| Ex. 120 | 0 ($Cl^-$ ions were not detected) | Good | Slightly low image density (still acceptable) |
| Comp. Ex. 46 | 125 | Background was slightly developed (still acceptable) | Background was developed |

As can be understood from Table 48, when the concentration of $Cl^-$ ions is not greater than 100 ppm, the resultant photoreceptor produces good images even after the running test. When $Cl^-$ ions is not included in the charge generation layer, the resultant photoreceptor produces images whose background area is slightly developed after the running test.

Example 121

The procedure for preparation of the photoreceptor in Example 100 was repeated except that the formulation of the charge transport layer coating liquid was changed as follows.

| Charge transport polymer material having the following formula | 10 |
|---|---|
| 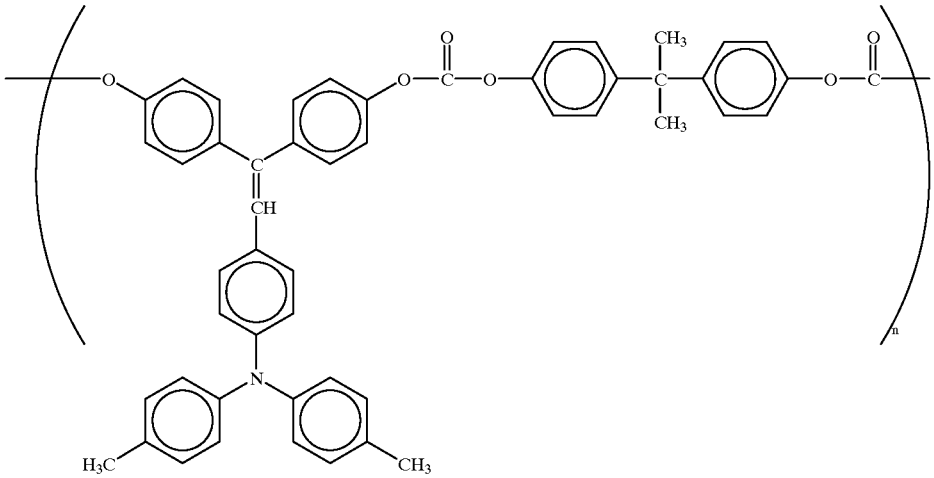 | |
| Methylene chloride | 100 |

Thus, a photoreceptor of Example 121 was prepared.

Each of the photoreceptors of Examples 99 and 120 was evaluated by the evaluation method (4) mentioned above. In the running test 10,000 copies were continuously produced.

The results are shown in Table 49.

TABLE 49

| | Image qualities (initial) | Image qualities after running test | Abrasion amount of CTL (μm) |
|---|---|---|---|
| Ex. 100 | Good | A few black streaks (still acceptable) | 3.1 |
| Ex. 121 | Good | Good | 1.6 |

As can be understood from Table 49, the photoreceptor of Example 121 has good abrasion resistance.

Synthesis Example 37

The procedure for preparation of the wet cake of the titanyl phthalocyanine pigment in Synthesis Example 1 was repeated. The wet cake was further washed with deionized water until $Br^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 37 (hereinafter referred to as TiOPc 37) was prepared.

The TiOPc 37 was exposed to X-ray to obtain its X-ray diffraction spectrum. The conditions of the X-ray irradiation were the same as those mentioned above in Synthesis Example 1.

The X-ray diffraction spectrum of the TiOPc 37 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 38

The TiOPc 37 was treated with 2-butanone, and then the solvent was dried to obtain a powder. Thus a TiOPc 38 was prepared. The X-ray diffraction spectrum of the TiOPc 38 was almost the same as that of the TiOPc 2 which is shown in FIG. 8 (i.e., main peaks were observed at least at Bragg (2 θ) angles of 7.5°±0.2°, 25.3°÷0.2° and 28.6°±0.2°).

Synthesis Example 39

The TiOPc 37 was treated with tetrahydrofuran, and then the solvent was dried to obtain a powder. Thus a TiOPc 39 was prepared. The X-ray diffraction spectrum of the TiOPc 39 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 40

The wet cake of a titanyl phthalocyanine pigment which had been prepared in Synthesis Example 37 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 40 was prepared.

The X-ray diffraction spectrum of the TiOPc 40 was almost the same as that of the TiOPc 4 (i.e., main peaks were observed at least at Bragg (2 θ) angles of 9.0°±0.2°, 14.2°±0.2°, 23.9°±0.2° and 27.1°±0.2°).

Synthesis Example 41

The wet cake of a titanyl phthalocyanine pigment which had been prepared in Synthesis Example 37 was repeatedly treated with deionized water while measuring the concentration of $Br^-$ ions in the filtrate. When the content of $Br^-$ ions relative to the pigment was about 20 ppm, the washing treatment was stopped. The wet cake was further treated with 1,2-dichloroethane in the same method as performed in Synthesis Example 37. Thus a TiOPc 41 was prepared.

The X-ray diffraction spectrum was almost the same as that of the TiOPc 37 (i.e., main peaks were observed at least at Bragg (2 θ) angles of 9.6°±0.2°, 24.0°±0.2°, and 27.2°±0.2°). The content of $Br^-$ ions in the TiOPc 41 was 17 ppm.

Synthesis Example 42

The wet cake of a titanyl phthalocyanine pigment which had been prepared in Synthesis Example 37 was washed with deionized water while measuring $NO_2^-$ ions in the filtrate. When the content of $Br^-$ ions relative to the pigment was about 100 ppm, the washing treatment was stopped. The wet cake was further treated with 1,2-dichloroethane in the same method as performed in Synthesis Example 37. Thus a TiOPc 42 was prepared.

The X-ray diffraction spectrum was almost the same as that of the TiOPc 37 (i.e., main peaks were observed at least at Bragg (2 θ) angles of 9.6°±0.2°, 24.0°±0.2°, and 27.2°±0.2°). The content of $Br^-$ ions in the TiOPc 42 was 98 ppm.

Example 122

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of charge generation layer

The following components were mixed.

| | |
|---|---|
| TiOPc 37 prepared above | 3 |
| Polyvinyl butyral | 2 |
| Tetrahydrofuran | 50 |
| 4-methyl-2-pentanone | 90 |

One part of deionized water in which ammonium bromide was dissolved was added into the mixture such that the concentration of $Br^-$ ions relative to the TiOPc 37 was 0.05 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of charge transport layer coating liquid

The following components were mixed to prepare a charge transport layer coating liquid.

| | |
|---|---|
| Polycarbonate resin | 10 |
| Charge transport material having the following formula | 8 |

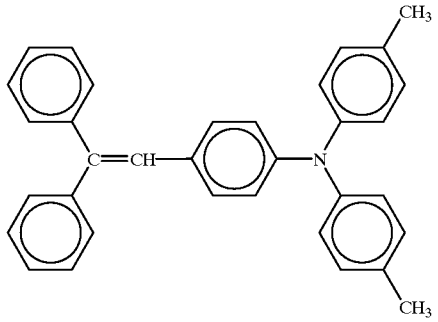

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 122 was prepared.

Examples 123 to 126 and Comparative Example 47

The procedure for preparation of the photoreceptor in Example 122 was repeated except that the concentration of $Br^-$ ions was changed as shown in Table 50.

Thus photoreceptors of Examples 123 and 126 and Comparative Example 47 were prepared.

Each of the thus prepared photoreceptors of Examples 122 to 126 and Comparative Example 47 was evaluated by the evaluation method (1) mentioned above. In the running test 18,000 copies were continuously produced.

The results are shown in Table 50.

TABLE 50

| | Conc. of $Br^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 122 | 0.05 | −980 | −155 | −970 | −175 |
| Ex. 123 | 1 | −970 | −140 | −950 | −155 |
| Ex. 124 | 5 | −950 | −150 | −940 | −160 |
| Ex. 125 | 10 | −970 | −135 | −940 | −150 |
| Ex. 126 | 30 | −960 | −145 | −950 | −155 |
| Comp. Ex. 47 | 70 | −820 | −135 | −650 | −155 |

As can be understood from Table 50, when the concentration of $Br^-$ ions is not greater than 50 ppm, the resultant photoreceptor has good charge properties even after the running test.

Example 127 and Comparative Example 48

The procedure for preparation of the photoreceptor in Example 122 was repeated except that the TiOPc 37 was replaced with the TiOPc 41 or the TiOPc 42. Thus, photoreceptors of Example 126 and Comparative Example 48 were prepared. The photoreceptors were evaluated by the same method as performed in Example 122. The results are shown in Table 51.

TABLE 51

| | Conc. of $Br^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 127 | 17 | −965 | −140 | −940 | −155 |
| Comp. Ex. 48 | 98 | −780 | −135 | −610 | −150 |

As can be understood from Table 51, the photoreceptor of Example 127 which includes the TiOPc including $Br^-$ ions in an amount of 17 ppm has good charging properties even after the running test. On the contrary, the photoreceptor of Comparative Example 48, which includes the TiOPc including $Br^-$ ions in an amount of 98 ppm, has a low surface potential after the running test.

Example 128

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 $\mu$m thick thereon.

Preparation of charge generation layer

The following components were mixed.

| | |
|---|---|
| TiOPc 38 prepared above | 4 |
| Polyvinyl butyral | 2 |
| Cyclohexanone | 50 |
| Tetrahydrofuran | 100 |

One part of deionized water in which ammonium bromide was dissolved was added into the mixture such that the concentration of $Br^-$ ions relative to the TiOPc 38 was 0.08 ppm. Thus, a charge generation layer coating liquid was prepared.

The thus prepared charge generation layer coating liquid was coated on the undercoat layer and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

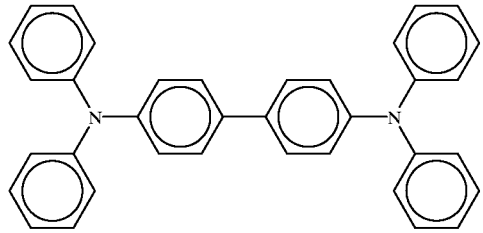

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 128 was prepared.

Examples 129 to 132 and Comparative Example 49

The procedure for preparation of the photoreceptor in Example 128 was repeated except that the concentration of $Br^-$ ion was changed as shown in Table 52.

Thus photoreceptors of Examples 129 to 132 and Comparative Example 49 were prepared.

Each of the thus prepared photoreceptors of Examples 128 to 132 and Comparative Example 49 was evaluated by the evaluation method (2) mentioned above. In the running test 12,000 copies were continuously produced.

The results are shown in Table 52.

TABLE 52

| | Conc. of $Br^-$ ions (ppm) | Initial image qualities | Image qualities after running test |
|---|---|---|---|
| Ex. 128 | 0.08 | Good | Good |
| Ex. 129 | 2 | Good | Good |
| Ex. 130 | 7 | Good | Good |
| Ex. 131 | 15 | Good | Good |
| Ex. 132 | 40 | Good | Good |
| Comp. Ex. 49 | 80 | Background was slightly developed (still acceptable) | Background was developed |

As can be understood from Table 52, when the concentration of $Br^-$ ions is not greater than 50 ppm, the resultant photoreceptor produces good images even when used for a long period of time.

Example 133

Preparation of undercoat layer

An aluminum cylinder was subjected to an anodic oxidation treatment and then the anodic oxidation coating was sealed.

Preparation of Charge Generation Layer

The following components were mixed.

| | |
|---|---|
| TiOPc 39 prepared above | 3 |
| Polyvinyl butyral | 1 |
| Cyclohexanone | 250 |
| Cyclohexane | 50 |

One part of deionized water in which ammonium bromide was dissolved was added into the mixture such that the concentration of $Br^-$ ions relative to the TiOPc 39 was 0.1 ppm. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |

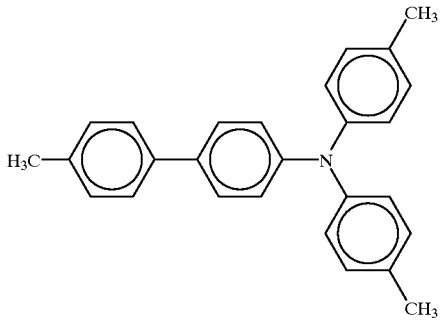

| | |
|---|---|
| Methylene chloride | 80 |

The thus prepared charge transport layer coating liquid was coated on the charge generation layer and then dried to form a charge transport layer having a thickness thereof was 20 $\mu$m.

Thus a photoreceptor of Example 133 was prepared.

Examples 134 to 137 and Comparative Example 50

The procedure for preparation of the photoreceptor in Example 133 was repeated except that the concentration of $Br^-$ ions was changed as shown in Table 53.

Thus photoreceptors of Examples 134 to 137 and Comparative Example 50 were prepared.

Each of the thus prepared photoreceptors of Examples 133 to 137 and Comparative Example 50 was evaluated by the evaluation method (3) mentioned above. In the running test 8,000 copies were continuously produced.

The results are shown in Table 53.

TABLE 53

| | Conc. Of $Br^-$ ions | Surface Potential (Initial) (V) | | Surface Potential (after running test) (V) | |
|---|---|---|---|---|---|
| | (ppm) | Dark area | Lighted area | Dark area | Lighted area |
| Ex. 133 | 0.1 | −725 | −130 | −705 | −145 |
| Ex. 134 | 0.8 | −700 | −120 | −680 | −135 |
| Ex. 135 | 4 | −720 | −125 | −710 | −135 |
| Ex. 136 | 21 | −710 | −130 | −690 | −135 |
| Ex. 137 | 38 | −700 | −115 | −685 | −130 |
| Comp. Ex. 50 | 72 | −630 | −120 | −575 | −135 |

As can be understood from Table 53, when the concentration of $Br^-$ ions is not greater than 50 ppm, the resultant photoreceptor has good charge properties even after the running test.

Example 138

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 $\mu$m thick thereon.

Preparation of charge generation layer

The following components were mixed.

| | |
|---|---|
| TiOPc 40 prepared above | 4 |
| Polyvinyl butyral | 2 |
| Cyclohexanone | 50 |
| Tetrahydrofuran | 100 |

One part of deionized water in which ammonium bromide was dissolved was added into the mixture such that the concentration of $Br^-$ ions relative to the TiOPc 40 was 1 ppm. Thus, a charge generation layer coating liquid was prepared.

The thus prepared charge generation layer coating liquid was coated on the undercoat layer and then dried to form a charge generation layer having a thickness of 0.3 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

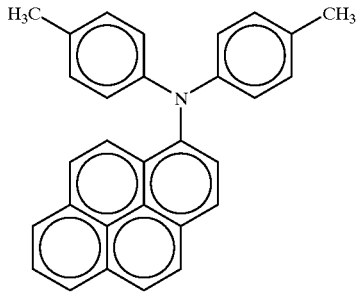

| | |
|---|---|
| Tetrahydro furan | 80 |

The thus prepared charge transport layer coating liquid was coated on the charge generation layer and then dried to form a charge transport layer having a thickness thereof was 25 $\mu$m.

Thus a photoreceptor of Example 138 was prepared.

Examples 139 and 141 and Comparative Example 51

The procedure for preparation of the photoreceptor in Example 138 was repeated except that the concentration of $Br^-$ ion was changed as shown in Table 54.

Thus photoreceptors of Examples 139 and 141 and Comparative Example 51 were prepared.

Example 142

The procedure for preparation of the photoreceptor in Example 138 was repeated except that the deionized water including ammonium bromide was not added to the charge generation layer coating liquid.

Each of the thus prepared photoreceptors of Examples 138 to 142 and Comparative Example 51 was evaluated by the evaluation method (2) mentioned above. In the running test 10,000 copies were continuously produced.

The results are shown in Table 54.

TABLE 54

| | Conc. of $Br^-$ ions (ppm) | Initial image qualities | Image qualities after running test |
|---|---|---|---|
| Ex. 138 | 1 | Good | Good |
| Ex. 139 | 5 | Good | Good |
| Ex. 140 | 13 | Good | Good |
| Ex. 141 | 34 | Good | Good |
| Ex. 142 | 0 ($Br^-$ ions were not detected) | Good | Slightly low image density (still acceptable) |
| Comp. Ex. 51 | 81 | Background was slightly developed | Background was soiled |

As can be understood from Table 54, when the concentration of $Br^-$ ions is not greater than 50 ppm, the resultant photoreceptor produces good images even after the running test. When $Br^-$ ions is not included in the charge generation layer, the resultant photoreceptor produces images whose background area is slightly soiled after the running test.

Example 143

The procedure for preparation of the photoreceptor in Example 122 was repeated except that the formulation of the charge transport layer coating liquid was changed as follows.

| | |
|---|---|
| Charge transport polymer material having the following formula | 10 |

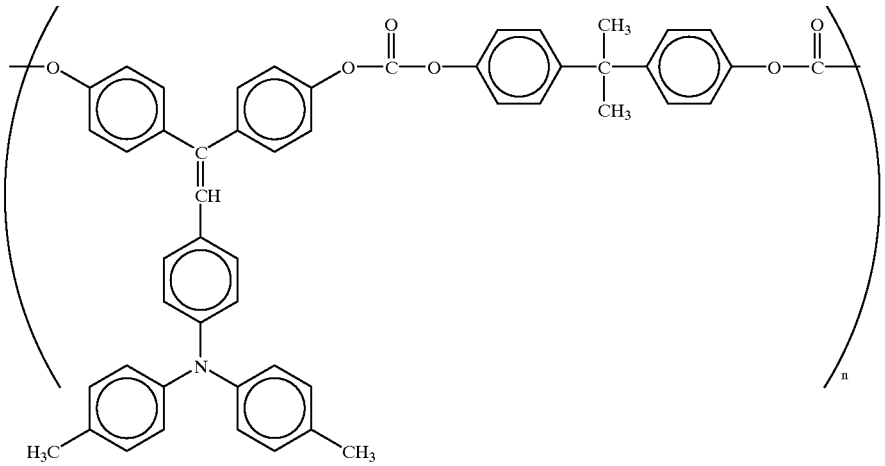

| | |
|---|---|
| Methylene chloride | 100 |

Thus, a photoreceptor of Example 143 was prepared.

Each of the photoreceptors of Examples 122 and 143 was evaluated by the evaluation method (4) mentioned above. In the running test 10,000 copies were continuously produced.

The results are shown in Table 55.

TABLE 55

| | Image qualities (initial) | Image qualities after running test | Abrasion amount of CTL (μm) |
|---|---|---|---|
| Ex. 122 | Good | A few black streaks (still acceptable) | 3.1 |
| Ex. 143 | Good | Good | 1.6 |

As can be understood from Table 55, the photoreceptor of Example 143 has good abrasion resistance.

Synthesis Example 43

The procedure for preparation of the wet cake of the titanyl phthalocyanine pigment in Synthesis Example 1 was repeated. The wet cake was further washed with deionized water until $NH_4^-$ ions were not detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 43 (hereinafter referred to as TiOPc 43) was prepared.

The TiOPc 43 was exposed to X-ray to obtain its X-ray diffraction spectrum. The conditions of the X-ray irradiation were the same as those mentioned above in Synthesis Example 1.

The X-ray diffraction spectrum of the TiOPc 43 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 44

The TiOPc 43 was treated with 2-butanone, and then the solvent was dried to obtain a powder. Thus a TiOPc 44 was prepared. The X-ray diffraction spectrum of the TiOPc 44 was almost the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 45

The TiOPc 43 was treated with tetrahydrofuran, and then the solvent was dried to obtain a powder. Thus a TiOPc 45 was prepared. The X-ray diffraction spectrum of the TiOPc 45 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 46

The wet cake of a titanyl phthalocyanine pigment which had been prepared in Synthesis Example 43 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 46 was prepared.

The X-ray diffraction spectrum of the TiOPc 46 was almost the same as that of the TiOPc 4 (i.e., main peaks was observed at least at Bragg (2 θ) angles of 9.0°±0.2°, 14.2°±0.2°, 23.9°±0.20 and 27.1°±0.2°).

Synthesis Example 47

The wet cake of a titanyl phthalocyanine pigment which had been prepared in Synthesis Example 43 was repeatedly treated with deionized water while measuring the concentration of $NH_4^-$ ions in the filtrate. When the content of $NH_4^+$ ions relative to the pigment was about 150 ppm, the washing treatment was stopped. The wet cake was further treated with 1,2-dichloroethane in the same method as performed in Synthesis Example 43. Thus a TiOPc 47 was prepared.

The X-ray diffraction spectrum was almost the same as that of the TiOPc 43 (i.e., main peaks were observed at least at Bragg (2 θ) angles of 9.6°±0.2°, 24.0°±0.2°, and 27.2°±0.2°). The content of $NH_4^-$ ions in the TiOPc 47 was 153 ppm.

Synthesis Example 48

The wet cake of a titanyl phthalocyanine pigment which had been prepared in Synthesis Example 43 was washed with deionized water while measuring $NH_4^-$ ions in the filtrate. When the content of $NH_4^-$ ions relative to the pigment was about 600 ppm, the washing treatment was stopped. The wet cake was further treated with 1,2-dichloroethane in the same method as performed in Synthesis Example 43. Thus a TiOPc 48 was prepared.

The X-ray diffraction spectrum was almost the same as that of the TiOPc 43 (i.e., main peaks were observed at least at Bragg (2 θ) angles of 9.6°±0.2°, 24.0°±0.2°, and 27.2°±0.2°). The content of $NH_4^-$ ions in the TiOPc 48 was 598 ppm.

Example 144

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of Charge Generation Layer

The following components were mixed.

| | |
|---|---|
| TiOPc 43 prepared above | 3 |
| Polyvinyl butyral | 2 |
| Tetrahydrofuran | 50 |
| 4-methyl-2-pentanone | 90 |

One part of deionized water in which aqueous ammonia was dissolved was added into the mixture such that the concentration of $NH_4^+$ ions relative to the TiOPc 43 was 300 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

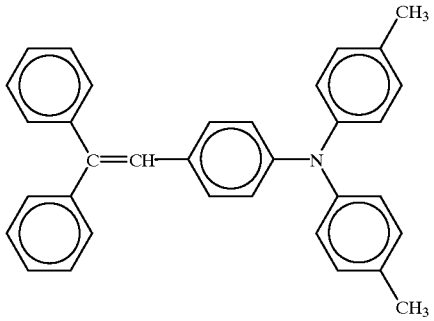

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 144 was prepared.

Examples 145 to 149 and Comparative Examples 52 and 53

The procedure for preparation of the photoreceptor in Example 144 was repeated except that the concentration of $NH_4^+$ ion was changed as shown in Table 56.

Thus photoreceptors of Examples 145 and 149 and Comparative Examples 52 and 53 were prepared.

Each of the thus prepared photoreceptors of Examples 144 to 149 and Comparative Examples 52 and 53 was evaluated by the evaluation method (1) mentioned above. In the running test 10,000 copies were continuously produced.

The results are shown in Table 56.

TABLE 56

| | Conc. of | Surface Potential (Initial) (V) | | Surface Potential (after running test) (V) | |
|---|---|---|---|---|---|
| | $NH_4^+$ ions (ppm) | Dark area | Lighted area | Dark area | Lighted area |
| Ex. 144 | 300 | −855 | −130 | −865 | −145 |
| Ex. 145 | 200 | −852 | −132 | −852 | −135 |
| Ex. 146 | 100 | −850 | −131 | −842 | −125 |
| Ex. 147 | 50 | −845 | −130 | −840 | −125 |
| Ex. 148 | 10 | −845 | −131 | −840 | −125 |
| Comp. Ex. 52 | 400 | −855 | −132 | −880 | −205 |
| Comp. Ex. 53 | 0 ($NH_4^+$ ions were not detected) | −830 | −120 | −780 | −120 |

As can be understood from Table 56, when the concentration of $NH_4^+$ ions is from 10 to 300 ppm, the resultant photoreceptor has good charge properties even after the running test. The photoreceptor not including $NH_4^+$ ions has poor surface potential, and the photoreceptor including $NH_4^+$ ions in an amount of 400 ppm has high residual potential, after the running test.

Example 149 and Comparative Example 54

The procedure for preparation of the photoreceptor in Example 144 was repeated except that the TiOPc 43 was replaced with the TiOPc 47 or the TiOPc 48. Thus, photoreceptors of Example 149 and Comparative Example 54 were prepared. The photoreceptors were evaluated by the same method as performed in Example 144. The results are shown in Table 57.

TABLE 57

| | Conc. of | Surface Potential (Initial) (V) | | Surface Potential (after running test) (V) | |
|---|---|---|---|---|---|
| | $NH_4^+$ ions (ppm) | Dark area | Lighted area | Dark area | Lighted area |
| Ex. 149 | 153 | −850 | −132 | −848 | −130 |
| Comp. Ex. 54 | 598 | −860 | −135 | −890 | −230 |

As can be understood from Table 57, the photoreceptor of Example 149 which includes the TiOPc including $NH_4^+$ ions in an amount of 153 ppm has good charging properties even after the running test. On the contrary, the photoreceptor of Comparative Example 54, which includes the TiOPc including $NH_4^+$ ions in an amount of 598 ppm, has a low surface potential after the running test.

Example 150

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 μm thick thereon.

Preparation of Charge Generation Layer

The following components were mixed.

| | |
|---|---|
| TiOPc 44 prepared above | 4 |
| Polyvinyl butyral | 2 |
| Cyclohexanone | 50 |
| Tetrahydrofuran | 100 |

One part of deionized water in which aqueous ammonia was dissolved was added into the mixture such that the concentration of $NH_4^+$ ions relative to the TiOPc 44 was 300 ppm. Thus, a charge generation layer coating liquid was prepared.

The thus prepared charge generation layer coating liquid was coated on the undercoat layer and then dried to form a charge generation layer having a thickness of 0.2 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |
| Tetrahydrofuran | 80 |

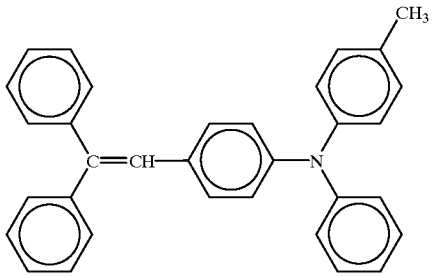

The thus prepared charge transport layer coating liquid was coated on the charge generation layer and then dried to form a charge transport layer having a thickness thereof was 20 μm.

Thus a photoreceptor of Example 150 was prepared.

Examples 151 to 154 and Comparative Examples 55 and 56

The procedure for preparation of the photoreceptor in Example 150 was repeated except that the concentration of $NH_4^+$ ions was changed as shown in Table 58.

Thus photoreceptors of Examples 151 to 154 and Comparative Examples 55 and 56 were prepared.

Each of the thus prepared photoreceptors of Examples 150 to 154 and Comparative Examples 55 and 56 was evaluated by the evaluation method (2) mentioned above. In the running test 8,000 copies were continuously produced.

The results are shown in Table 58.

TABLE 58

| | Conc. of $NH_4^+$ ions (ppm) | Initial image qualities | Image qualities after running test |
|---|---|---|---|
| Ex. 150 | 300 | Good | Good |
| Ex. 151 | 200 | Good | Good |
| Ex. 152 | 100 | Good | Good |
| Ex. 153 | 50 | Good | Good |
| Ex. 154 | 10 | Good | Good |
| Comp. Ex. 55 | 400 | Good | Low image density and white spot image |
| Comp. Ex. 56 | 0 ($NH_4^+$ ions were not detected) | Good | Background was developed |

As can be understood from Table 58, when the concentration of $NH_4^+$ ions is from 10 to 300 ppm, the resultant photoreceptor produces good images even when used for a long period of time.

Example 155

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 45 prepared above | 3 |
| Polyvinyl butyral | 1 |
| Cyclohexanone | 250 |
| Cyclohexane | 50 |

One part of deionized water in which aqueous ammonia was dissolved was added into the mixture such that the concentration of $NH_4^+$ ions relative to the TiOPc 45 was 300 ppm. Thus, a charge generation layer coating liquid was prepared.

The thus prepared charge generation layer coating liquid was coated on the anodic oxidation coating and then dried to form a charge generation layer having a thickness of 0.2 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 7 |
| Methylene chloride | 80 |

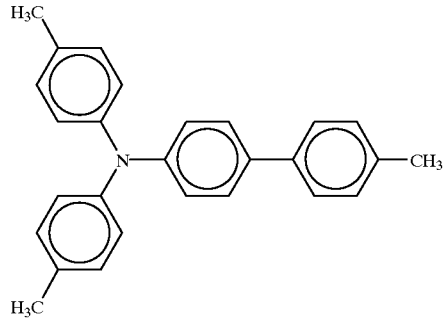

The thus prepared charge transport layer coating liquid was coated on the charge generation layer and then dried to form a charge transport layer having a thickness thereof was 20 μm.

Thus a photoreceptor of Example 155 was prepared.

Examples 156 to 159 and Comparative Examples 57 and 58

The procedure for preparation of the photoreceptor in Example 155 was repeated except that the concentration of $Br^-$ ions was changed as shown in Table 59.

Thus photoreceptors of Examples 156 to 159 and Comparative Examples 57 and 58 were prepared.

Each of the thus prepared photoreceptors of Examples 155 to 159 and Comparative Examples 57 and 58 was evaluated by the evaluation method (3) mentioned above. In the running test 8,000 copies were continuously produced.

The results are shown in Table 59.

TABLE 59

| | Conc. Of $NH_4^+$ ions (ppm) | Image qualities (Initial) | Image qualities after running test |
|---|---|---|---|
| Ex. 155 | 300 | Good | Good |
| Ex. 156 | 200 | Good | Good |
| Ex. 157 | 100 | Good | Good |
| Ex. 158 | 50 | Good | Good |
| Ex. 159 | 10 | Good | Good |
| Comp. Ex. 57 | 400 | Good | Low density and white spot image |
| Comp. Ex. 58 | 0 ($NH_4^+$ ions were not detected) | Good | Background was developed |

As can be understood from Table 59, when the concentration of $NH_4^+$ ions is from 10 to 300 ppm, the resultant photoreceptor has good charge properties even after the running test.

Example 160

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 μm thick thereon.

Preparation of Charge Generation Layer

The following components were mixed.

| | |
|---|---|
| TiOPc 46 prepared above | 4 |
| Polyvinyl butyral | 2 |
| Cyclohexanone | 50 |
| Tetrahydrofuran | 100 |

One part of deionized water in which aqueous ammonia was dissolved was added into the mixture such that the concentration of $NH_4^+$ ions relative to the TiOPc 46 was 300 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

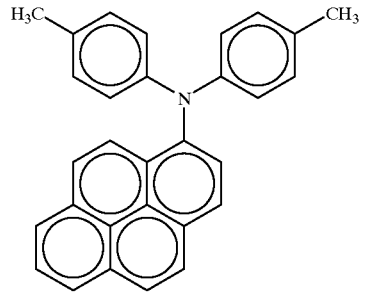

| | |
|---|---|
| Tetrahydrofuran | 80 |

The thus prepared charge transport layer coating liquid was coated on the charge generation layer and then dried to form a charge transport layer having a thickness thereof was 25 μm.

Thus a photoreceptor of Example 160 was prepared.

Examples 161 and 164 and Comparative Examples 59 and 60

The procedure for preparation of the photoreceptor in Example 161 was repeated except that the concentration of $NH_4^+$ ions was changed as shown in Table 60.

Thus photoreceptors of Examples 161 and 164 and Comparative Examples 59 and 60 were prepared.

Each of the thus prepared photoreceptors of Examples 160 to 164 and Comparative Examples 59 and 60 was evaluated by the evaluation method (2) mentioned above. In the running test 8,000 copies were continuously produced.

The results are shown in Table 60.

TABLE 60

| | Conc. of $NH_4^+$ ions (ppm) | Initial image qualities | Image qualities after running test |
|---|---|---|---|
| Ex. 160 | 300 | Good | Good |
| Ex. 161 | 200 | Good | Good |
| Ex. 162 | 100 | Good | Good |
| Ex. 163 | 50 | Good | Good |
| Ex. 164 | 10 | Good | Good |
| Comp. Ex. 59 | 400 | Good | Low image density and white spot image |
| Comp. Ex. 60 | 0 ($NH_4^+$ ions were not detected) | Good | Background was developed |

As can be understood from Table 60, when the concentration of $NH_4^+$ ions is from 10 to 300 ppm, the resultant photoreceptor produces good images even after the running test.

Example 165

The procedure for preparation of the photoreceptor in Example 144 was repeated except that the formulation of the charge transport layer coating liquid was changed as follows.

Charge transport polymer material having the following formula 10

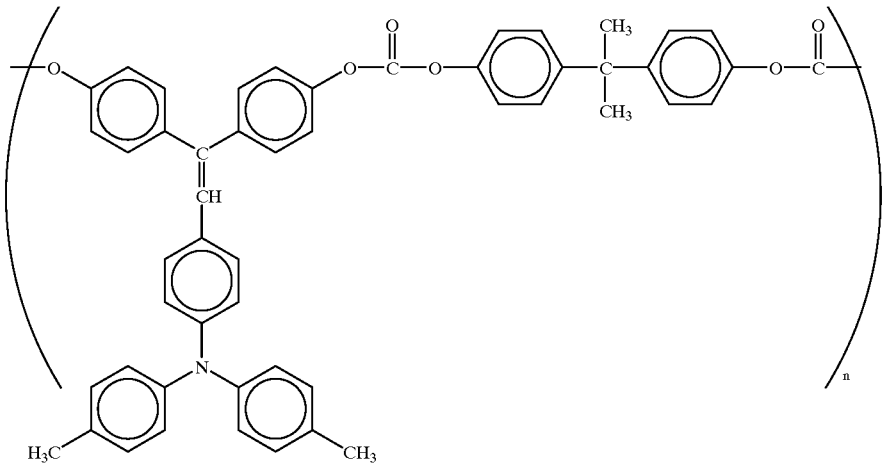

Methylene chloride 100

Thus, a photoreceptor of Example 165 was prepared.

Each of the photoreceptors of Examples 144 and 165 was evaluated by the evaluation method (4) mentioned above. In the running test 10,000 copies were continuously produced.

The results are shown in Table 61.

TABLE 61

| | Image qualities (initial) | Image qualities after running test | Abrasion amount of CTL (μm) |
|---|---|---|---|
| Ex. 144 | Good | A few black streaks (still acceptable) | 3.1 |
| Ex. 165 | Good | Good | 1.6 |

As can be understood from Table 61, the photoreceptor of Example 165 has good abrasion resistance.

Synthesis Example 49

The procedure for preparation of the wet cake of the titanyl phthalocyanine pigment in Synthesis Example 1 was repeated. The wet cake was further washed with deionized water until water-soluble inorganic salts were hardly detected from the filtrate.

Twenty (20) grams of the thus prepared wet cake of the titanyl phthalocyanine pigment were added in 200 g of 1,2-dichloroethane, and the mixture was stirred for 4 hours. Then 1000 g of methanol were added therein, and the mixture was stirred for one hour and then filtered. The filtered cake was then dried.

Thus a TiOPc of Synthesis Example 49 (hereinafter referred to as TiOPc 49) was prepared.

The TiOPc 49 was exposed to X-ray to obtain its X-ray diffraction spectrum. The conditions of the X-ray irradiation were the same as those mentioned above in Synthesis Example 1.

The X-ray diffraction spectrum of the TiOPc 49 was almost the same as that of the TiOPc 1 which is shown in FIG. 7 (i.e., main peaks were observed at least at Bragg (2 θ) angles of 9.6°±0.2°, 24.0°±0.2° and 27.2°±0.2°).

Synthesis Example 50

The TiOPc 49 was treated with 2-butanone, and then the solvent was dried to obtain a powder. Thus a TiOPc 50 was prepared. The X-ray diffraction spectrum of the TiOPc 50 was almost the same as that of the TiOPc 2 which is shown in FIG. 8 (i.e., main peaks were observed at least at Bragg (2 θ) angles of 7.5°±0.2°, 25.3°±0.2° and 28.6°±0.2°).

Synthesis Example 51

The TiOPc 49 was treated with tetrahydrofuran, and then the solvent was dried to obtain a powder. Thus a TiOPc 51 was prepared. The X-ray diffraction spectrum of the TiOPc 51 was almost the same as that of TiOPc 3 which is shown in FIG. 9 (i.e., main peaks were observed at least at Bragg (2 θ) angles of 9.3°±0.2°, 13.1°±0.2° and 26.2°±0.2°).

Synthesis Example 52

The wet cake of a titanyl phthalocyanine pigment which had been prepared in Synthesis Example 49 and which had been washed with deionized water was dispersed in methanol while agitating. The dispersion was filtered and then the cake was dried to prepare a powder. A mixture of the powder and n-butyl ether were milled and then washed with methanol followed by deionized water. The mixture was filtered and the cake was dried to obtain a powder. Thus a TiOPc 52 was prepared.

The X-ray diffraction spectrum of the TiOPc 52 was the same as that of the TiOPc 4 (i.e., main peaks was observed at least at Bragg (2 θ) angles of 9.0°±0.2°, 14.2°±0.2°, 23.9°±0.2° and 27.1°±0.2°).

Example 166

Preparation of Undercoat Layer

The following components were mixed to prepare an undercoat layer coating liquid.

| | |
|---|---|
| Titanium dioxide powder | 15 |
| Polyvinyl butyral | 3 |
| Epoxy resin | 3 |
| 2-butanone | 150 |

The thus prepared undercoat layer coating liquid was coated on an aluminum cylinder and then dried to form an undercoat layer of 2.5 μm thick thereon.

Preparation of Charge Generation Layer

The following components were mixed.

| | |
|---|---|
| TiOPc 51 prepared above | 3 |
| Polyvinyl butyral | 2 |
| Tetrahydro furan | 50 |
| 4-methyl-2-pentanone | 90 |

Deionized water in which ammonium sulfate was dissolved was added into the mixture such that the concentration of ammonium sulfate relative to the TiOPc 51 was 900 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 8 |

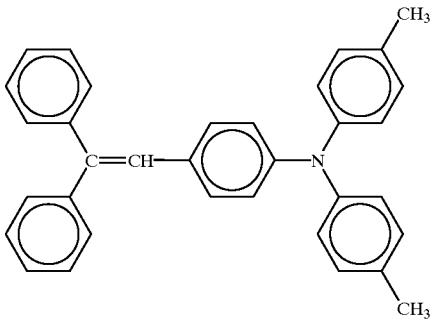

| | |
|---|---|
| Methylene chloride | 80 |

The thus prepared charge transport layer coating liquid was coated on the charge generation layer and then dried to form a charge transport layer having a thickness thereof was 22 μm.

Thus a photoreceptor of Example 166 was prepared.

Examples 167 to 170 and Comparative Examples 61 and 62

The procedure for preparation of the photoreceptor in Example 166 was repeated except that the concentration of ammonium sulfate was changed as shown in Table 62.

Thus photoreceptors of Examples 167 and 170 and Comparative Examples 61 and 62 were prepared.

Each of the thus prepared photoreceptors of Examples 166 to 170 and Comparative Examples 61 and 62 was set one by one in an electrophotographic image forming apparatus as shown in FIG. 4 and preserved under a condition of 30° C. and 90% RH for one day. Then images were produced. Evaluation of the images was performed with respect to white images. At this point, a laser diode emitting a laser having a wavelength of 780 nm was used as a light source of imagewise light irradiating device 5. In addition, a probe of a surface potential meter was set at a position just before the developing area to measure the surface potentials of a lighted area of the photoreceptor which had been exposed to light and a dark area which had not been exposed to light.

The results are shown in Table 62.

TABLE 62

| | Conc. of inorganic salts (ppm) | Surface Potential (V) | | Image qualities | |
|---|---|---|---|---|---|
| | | Dark area | Lighted area | Initial | After preservation test |
| Ex. 166 | 900 | −900 | −185 | Good | A few black spots |
| Ex. 167 | 500 | −900 | −185 | Good | A few black spots |
| Ex. 168 | 300 | −900 | −182 | Good | Few black spots |
| Ex. 169 | 100 | −900 | −185 | Good | Few black spots |
| Ex. 170 | 0 (inorganic salts were not detected) | −900 | −195 | Good | A few black spots |
| Comp. Ex. 61 | 1300 | −900 | −185 | Good | Many black spots |
| Comp. Ex. 62 | 5000 | −900 | −180 | Good | Many black spots |

As can be understood from Table 62, when the concentration of ammonium sulfate is greater than 1000 ppm, the resultant white images have many black spots although the resultant photoreceptor has good charge properties and produces images having good image qualities except the black spots even after the photoreceptor is preserved under a high temperature and high humidity condition. When the photoreceptor includes no inorganic salts, the residual potential of the photoreceptor has a relatively high after preserved under a high temperature and high humidity condition.

When the TiOPc was insufficiently subjected to a washing treatment and/or a refining treatment, impurities of water-soluble inorganic salts mainly including a sulfate ion and an ammonium ion tend to be included in the TiOPc. In addition, a sodium ion, a potassium ion, a nitrate ion etc. tend to be also included in the TiOPc. When the total of the concentration of the water-soluble inorganic salts was greater than 1000 ppm, the above-mentioned black spot image problem tends to occur, which is similar to this case in which ammonium sulfate (water-soluble inorganic salt) is intendedly added. Therefore, it is said that the black spot image problem occurs when the concentration of water-soluble inorganic salts is greater than the specific value (1000 ppm) independent of whether the water-soluble inorganic salts are intendedly included in the TiOPc or included due to insufficient washing and refining.

Example 171

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 2 $\mu$m thick thereon.

Preparation of Charge Generation Layer

The following components were mixed.

| | |
|---|---|
| TiOPc 49 prepared above | 4 |
| Polyvinyl butyral | 2 |
| Cyclohexanone | 50 |
| Tetrahydrofuran | 100 |

Inorganic salts of ammonium sulfate, sodium sulfate and sodium chloride were added into the mixture such that the concentration of the inorganic salts relative to the TiOPc 49 was 900 ppm. In this case, the weight ratio of the added ammonium sulfate, sodium sulfate and sodium chloride was 10:1:1. Thus, a charge generation layer coating liquid was prepared.

The thus prepared charge generation layer coating liquid was coated on the undercoat layer and then dried to form a charge generation layer having a thickness of 0.2 $\mu$m thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

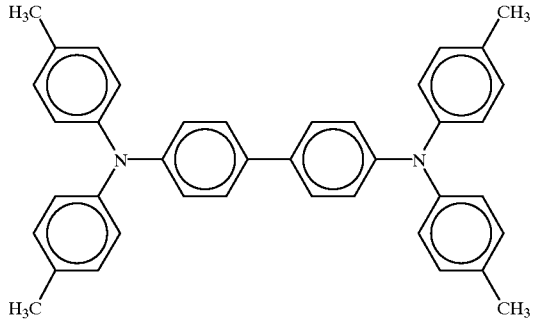

| | |
|---|---|
| Tetrahydrofuran | 80 |

The thus prepared charge transport layer coating liquid was coated on the charge generation layer and then dried to form a charge transport layer having a thickness thereof was 20 $\mu$m.

Thus a photoreceptor of Example 171 was prepared.

Examples 172 to 175 and Comparative Examples 63 and 64

The procedure for preparation of the photoreceptor in Example 171 was repeated except that the concentration of the inorganic salts was changed as shown in Table 63.

Thus photoreceptors of Examples 172 to 175 and Comparative Examples 63 and 64 were prepared.

Each of the thus prepared photoreceptors of Examples 171 to 175 and Comparative Examples 63 and 64 was set one by one in an electrophotographic image forming apparatus as shown in FIG. 5 and preserved under a condition of 30° C. and 90% RH for one day. Then images were produced. At this point, a laser diode emitting a laser having a wavelength of 780 nm was used as a light source of imagewise light irradiating device 24. Laser light emitted from the laser diode was irradiated to the photoreceptor via a polygon mirror. The image qualities of the copy images were visually evaluated.

The results are shown in Table 63.

TABLE 63

| | Conc. of inorganic salts (ppm) | Image qualities after the preservation test (30° C. and 90% RH) |
|---|---|---|
| Ex. 171 | 900 | A few black spots |
| Ex. 172 | 500 | A few black spots |
| Ex. 173 | 300 | Few black spots |
| Ex. 174 | 100 | Few black spots |
| Ex. 175 | 0 (inorganic salts were not detected) | Few black spots |
| Comp. Ex. 63 | 1300 | Many black spots |
| Comp. Ex. 64 | 2000 | Many black spots |

As can be understood from Table 63, when the concentration of the inorganic salts is not greater than 1000 ppm, the resultant photoreceptor does not cause the black spot image problem.

Example 176

Preparation of Undercoat Layer

An aluminum cylinder was subjected to an anodic oxidation treatment and then the anodic oxidation coating was sealed.

Preparation of Charge Generation Layer

The following components were mixed.

| | |
|---|---|
| TiOPc 50 prepared above | 3 |
| Polyvinyl butyral | 1 |
| Cyclohexanone | 250 |
| Cyclohexane | 50 |

Inorganic salts of ammonium sulfate and sodium sulfate were added into the mixture such that the concentration of the inorganic salts relative to the TiOPc 50 was 900 ppm. In this case, the weight ratio of ammonium sulfate to sodium sulfate was 10: 10. Thus, a charge generation layer coating liquid was prepared.

The thus prepared charge generation layer coating liquid was coated on the anodic oxidation coating and then dried to form a charge generation layer having a thickness of 0.2 $\mu$m thereon.

Preparation of charge transport layer coating liquid

The following components were mixed to prepare a charge transport layer coating liquid.

| | |
|---|---|
| Polycarbonate resin | 10 |
| Charge transport material having the following formula | 7 |

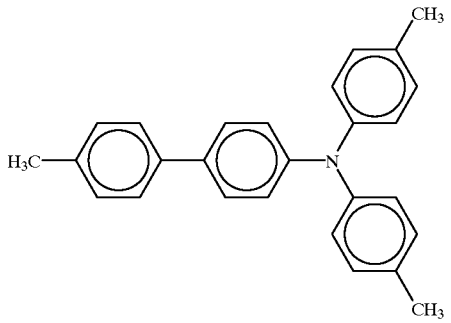

| | |
|---|---|
| Methylene chloride | 80 |

The thus prepared charge transport layer coating liquid was coated on the charge generation layer and then dried to form a charge transport layer having a thickness thereof was 20 μm.

Thus a photoreceptor of Example 176 was prepared.

Examples 177 to 180 and Comparative Examples 65 and 66

The procedure for preparation of the photoreceptor in Example 176 was repeated except that the concentration of the inorganic salts was changed as shown in Table 64.

Thus photoreceptors of Examples 177 to 180 and Comparative Examples 65 and 66 were prepared.

Each of the thus prepared photoreceptors of Examples 176 to 180 and Comparative Examples 65 and 66 was set one by one in an electrophotographic process cartridge as shown in FIG. 6 and then the cartridge was set in an image forming apparatus and preserved under a high temperature and high humidity condition for one day. Then an image forming test was performed. At this point, a laser diode emitting a laser having a wavelength of 780 nm was used as a light source of imagewise light irradiating device 19. Laser light emitted from the laser diode was irradiated to the photoreceptor via a polygon mirror.

The results are shown in Table 64.

TABLE 64

| | Conc. of inorganic salts (ppm) | Image qualities after preservation test (after preserved under a condition of 30° C. and 90% RH for one day) |
|---|---|---|
| Ex. 176 | 900 | A few black spots |
| Ex. 177 | 500 | A few black spots |
| Ex. 178 | 300 | Few black spots |
| Ex. 179 | 100 | Few black spots |
| Ex. 180 | 0 (inorganic salts were not detected) | Few black spots |
| Comp. Ex. 65 | 1300 | Many black spots |
| Comp. Ex. 66 | 2000 | Many black spots |

As can be understood from Table 64, when the concentration of the inorganic salts is not greater than 1000 ppm, the resultant photoreceptor does not cause the black spot image problem even after preserved under a high temperature and high humidity condition.

Example 181

Preparation of Undercoat Layer

The following components were mixed to prepare an undercoat layer coating liquid.

| | |
|---|---|
| Titanium dioxide powder | 5 |
| Alcohol-soluble nylon | 4 |
| Methanol | 50 |
| Isopropanol | 20 |

The thus prepared undercoat layer coating liquid was coated on the surface of a nickel belt prepared by an electroforming method and then dried to form an undercoat layer of 1.5 μm thick thereon.

Preparation of Charge Generation Layer

The following components were mixed.

| | |
|---|---|
| TiOPc 52 prepared above | 4 |
| Polyvinyl butyral | 2 |
| Cyclohexanone | 50 |
| Tetrahydrofuran | 100 |

Ammonium sulfate was added into the mixture such that the concentration thereof relative to the TiOPc 52 was 900 ppm. Thus, a charge generation layer coating liquid was prepared.

The thus prepared charge generation layer coating liquid was coated on the undercoat layer and then dried to form a charge generation layer having a thickness of 0.3 μm thereon.

Preparation of Charge Transport Layer Coating Liquid

The following components were mixed to prepare a charge transport layer coating liquid.

| | |
|---|---|
| Polycarbonate resin | 10 |
| Charge transport material having the following formula | 9 |

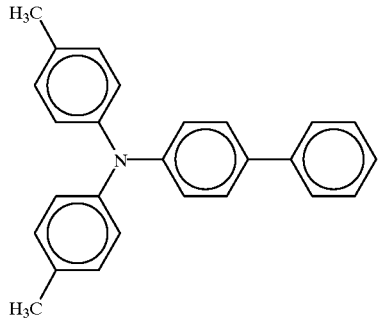

| | |
|---|---|
| Tetrahydrofuran | 80 |

The thus prepared charge transport layer coating liquid was coated on the charge generation layer and then dried to form a charge transport layer having a thickness thereof was 25 μm.

Thus a photoreceptor of Example 181 was prepared.

Examples 182 to 185 and Comparative Examples 67 and 68

The procedure for preparation of the photoreceptor in Example 181 was repeated except that the concentration of inorganic salt was changed as shown in Table 65.

Thus photoreceptors of Examples 182 to 186 and Comparative Examples 67 and 68 were prepared.

Each of the thus prepared photoreceptors of Examples 181 to 185 and Comparative Examples 67 and 68 was set one by one in an electrophotographic image forming apparatus as shown in FIG. 5 and preserved under a condition of 30° C. and 90% RH for one day. Then an image forming test was performed. At this point, a laser diode emitting a laser having a wavelength of 780 nm was used as a light source of imagewise light irradiating device 24. Laser light emitted from the laser diode was irradiated to the photoreceptor via a polygon mirror.

The results are shown in Table 65.

TABLE 65

| | Conc. Of ammonium sulfate (ppm) | Image qualities after the preservation test (after preserved under a condition of 30° C. and 90% RH) |
|---|---|---|
| Ex. 181 | 900 | A few black spots |
| Ex. 182 | 500 | A few black spots |
| Ex. 183 | 300 | Few black spots |
| Ex. 184 | 100 | Few black spots |
| Ex. 185 | 0 (ammonium sulfate was not detected) | Few black spots |
| Comp. Ex. 67 | 1300 | Many black spots |
| Comp. Ex. 68 | 2000 | Many black spots |

As can be understood from Table 65, when the concentration of ammonium sulfate is not greater than 1000 ppm, the resultant photoreceptor does not cause the black spot image problem even after preserved under the high temperature and high humidity condition.

Example 186

The procedure for preparation of the photoreceptor in Example 166 was repeated except that the formulation of the charge transport layer coating liquid was changed as follows.

| | |
|---|---|
| Charge transport polymer material having the following formula | 10 |

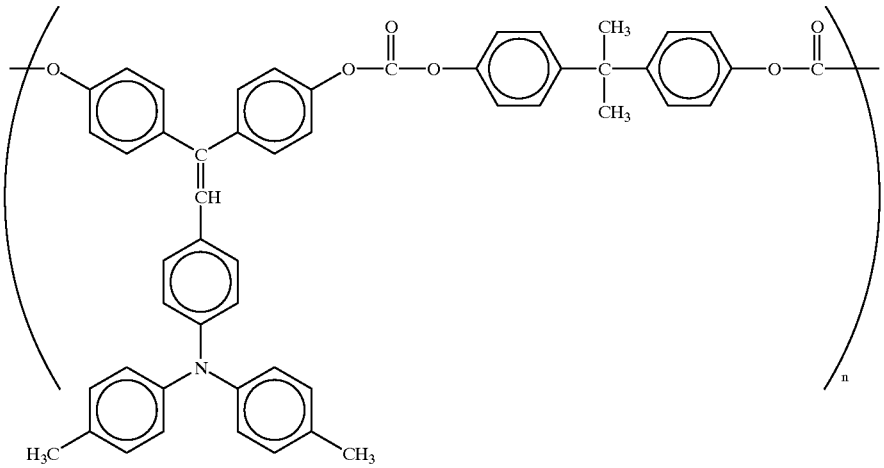

| | |
|---|---|
| Methylene chloride | 100 |

Thus, a photoreceptor of Example 186 was prepared.

Each of the photoreceptors of Examples 166 and 186 was evaluated by the evaluation method (4) mentioned above. In the running test 10,000 copies were continuously produced.

The results are shown in Table 66.

TABLE 66

| | Image qualities (initial) | Image qualities after running test | Abrasion amount of CTL ($\mu$m) |
|---|---|---|---|
| Ex. 166 | Good | A few black streaks (still acceptable) | 3.1 |
| Ex. 186 | Good | Good | 1.6 |

As can be understood from Table 66, the photoreceptor of Example 186 has good abrasion resistance.

Examples 187 to 191 and Comparative Examples 69 and 70

The procedure for preparation of the photoreceptors in Examples 166 to 170 and Comparative Examples 61 and 62 was repeated except that the TiOPc 51 was replaced with an azo pigment having the following formula and the inorganic salt was changed to sodium chloride.

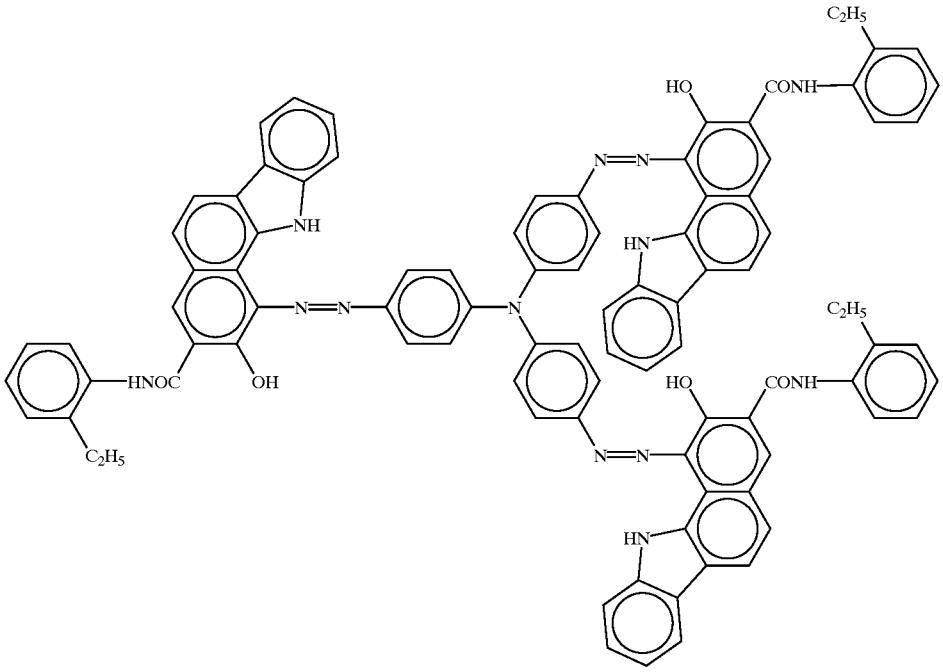

Thus, photoreceptors of Examples 187 to 191 and Comparative Examples 69 and 70 were prepared.

The photoreceptors were evaluated in the same way as performed in Example 166. The results are shown in Table 67.

TABLE 67

| | Image qualities | |
|---|---|---|
| | Initial | After preservation test |
| Ex. 187 | good | A few black spots |
| Ex. 188 | good | A few black spots |
| Ex. 189 | good | Few black spots |
| Ex. 190 | good | Few black spots |
| Ex. 191 | good | A few black spots |
| Comp. Ex. 69 | good | Many black spots |
| Comp. Ex. 70 | good | Many black spots |

As can be understood from Table 67, the effects of the present invention can be exerted independently of the species of the charge generation materials used and the inorganic salts impurities included therein.

As can be understood from the above-description, when the concentrations of the ions in the photosensitive layer including a TiOPc as a charge generation material are as follows:

$K^+$ ion: not greater than 50 ppm, $Na^+$ ion: not greater than 200 ppm, $NO_3^-$ ion: not less than 50 ppm, $HCOO^-$ ion: not greater than 100 ppm, $NO_2^-$ ion: not greater than 50 ppm, $Cl^-$ ion: not greater than 100 ppm, $Br^-$ ion: not less than 50 ppm, and $NH_4^+$ ion: from 10 to 300 ppm, the resultant photoreceptor has good charge properties even when repeatedly used while having high sensitivity.

In addition, when the concentration of water-soluble inorganic salts in a photosensitive layer including an organic pigment as a charge generation material is not greater than 1000 ppm, the resultant photoreceptor hardly causes the black spot problem even after the photoreceptor is preserved under high temperature and high humidity conditions.

Further, a photoreceptor having good abrasion resistance while keeping the above-mentioned good charge properties and image qualities.

Furthermore, an image forming method is provided by which good images can be repeatedly produced at a high speed for a long period of time and even after the photoreceptor is preserved under high temperature and high humidity conditions.

Furthermore, an image forming apparatus and process cartridge in which good images can be repeatedly produced at a high speed for a long period of time can be provided and even after the photoreceptor is preserved under high temperature and high humidity conditions.

Having now fully described the invention, it will be apparent to one of ordinary skill in the art that many changes and modifications can be made thereto without departing from the spirit and scope of the invention as set forth therein.

This application is based on Japanese Patent Applications Nos. 11-352720, and 2000-042702, filed on Dec. 13, 1999, and Feb. 21, 2000, respectively, the contents of which are hereby incorporated by reference.

What is claimed as new and desired to be secured by Letters Patent of the United States is:

1. A photoreceptor comprising an electroconductive substrate and a photosensitive layer overlying the electroconductive substrate, wherein the photosensitive layer comprises a charge generation material comprising an organic pigment, and wherein the photosensitive layer further comprises $HCOO^-$ ion in an amount not greater than 100 ppm relative to the total amount of organic pigment.

2. The photoreceptor of claim 1, wherein the organic pigment comprises titanyl phthalocyanine.

3. The photoreceptor according to claim 2, wherein the titanyl phthalocyanine has an X-ray diffraction spectrum in which main diffraction peaks are observed at Bragg (2 θ) angles of 9.6°±0.2°, 24.0±0.2° and 27.2±0.2° when a specific X-ray of Cu-Kα having a wavelength of 1.542 Å irradiates the titanyl phthalocyanine.

4. The photoreceptor according to claim 2, wherein the titanyl phthalocyanine has an X-ray diffraction spectrum in which main diffraction peaks are observed at Bragg (2 θ) angles of 7.5°±0.2°, 25.3±0.2° and 28.6±0.2° when a specific X-ray of Cu-Kα having a wavelength of 1.541 Å irradiates the titanyl phthalocyanine.

5. The photoreceptor according to claim 2, wherein the titanyl phthalocyanine has an X-ray diffraction spectrum in which main diffraction peaks are observed at Bragg (2θ) angles of 9.3°±0.2°, 13.1±0.2° and 26.2±0.2° when a specific X-ray of Cu-Kα having a wavelength of 1.542 Å irradiates the titanyl phthalocyanine.

6. The photoreceptor according to claim 2, wherein the titanyl phthalocyanine has an X-ray diffraction spectrum in which main diffraction peaks are observed at Bragg (2θ) angles of 9.0°±0.2°, 14.2±0.2°, 23.9±0.2° and 27.1±0.2° when a specific X-ray of Cu-Kα having a wavelength of 1.542 Å irradiates the titanyl phthalocyanine.

7. The photoreceptor according to claim 2, wherein the titanyl phthalocyanine further comprises a $Na^+$ ion in an amount not greater than 200 ppm.

8. The photoreceptor according to claim 2, wherein the titanyl phthalocyanine further comprises a $NO_3^-$ ion in an amount not greater than 50 ppm.

9. The photoreceptor according to claim 2, wherein the titanyl phthalocyanine further comprises a $NO_2^-$ ion in an amount not greater than 50 ppm.

10. The photoreceptor according to claim 2, wherein the titanyl phthalocyanine further comprises a $Cl^-$ ion in an amount not greater than 100 ppm.

11. The photoreceptor according to claim 2, wherein the titanyl phthalocyanine further comprises a $Br^-$ ion in an amount not greater than 50 ppm.

12. The photoreceptor according to claim 2, wherein the titanyl phthalocyanine further comprises a $NH_4^+$ ion in an amount of from 10 ppm to 300 ppm.

13. The photoreceptor according to claim 2, wherein the titanyl phthalocyanine comprises a $K^+$ ion in an amount not greater than 50 ppm.

14. The photoreceptor according to claim 1, wherein the photosensitive layer further comprises a $Na^+$ ion in an amount not greater than 200 ppm relative to the total amount of the organic pigment.

15. The photoreceptor according to claim 1, wherein the photosensitive layer further comprises a $NO_3^-$ ion in an amount not greater than 50 ppm relative to the total amount of the organic pigment.

16. The photoreceptor according to claim 1, wherein the photosensitive layer further comprises a $NO_2^-$ ion in an amount not greater than 50 ppm relative to the total amount of the organic pigment.

17. The photoreceptor according to claim 1, wherein the photosensitive layer further comprises a $Cl^-$ ion in an amount not greater than 100 ppm relative to the total amount of the organic pigment.

18. The photoreceptor according to claim 1, wherein the photosensitive layer further comprises a $Br^-$ ion in an amount not greater than 50 ppm relative to the total amount of the organic pigment.

19. The photoreceptor according to claim 1, wherein the photosensitive layer further comprises a $NH_4^+$ ion in an amount of from 10 ppm to 300 ppm relative to the total amount of the organic pigment.

20. The photoreceptor according to claim 1, wherein the photosensitive layer further comprises a charge generation layer comprising the charge generation material and a charge transport layer.

21. The photoreceptor according to claim 20, wherein the charge transport layer comprises a polycarbonate resin comprising a triarylamine group in at least one of a main chain or a side chain thereof.

22. The photoreceptor according to claim 2, wherein the photosensitive layer further comprises a $K^+$ ion in an amount not greater than 50 ppm relative to the total amount of the organic pigment.

23. An electrophotographic image forming method comprising:

charging a surface of a photoreceptor;

irradiating the photoreceptor with light to form an electrostatic latent image on the surface of the photoreceptor;

developing the electrostatic image with a toner to form a toner image on the surface of the photoreceptor; and transferring the toner image onto a receiving material, wherein the photoreceptor comprises an electroconductive substrate and a photosensitive layer on the electroconductive substrate, wherein the photosensitive layer comprises a charge generation material comprising an organic pigment, and wherein the photosensitive layer further comprises a $HCOO^-$ ion in an amount not greater than 100 ppm relative to the total amount of the organic pigment.

24. The image forming method according to claim 23, wherein the organic pigment comprises a titanyl phthalocyanine.

25. The image forming method according to claim 24, wherein the titanyl phthalocyanine has an X-ray diffraction spectrum in which main diffraction peaks are observed at Bragg (2θ) angles of 9.6°±0.2°, 24.0±0.2° and 27.2±0.2° when a specific X-ray of Cu-Kα having a wavelength of 1.542 Å irradiates the titanyl phthalocyanine.

26. The image forming method according to claim 24, wherein the titanyl phthalocyanine has an X-ray diffraction spectrum in which main diffraction peaks are observed at Bragg (2θ) angles of 7.5°±0.2°, 25.3±0.2° and 28.6±0.2° when a specific X-ray of Cu-Kα having a wavelength of 1.542 Å irradiates the titanyl phthalocyanine.

27. The image forming method according to claim 24, wherein the titanyl phthalocyanine has an X-ray diffraction spectrum in which main diffraction peaks are observed at Bragg (2θ) angles of 9.3°±0.2°, 13.1±0.2° and 26.2±0.2° when a specific X-ray of Cu-Kα having a wavelength of 1.542 Å irradiates the titanyl phthalocyanine.

28. The image forming method according to claim 24, wherein the titanyl phthalocyanine has an X-ray diffraction spectrum in which main diffraction peaks are observed at Bragg (2θ) angles of 9.0°±0.2°, 14.2±0.2°, 23.9±0.2° and 27.1±0.2° when a specific X-ray of Cu-Kα having a wavelength of 1.542 Å irradiates the titanyl phthalocyanine.

29. The image forming method according to claim 23, wherein the photosensitive layer further comprises a $Na^+$ ion in an amount not greater than 200 ppm relative to the total amount of the organic pigment.

30. The image forming method according to claim 23, wherein the photosensitive layer further comprises a $NO_3^-$ ion in an amount not greater than 50 ppm relative to the total amount of the organic pigment.

31. The image forming method according to claim 23, wherein the photosensitive layer further comprises a $NO_2^-$ ion in an amount not greater than 50 ppm relative to the total amount of the organic pigment.

32. The image forming method according to claim 23, wherein the photosensitive layer further comprises a $Cl^-$ ion in an amount not greater than 100 ppm relative to the total amount of the organic pigment.

33. The image forming method according to claim 23, wherein the photosensitive layer further comprises a $Br^-$ ion in an amount not greater than 50 ppm relative to the total amount of the organic pigment.

34. The image forming method according to claim 23, wherein the photosensitive layer further comprises a $NH_4^+$ ion in an amount of from 10 to 300 ppm relative to the total amount of the organic pigment.

35. The image forming method according to claim 23, wherein the photosensitive layer further comprises a charge generation layer comprising the charge generation material and a charge transport layer.

36. The image forming method according to claim 35, wherein the charge transport layer further comprises a polycarbonate resin comprising a triarylamine group in at least one of a main chain or a side chain thereof.

37. The image forming method according to claim 23, wherein the photosensitive layer further comprises a $K^+$ ion in an amount not greater than 50 ppm relative to the total amount of the organic pigment.

38. An electrophotographic image forming apparatus comprising:

a photoreceptor;

a charger which charges a surface of the photoreceptor;

a light irradiating device which irradiates the surface of the photoreceptor with light to form an electrostatic latent image on the surface of the photoreceptor;

a developing device which develops the electrostatic image with a toner to form a toner image on the surface of the photoreceptor; and a transfer device which transfers the toner image on the photoreceptor to a receiving material, wherein the photoreceptor comprises an electroconductive substrate and a photosensitive layer overlying the electroconductive substrate, wherein the photosensitive layer comprises a charge generation material comprising an organic pigment, and wherein the photosensitive layer further comprises a HCOO— ion in an amount not greater than 100 ppm relative to the total amount of the organic pigment.

39. The image forming apparatus of claim 38, wherein the organic pigment comprises a titanyl phthalocyanine.

40. The image forming apparatus according to claim 39, wherein the titanyl phthalocyanine has an X-ray diffraction spectrum in which main diffraction peaks are observed at Bragg (2θ) angles of 9.6°±0.2°, 24.0±0.2° and 27.2±0.2° when a specific X-ray of Cu-Kα having a wavelength of 1.542 Å irradiates the titanyl phthalocyanine.

41. The image forming apparatus according to claim 39, wherein the titanyl phthalocyanine has an X-ray diffraction spectrum in which main diffraction peaks are observed at Bragg (2θ) angles of 7.5°±0.2°, 25.3±0.2° and 28.6±0.2° when a specific X-ray of Cu-Kα having a wavelength of 1.542 Å irradiates the titanyl phthalocyanine.

42. The image forming apparatus according to claim 39, wherein the titanyl phthalocyanine has an X-ray diffraction spectrum in which main diffraction peaks are observed at Bragg (2θ) angles of 9.3°±0.2°, 13.1±0.2° and 26.2±0.2° when a specific X-ray of Cu-Kα having a wavelength of 1.542 Å irradiates the titanyl phthalocyanine.

43. The image forming apparatus according to claim 39, wherein the titanyl phthalocyanine has an X-ray diffraction spectrum in which main diffraction peaks are observed at Bragg (2θ) angles of 9.0°±0.2°, 14.2±0.2°, 23.9±0.2° and 27.1±0.2° when a specific X-ray of Cu-Kα having a wavelength of 1.542 Å irradiates the titanyl phthalocyanine.

44. The image forming apparatus according to claim 38, wherein the photosensitive layer further comprises a $Na^+$ ion in an amount not greater than 200 ppm relative to the total amount of the organic pigment.

45. The image forming apparatus according to claim 38, wherein the photosensitive layer further comprises a $NO_3^-$ ion in an amount not greater than 50 ppm relative to the total amount of the organic pigment.

46. The image forming apparatus according to claim 38, wherein the photosensitive layer further comprises a $NO_2^-$ ion in an amount not greater than 50 ppm relative to the total amount of the organic pigment.

47. The image forming apparatus according to claim 38, wherein the photosensitive layer further comprises a $Cl^-$ ion in an amount not greater than 100 ppm relative to the total amount of the organic pigment.

48. The image forming apparatus according to claim 38, wherein the photosensitive layer further comprises a $Br^-$ ion in an amount not greater than 50 ppm relative to the total amount of the organic pigment.

49. The image forming apparatus according to claim 38, wherein the photosensitive layer further comprises a $NH_4^+$ ion in an amount of from 10 to 300 ppm relative to the total amount of the organic pigment.

50. The image forming apparatus according to claim 38, wherein the photosensitive layer further comprises a charge generation layer comprising the charge generation material and a charge transport layer.

51. The image forming apparatus according to claim 50, wherein the charge transport layer further comprises a polycarbonate resin comprising a triarylamine group in at least one of a main chain or a side chain thereof.

52. The image forming apparatus according to claim 38, wherein the charger charges the photoreceptor while contacting the surface of the photoreceptor.

53. The image forming apparatus according to claim 38, wherein the charger charges the photoreceptor while close to, but not touching, the surface of the photoreceptor.

54. The image forming apparatus according to claim 38, wherein the charger charges the photoreceptor while applying a DC voltage overlapped with an AC voltage to the surface of the photoreceptor.

55. The image forming apparatus according to claim 38, wherein the light irradiating device comprises a light source selected from the group consisting of laser diodes and light emitting diodes.

56. The image forming apparatus according to claim 38, wherein the photosensitive layer further comprises a $K^+$ ion in an amount not greater than 50 ppm relative to the total amount of the organic pigment.

57. A process cartridge comprising a photoreceptor, wherein the process cartridge can be attached to and detached from an electrophotographic image further apparatus, wherein the photoreceptor comprises an electroconductive substrate and a photosensitive layer overlying the electroconductive substrate, wherein the photosensitive layer comprises a charge generation material comprising an organic pigment, and wherein the photosensitive layer further comprises a HCOO— ion in an amount not greater than 100 ppm relative to the total amount of the organic pigment.

58. The process cartridge according to claim 57, wherein the organic pigment comprises a titanyl phthalocyanine.

59. The process cartridge according to claim 58, wherein the titanyl phthalocyanine has an X-ray diffraction spectrum in which main diffraction peaks are observed at Bragg (2θ) angles of 9.6°±0.2°, 24.0±0.2° and 27.2±0.2° when a specific X-ray of Cu-Kα having a wavelength of 1.542 Å irradiates the titanyl phthalocyanine.

60. The process cartridge according to claim 58, wherein the titanyl phthalocyanine has an X-ray diffraction spectrum in which main diffraction peaks are observed at Bragg (2θ) angles of 7.5°±0.2°, 25.3±0.2° and 28.6±0.2° when a specific X-ray of Cu-Kα having a wavelength of 1.542 Å irradiates the titanyl phthalocyanine.

61. The process cartridge according to claim 58, wherein the titanyl phthalocyanine has an X-ray diffraction spectrum in which main diffraction peaks are observed at Bragg (2θ) angles of 9.3°±0.2°, 13.1±0.2° and 26.2±0.2° when a specific X-ray of Cu-Kα having a wavelength of 1.542 Å irradiates the titanyl phthalocyanine.

62. The process cartridge according to claim 58, wherein the titanyl phthalocyanine has an X-ray diffraction spectrum in which main diffraction peaks are observed at Bragg (2θ) angles of 9.0°±0.2°, 14.2±0.2°, 23.9±0.2° and 27.1±0.2° when a specific X-ray of Cu-Kα having a wavelength of 1.542 Å irradiates the titanyl phthalocyanine.

63. The process cartridge according to claim 57, wherein the photosensitive layer further comprises a $Na^+$ ion in an amount not greater than 200 ppm relative to the total amount of the organic pigment.

64. The process cartridge according to claim 57, wherein the photosensitive layer further comprises a $NO_3^-$ ion in an amount not greater than 50 ppm relative to the total amount of the organic pigment.

65. The process cartridge according to claim 57, wherein the photosensitive layer further comprises a $NO_2^-$ ion in an amount not greater than 50 ppm relative to the total amount of the organic pigment.

66. The process cartridge according to claim 57, wherein the photosensitive layer further comprises a $Cl^-$ ion in an amount not greater than 100 ppm relative to the total amount of the organic pigment.

67. The process cartridge according to claim 57, wherein the photosensitive layer further comprises a $Br^-$ ion in an amount not greater than 50 ppm relative to the total amount of the organic pigment.

68. The process cartridge according to claim 57, wherein the photosensitive layer further comprises a $NH_4^+$ ion in an amount of from 10 to 300 ppm relative to the total amount of the organic pigment.

69. The process cartridge according to claim 57, wherein the photosensitive layer further comprises a charge generation layer comprising the charge generation material and a charge transport layer.

70. The process cartridge according to claim 69, wherein the charge transport layer further comprises a polycarbonate resin comprising a triarylamine group in at least one of a main chain or a side chain thereof.

71. The process cartridge according to claim 57, wherein the photosensitive layer further comprises a $K^+$ ion in an amount not greater than 50 ppm relative to the total amount of the organic pigment.

* * * * *